United States Patent [19]

Yagi et al.

[11] Patent Number: 4,818,670

[45] Date of Patent: Apr. 4, 1989

[54] SILVER HALIDE PHOTOGRAPHIC LIGHT-SENSITIVE MATERIALS CONTAINING COMPOUND CAPABLE OF SPLITTING OF DIFFUSIBLE DEVELOPMENT INHIBITOR OR PRECURSOR AND SILVER HALIDE GRAIN HAVING INTERNAL FOG NUCLEUS

[75] Inventors: Toshihiko Yagi; Hiroshi Shimazaki, both of Hino, Japan

[73] Assignee: Konishiroku Photo Industry Co., Ltd., Tokyo, Japan

[21] Appl. No.: 15,285

[22] Filed: Feb. 17, 1987

[30] Foreign Application Priority Data

Feb. 20, 1986 [JP] Japan ..... 61-35499

[51] Int. Cl.[4] ..... G03C 1/08; G03C 1/46; G03C 7/26; G03C 7/32

[52] U.S. Cl. ..... 430/544; 430/505; 430/509; 430/552; 430/553; 430/558; 430/567; 430/955; 430/957

[58] Field of Search ..... 430/565, 957, 558, 544, 430/567, 509, 552, 553, 955

[56] References Cited

U.S. PATENT DOCUMENTS

| | | | |
|---|---|---|---|
| 4,052,213 | 10/1977 | Credner et al. | 430/443 |
| 4,431,728 | 2/1984 | Abe et al. | 430/957 |
| 4,564,587 | 1/1986 | Watanabe et al. | 430/957 |
| 4,618,571 | 10/1986 | Ichijima et al. | 430/957 |
| 4,626,498 | 12/1986 | Shuto et al. | 430/505 |
| 4,636,457 | 1/1987 | Valbusa et al. | 430/505 X |
| 4,725,529 | 2/1988 | Shimazaki et al. | 430/957 |
| 4,734,357 | 3/1988 | Mihayashi et al. | 430/957 |
| 4,737,451 | 4/1988 | Ichijima | 430/957 |

*Primary Examiner*—Mukund J. Shah, PhD

*Attorney, Agent, or Firm*—Jordan B. Bierman

[57] ABSTRACT

A silver halide photographic material is disclosed, which has high image quality in addition to high sensitivity. The photographic material comprises a support and at least one silver halide light-sensitive emulsion layer containing a compound being capable of splitting off a diffusible development-inhibitor or a precursor thereof upon a reaction with an oxidized product of a color developing agent. At least one of the silver halide light-sensitive emulsion layer layer and a layer adjacent to the light-sensitive emulsion layer contains a silver halide emulsion comprising a silver halide grain having an internal fog nucleus.

8 Claims, No Drawings

SILVER HALIDE PHOTOGRAPHIC LIGHT-SENSITIVE MATERIALS CONTAINING COMPOUND CAPABLE OF SPLITTING OF DIFFUSIBLE DEVELOPMENT INHIBITOR OR PRECURSOR AND SILVER HALIDE GRAIN HAVING INTERNAL FOG NUCLEUS

FIELD OF THE INVENTION

The present invention relates to silver halide photographic light-sensitive materials having improved running characteristics in processing and assuring high sensitivity and excellent sharpness.

BACKGROUND OF THE INVENTION

In the field of production of light-sensitive materials for amateur's color photography, high sensitivity and reduced size formatting have been achieved, and it has become necessary to meet various requirements concerning silver halide light-sensitive materials for color photography which assure high sensitivity and high image quality.

To meet these requirements, many studies have been made on silver halide light-sensitive materials for color photography containing a chemical compound (hereinafter called the diffusible DIR compound) which reacts with oxidized product of the developing agent during development and liberates the diffusible development-inhibitor or its precursor. The techniques thus developed are now indispensable as a means of improving color reproducibility, sharpness, and graininess. On the other hand, Japanese patent application No. 214852-1984 and No. 170849-1985 through No. 170853-1985 disclose the techniques concerning use of silver halide emulsion containing fog nuclei combinedly with light-sensitive silver halide emulsion for improved sensitivity.

However, these techniques have led to a new problem because the above-mentioned diffusible DIR compound accumulates in the developing solution, resulting in deterioration of sensitivity and decrease of $\gamma$ in the repetitive processing (running). Therefore, a drastic improvement is being desired because there is a trend toward more coarse control of photographic processing with the increase of in-house processing. Also, use of the diffusible DIR compound involves an fundamental and intrinsic problem that sensitivity is greatly sacrificed by addition of the diffusible DIR compound to the light-sensitive material.

On the other hand, the fact that application of the silver halide emulsion containing fog nuclei greatly impairs sharpness has been barrier to practical use. Thus, various techniques have been studied and developed to achieve high sensitivity and high image quality, but there are heaps of technical problems yet to be solved. The present invention intends to eliminate the drawbacks which the above-mentioned DIR compound and silver halide emulsion containing fog nuclei have, and to provide silver halide light-sensitive materials with higher sensitivity and more excellent image quality.

SUMMARY OF THE INVENTION

A purpose of the present invention is to provide a silver halide photographic light-sensitive material having high image quality (especially, sharpness) in addition to high sensitivity. Another object is to provide a silver halide light-sensitive material for photography with improved changes in properties of the developing solution during repetitive development.

The objects of the present invention have been attained by a silver halide photographic light-sensitive material comprising a support, provided thereon, and at least one silver halide light-sensitive emulsion layer, in which the silver halide light-sensitive emulsion layer contains a compound being capable of splitting off a diffusible development-inhibitor, simply called inhibitor hereinafter, or a precursor thereof upon a reaction with a oxidized product of a color developing agent, and at least one of the silver halide light-sensitive emulsion layer and a layer adjacent to the silver halide light-sensitive emulsion layer contains a silver halide emulsion comprising a silver halide grain having an internal fog nucleus.

DETAILED DESCRIPTION OF THE INVENTION

In the present invention, the diffusion of inhibiting groups are assessed according to the following procedures: The light-sensitive material samples A and B consisting of the layers mentioned below is coated on a transparent support. Sample A: Sample containing a green sensitive silver halide emulsion Green sensitive silver iodobromide subjected to spectral sensitization (containing 6 mol % of silver iodide, and having the grain size of 0.48 $\mu$m) and gelatinous solution containing 0.07 mol of magenta coupler (MC) per mol of silver is coated so that the amount of coated silver may be 1.1 g/m$^2$ and that the amount of gelatin attached may be 3.0 g/m$^2$; and, further, gelatin solution containing silver iodobromide (containing silver bromide of 2 mol % and having the average grain size of 0.08 $\mu$m) not subjected to chemical or spectral sensitization is coated to form a protective layer so that the amount of silver coated may be 0.1 g/m$^2$ and that the amount of gelatin coated may be 0.8 g/m$^2$.

(MC)

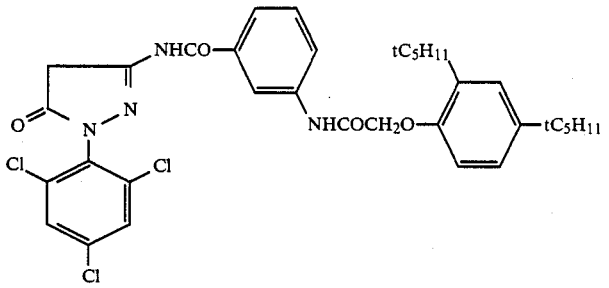

Sample B: Similar to Sample A except that the protective layer does not contain silver iodobromide. In addition, each layer contains hardener and surface acitve agent.

Processing is carried out according to Example 1 of implementation described later except that development is performed 2 minutes 40 seconds after Samples A and B are exposed to white light. The developing solution to which various inhibitors are added to suppress the sensitivity of Sample B to 60% ($-\Delta \log E=0.22$ in logarithmic expression) and that not containing such inhibitors are used.

If the sensitivity of Sample A and that of Sample B without containing inhibitors are expressed as So and So', and the sensitivity of Sample A and that of Sample B containing inhibitors as $S_A$ and $S_B$, then the sensitivity decrement of Sample A and that of Sample B will be respectively expressed as:

$$\Delta So = So' - S_A$$

$$\Delta S = So - S_B$$

The diffusibility is given by ΔS/ΔSo.

Here, sensitivity is a logarithm of the reciprocal (−log E) of the amount of light exposure at the point where the fog density is +0.3.

The values thus calculated is used as yardsticks for diffusion. Table 1 shows the diffusibility of some types of inhibitors.

TABLE 1

| Compound No. | Structure | Amount of added (mol/l) | Sensitivity decrement ΔSo | Sensitivity decrement ΔS | Diffusibility ΔS/ΔSo |
|---|---|---|---|---|---|
| A-6 | 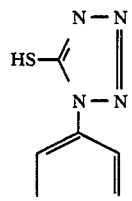 | $1.3 \times 10^{-5}$ | 0.22 | 0.05 | 0.23 |
| A-8 | 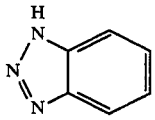 | $1.7 \times 10^{-4}$ | 0.21 | 0.20 | 0.95 |

In the present invention, the diffusible DIR compound has the diffusibility of 0.35 or more, and preferably 0.40 or more.

The diffusible DIR compound used in the present invention may be selected among compounds which are expressed, for instance, by the following formula:

Formula for diffusible DIR compound (1)

COUP-(-Y)m

In the above formula, COUP represents a coupler residue, and m for 1 or 2. Y is the group which is bonded to the coupling position of COUP and splitted off as a result or reaction with an oxidized product of color developing agent, and this group stands for the inhibitor having high diffusibility, or compound which can release inhibitor.

Coup may only has the nature of the coupler and it need not produce coloring matters.

In the formula (1) for the diffusible DIR compound (1), Y is represented by the formulae (2A) through (5) below:

Formula (2A)

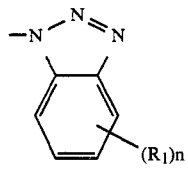

Formula (2B)

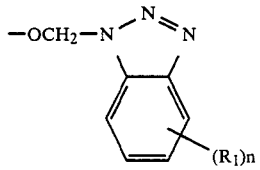

Formula (2C)

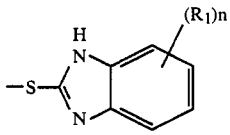

Formula (2D)

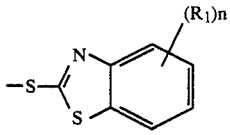

Formula (2E)

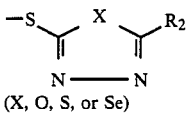

Formula (3)

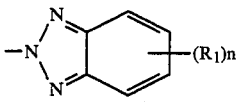

Formula (4)

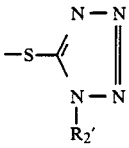

Formula (5)

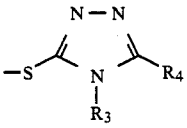

In the formulae (2A) through (2D) and (3), $R_1$ represents an alkyl group, alkoxy group, acyl amino group, halogen atom, alkoxycarbonyl group, thiazolidenamino group, aryloxycarbonyl group, acyloxy group, carbamoyl group, N-alkyl-carbamoyl group, N, N-dialkylcarbamoyl group, nitro group, amino group, N-aryl carbamoyloxy group, sulfamoyl group, N-alkyl-carbamoyloxy group, hydroxy group, alkoxy carbonylamino group, alkylthio group, arylthio group, aryl group, heterocyclic group, cyano group, alkylsulfonyl group or aryloxycarbonylamino group. The symbol n represents 1 or 2. if n is 2, $R_1$ may be the same or different groups each other. The total number of carbons contained in $R_1$ whose number is equivalent to n is any number from 0 to 10.

$R_2$ in the above formula (2E) has the same meaning as $R_1$ in the formulae (2A) through (2D) with X representing the oxygen atom, sulfur atom, or selenium atom; and, in the formula (4), $R_2'$ representing an alkyl, aryl or heterocyclic group.

In the formula (5), $R_3$ represents a hydrogen atom, alkyl group, aryl group, or heterocyclic group, and $R_4$ represents the hydrogen atom, alkyl group, aryl group, halogen atom, acylamino group, alkoxycarbonylamino group, aryloxy carbonyl amino group, alkane sufonamide group, cyano group, heterocyclic group, alkylthio group, or amino group. When $R_1$, $R_2$, $R_3$, or $R_4$ represents an alkyl group, it may be either substituted or non-substituted, or a straight chain or branched chain, or else it may be cyclic alkyl. The substituent is the halogen atom, nitro group, cyano group, aryl group, alkoxy group, aryloxy group, alkoxy carbomoyl group, aryloxy carbonyl group, sulfamoyl group, carbamoyl group, hydroxy group, alkane sulfonyl group, aryl sulfonyl group, alkylthio group or arylthio group.

When each of $R_1$, $R_2$, $R_3$, or $R_4$ represents an aryl group, it may be substituted. For this purpose, an alkyl group, alkenyl group, alcoxy group, alkoxy carbonyl group, halogen atom, nitro group, amino group, sulfamoyl group, hydroxy group, carbamoyl group, aryloxy carbonyl amino group alkoxy carbonyl amino group, acyl amino group, cyano group, or ureido group may be used.

When each of $R_1$, $R_2$, $R_3$, or $R_4$ represents the heterocyclic group, it stands for a single ring or condensed ring having five or six members including a nitrogen atom, oxygen atom and sulfur atom as heteroatoms; and it is selected among a pyridyl group, quinoryl group, furyl group, benzothiazolyl group, oxazoryl group, imidazoryl group, thiazoryl group, triazoryl group, benzotriazoryl group, imido groupm, and oxazine group; and they may have substituents mentioned above in connection with the aryl group.

In the formulae (2E) and (4), the number of carbons contained in $R_2$ is any number from 1 to 15.

In the above formula (5), the total number of carbons contained in $R_3$ or $R_4$ is any number from 1 to 15.

In the above formula (1), Y stands for the following formula (6).

-TIME-INHIBIT Formula (6)

In the above formula, the TIME group can be bonded to the coupling position, and splitted off by the reaction with the oxidized product of color developing agent, and it can moderately control and release the INHIBIT group after it is splitted off from the coupler.

The INHIBIT group is the inhibitor.

In the formula (6), the -TIME-INHIBITOR group is expressed by the following formulae (7) through (13).

Formula (7)

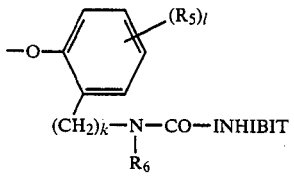

-continued

Formula (8)

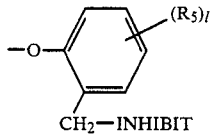

Formula (9)

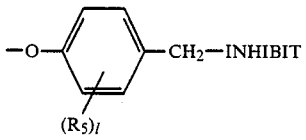

Formula (10)

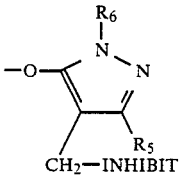

Formula(11)

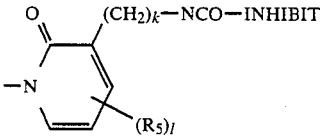

Formula (12)

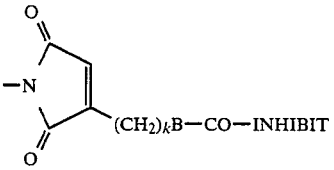

formula (13)

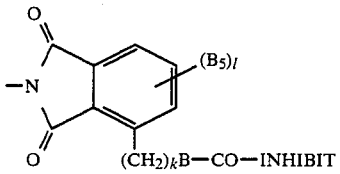

In the formulae (7) through (13), $R_5$ represents a hydrogen atom, halogen atom, alkyl group, alkenyl group, aralkyl group, alkoxy group, alkoxy carbonyl group, anylino group, acylamino group, ureido group, cyano group, nitro group, sylfonamide group, sulfamoyl group, carbamoyl group, aryl group, carboxy group, sulfo group, hydroxy group or alkane sulfonyl group; in the formulae (7), (8), (9), (11), and (13), l represents 1 or 2; in the formulae (7), (11), (12), and (13), K represents 0, 1, or 2; in the formulae (7), (10), and (11), $R_6$ represents an alkyl group, alkenyl group, aralkyl group, sycloalkyl group or aryl group; in the formulae (12) and (13), B represents an oxygen atom or

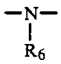

(in which $R_6$ has the meaning already defined); and the INHIBIT group has the same meaning as the formulae defined as the formulae (2A), (2B), (3), (4), and (5) excepting the number of carbons.

However, in the formulae (2A), (2B), and (3), the total number of carbons contained in $R_1$ in each molecule is any number from 1 to 32; in the formula (4), the number of carbons contained in $R_2$ is any number from 1 to 32, and, in the formula (5), the total number of carbons contained in $R_3$ and $R_4$ is any number from 0 to 32.

When $R_5$ and $R_6$ represent an alkyl group, each of them may be either a substituted or non-substituted chain or ring. If it is substituted, it may be any among those described in case where $R_1$ through $R_4$ are the alkyl groups. If each of $R_5$ and $R_6$ represents the aryl group, it may be substituted. As the substituent, any of those described in case where $R_1$ through $R_4$ represent the alkyl group may be cited.

Among the above-mentioned diffusible DIR compounds, it is preferable to select one having the splitting off group expressed by the formula (2A), (2B), (2E), or (5).

The yellow color image producing coupler residues expressed as COUP in the formula (1) includes pivaloylacetoanylide type, benzoylacetoanylide type, malondiester type, malondiamide type, dibenzoylmethane type, benzothiazorylacetoamide type, malonate monoamide type, benzothiazoryl acetate type, benz oxazorylacetateamide type, benzoxazoryl acetate type, malondiester type benz imidazoryl acetoamide type, and benzimidazorylacetate type coupler residues; coupler residues derived from the acetoamide substituted with heterocyclic ring or acetate substituted with heterocyclic ring included in U.S. Pat. No. 3,841,880; coupler residues derived from acylacetamides described in U.S. Pat. No. 3,770,446, British Pat. No. 1,459,171, West German OLS Pat. No. 2,503,099, and Japanese Patent Publication Open to Public Inspection (hereinafter called Japanese Patent O.P.I. Publication) No. 139738/1975, or Research Disclosure No. 15737; and heterocyclic coupler residues described in U.S. Pat. No. 4,046,574.

The magenta color image producing coupler residue represented by A should preferably be the coupler residue having the 5-oxyso 2-pyrazoline nucleus, pyrazolo-[1, 5-a] benzoimidazol nucleus or cyanoacetophenone type coupler residue.

The cyan color image producing coupler residue represented by A is preferably the coupler residue having the phenol nucleus or α-naphtol nucleus, or indazolon type or pyrazolotriazol type coupler residue.

Furthermore, the DIR coupler has the same effect even if no coloring matter is actually produced after the coupler is coupled to the oxidized developing agent to release the inhibitor. The coupler residues of this type expressed as A include those described in U.S. Pat. Nos. 4,052,213, 4,088,491, 3,632,345, 3,958,993 or 3,961,959.

The examples of the diffusible DIR compounds covered by the present invention are given below provided that they are not limitative:

EXAMPLES OF COMPOUNDS

D-1

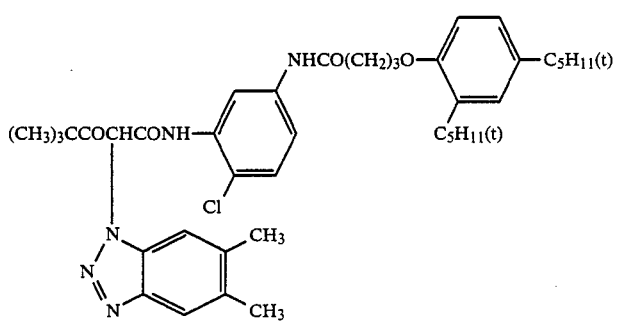

D-2

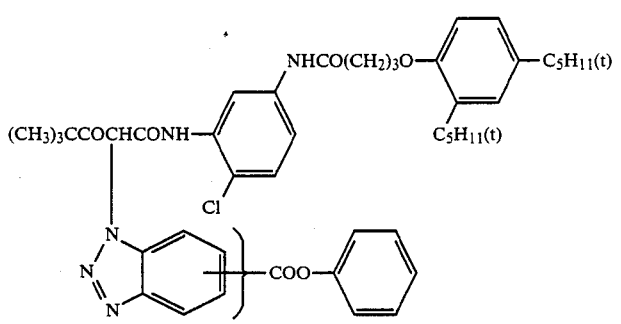

D-3

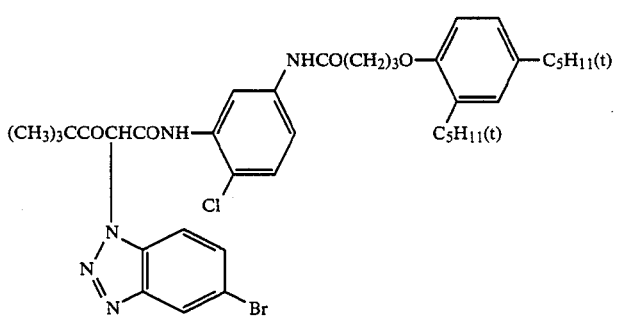

-continued
D-4
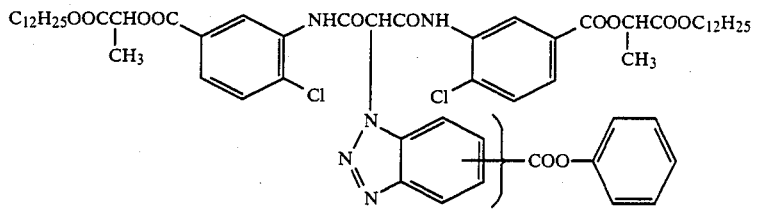
D-5
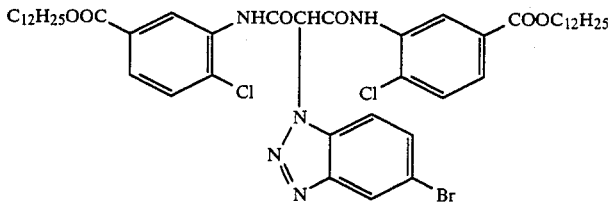
D-6
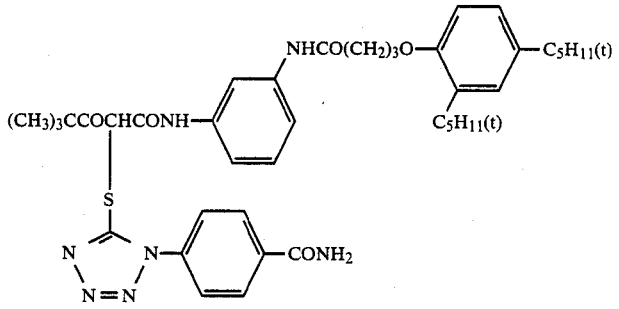
D-7
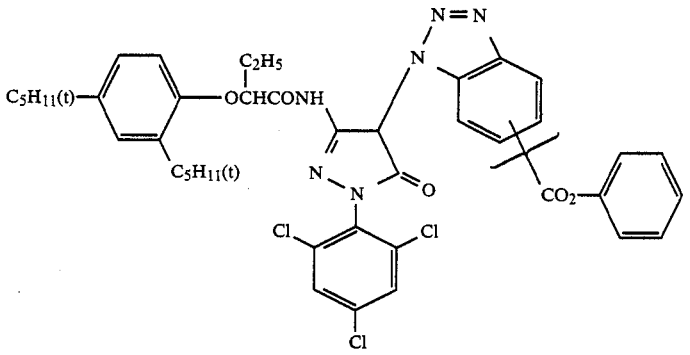
D-8
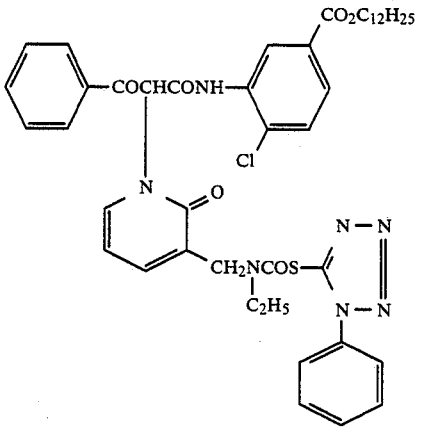

-continued
D-9
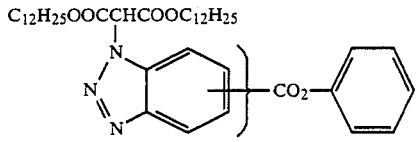
D-10
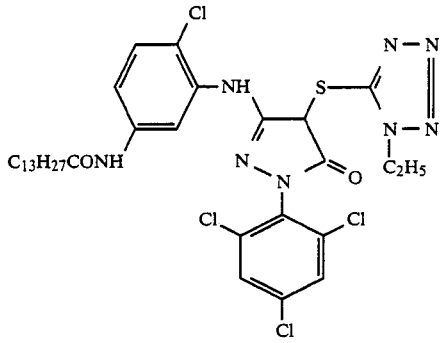
D-11
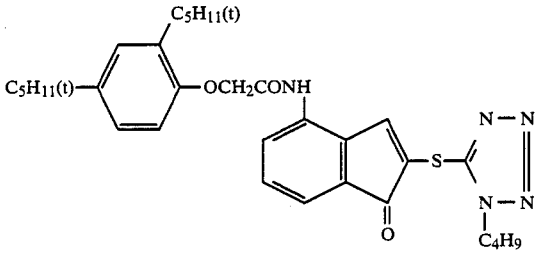
D-12
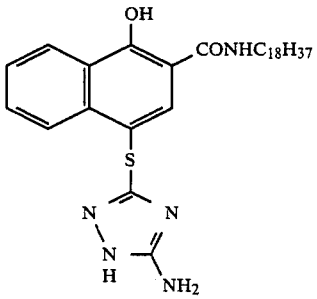
D-13
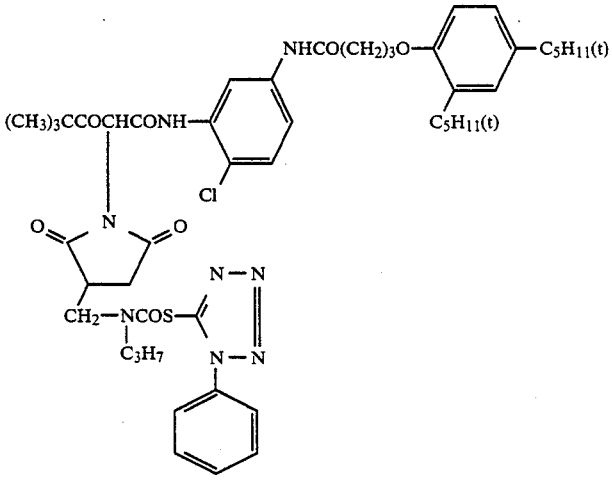

-continued
D-14
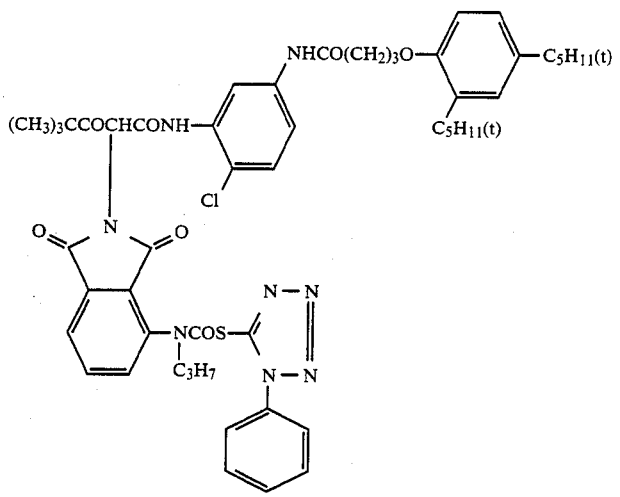
D-15
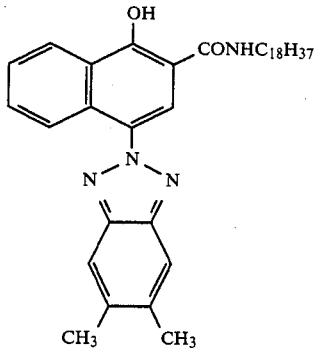
D-16
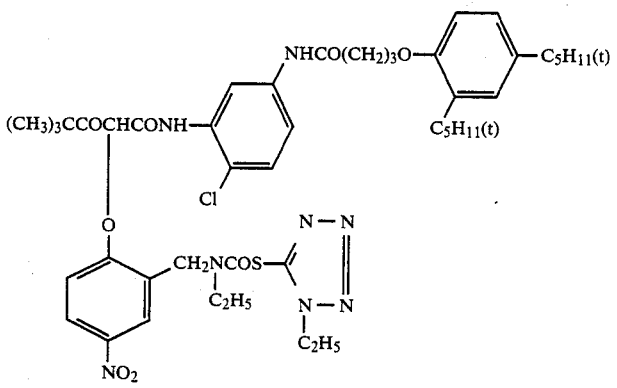
D-17
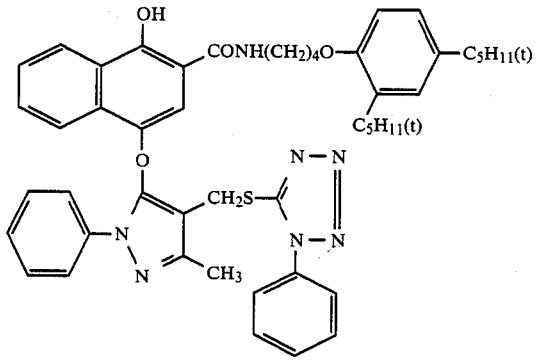

-continued
D-18
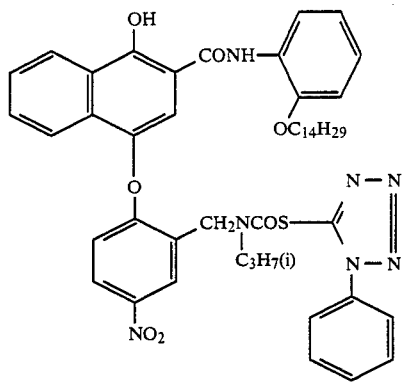
D-19
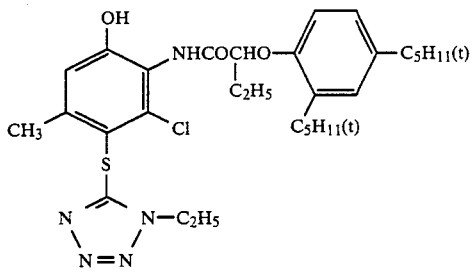
D-20
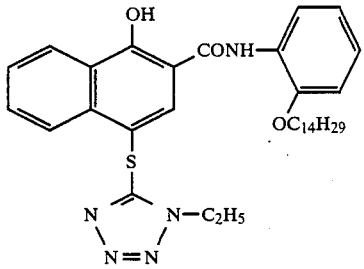
D-21
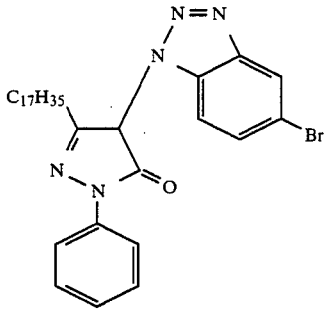
D-22
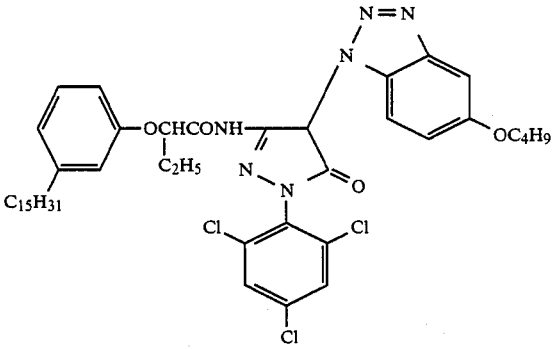

-continued
D-23
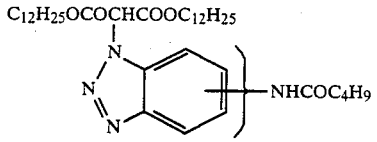
D-24
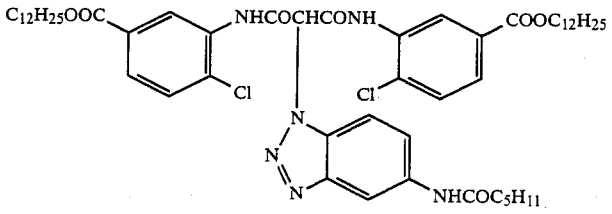
D-25
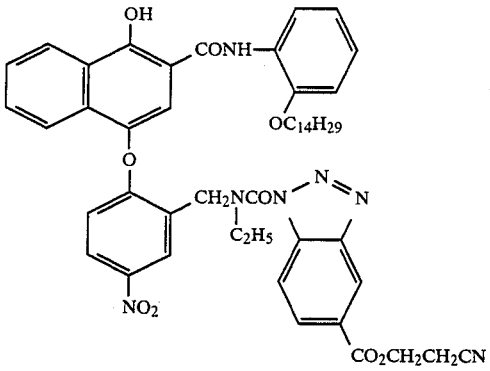
D-26
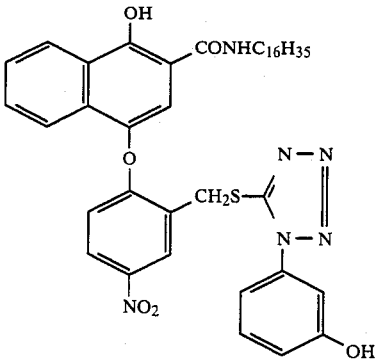
D-27
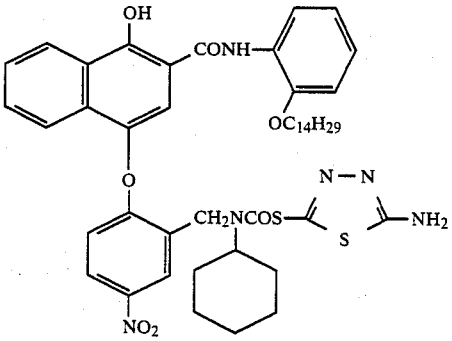

-continued
D-28
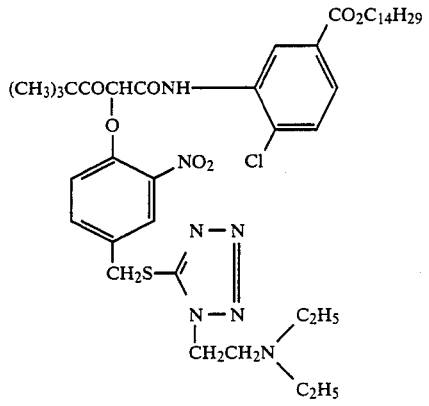
D-29
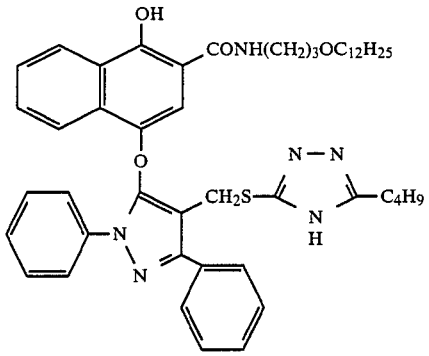
D-30
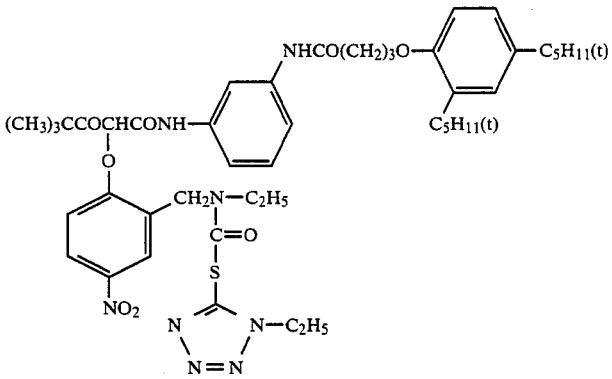
D-31
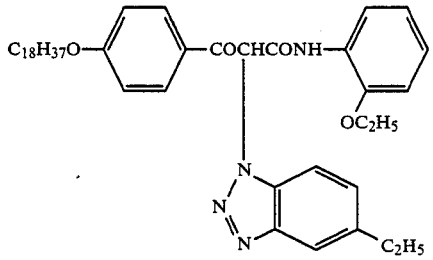

-continued
D-32
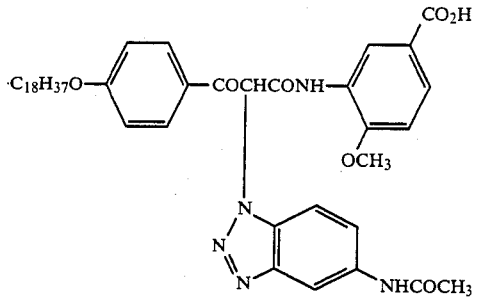
D-33
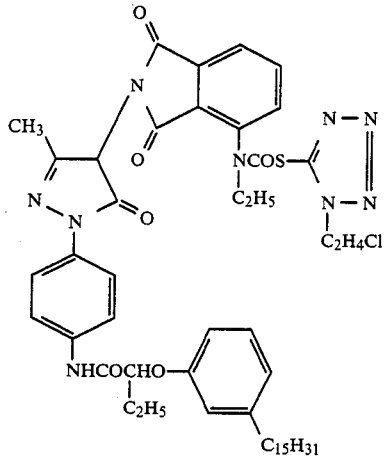
D-34
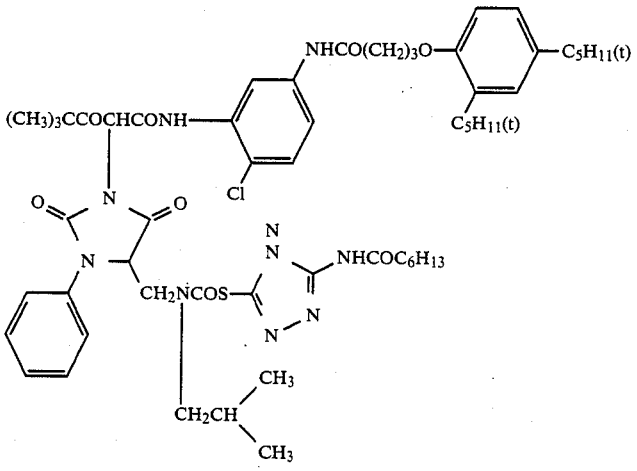
D-35
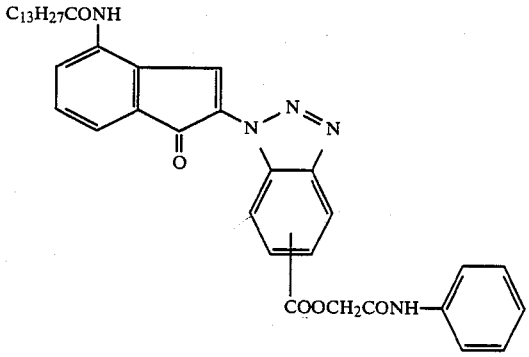

-continued
D-36
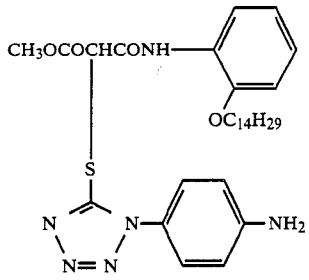
D-37
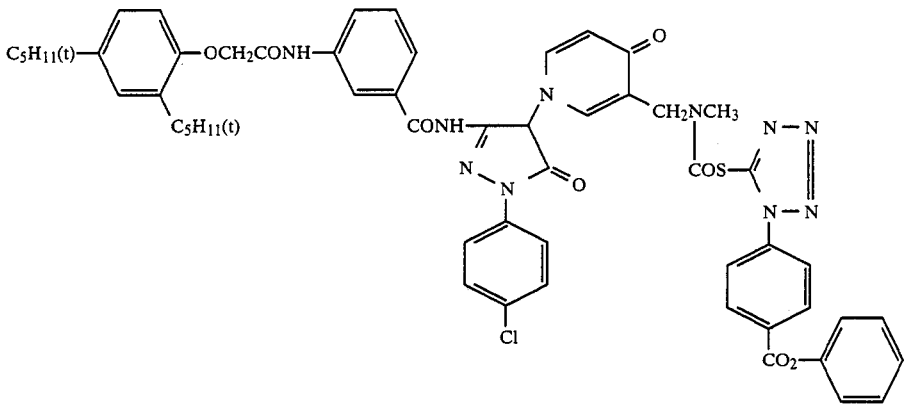
D-38
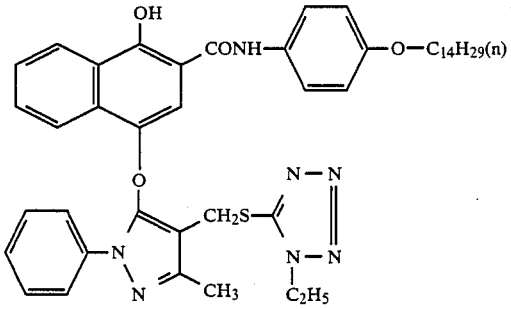
D-39
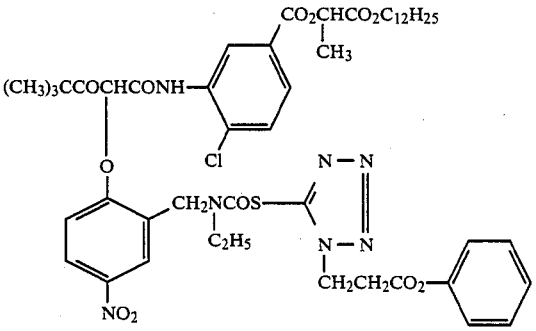

-continued
D-40
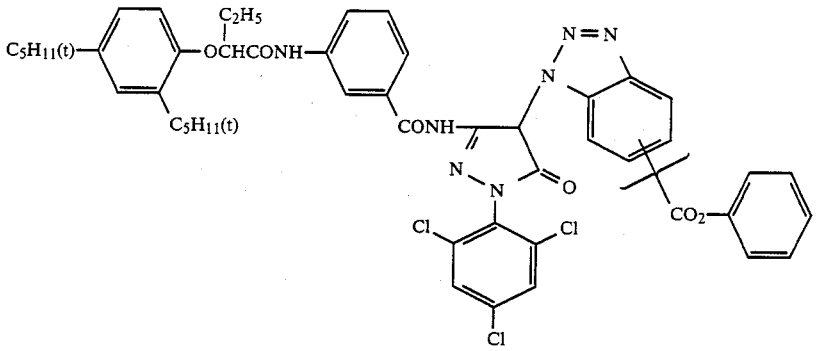
D-41
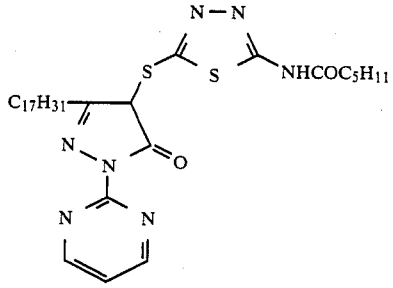
D-42
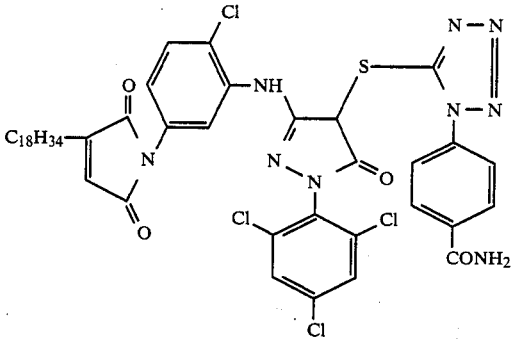
D-43
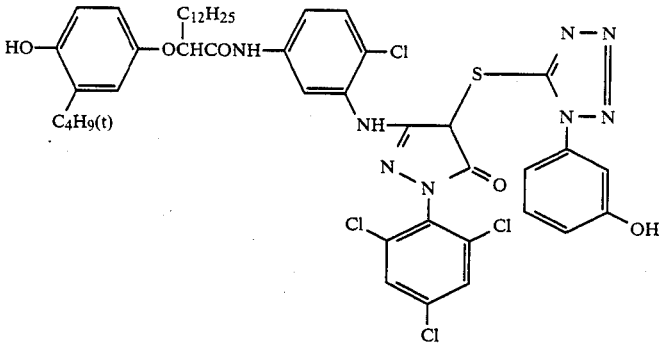
D-44
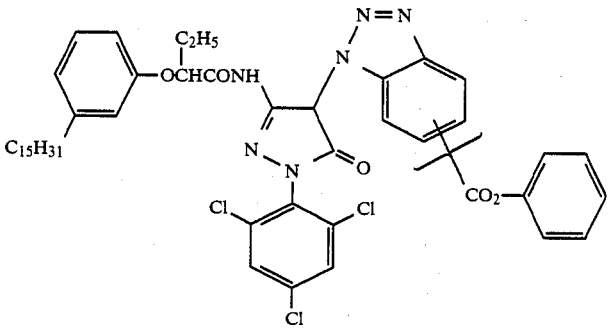

-continued
D-45
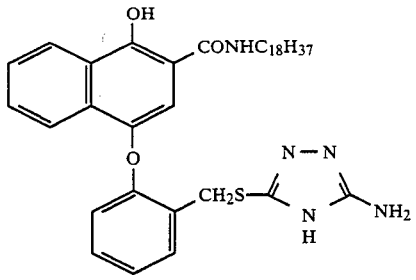
D-46
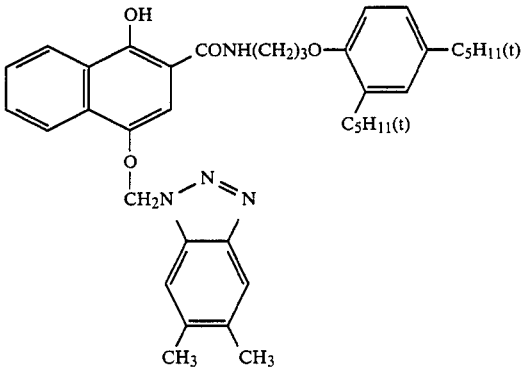
D-47
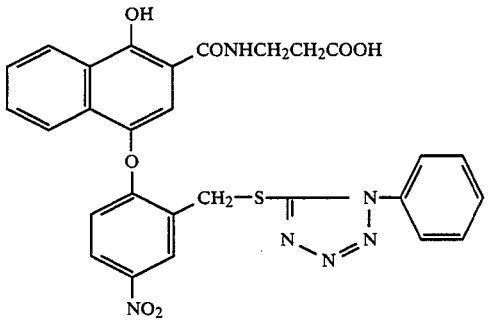
D-48
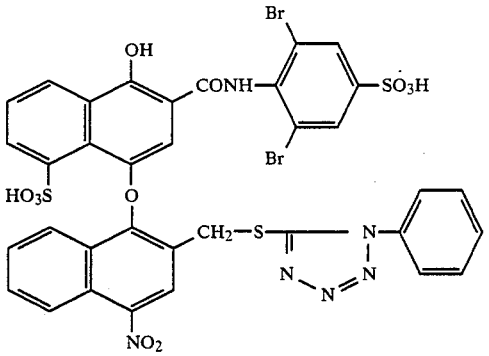
D-49
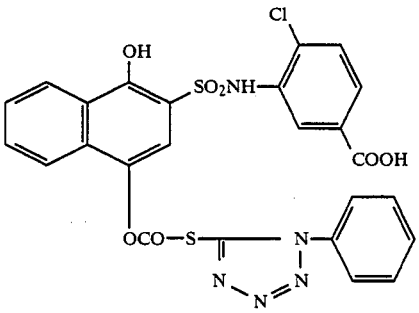

-continued
D-50
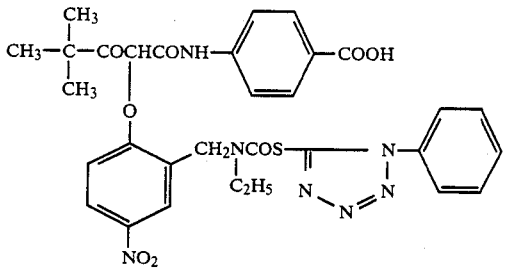
D-51
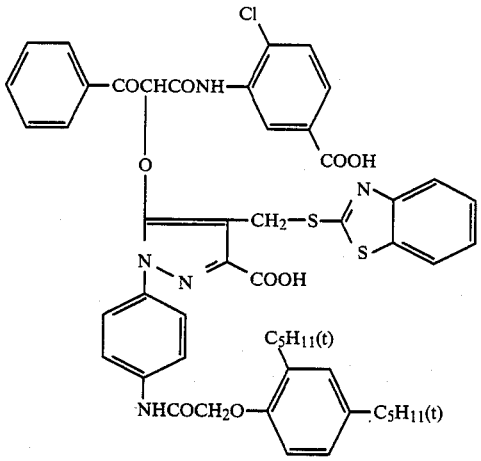
D-52
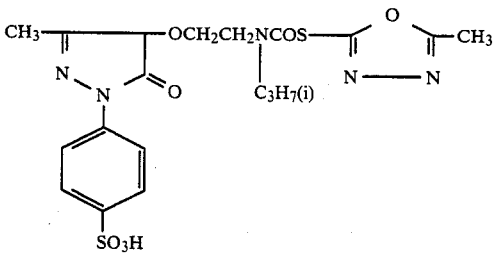
D-53
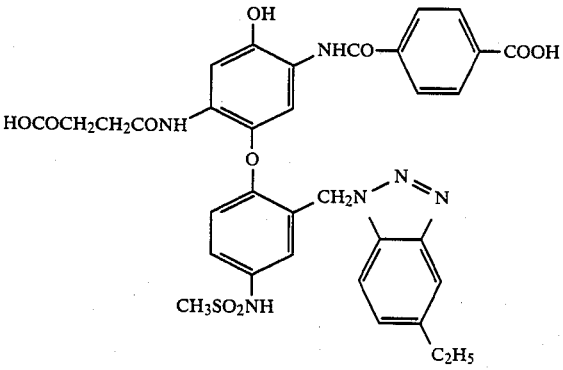

-continued
D-54
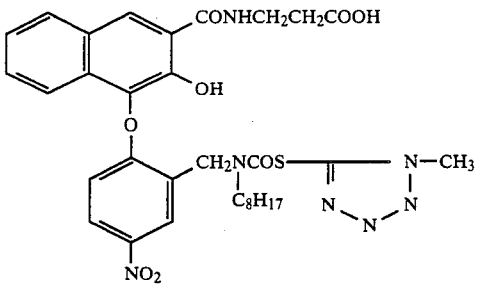
D-55
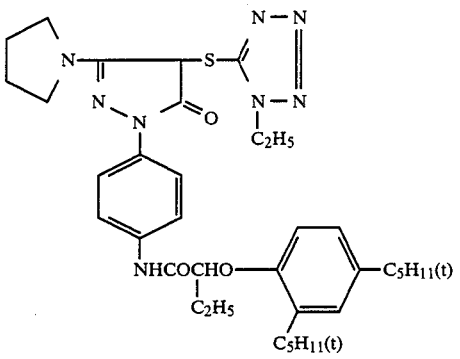
D-56
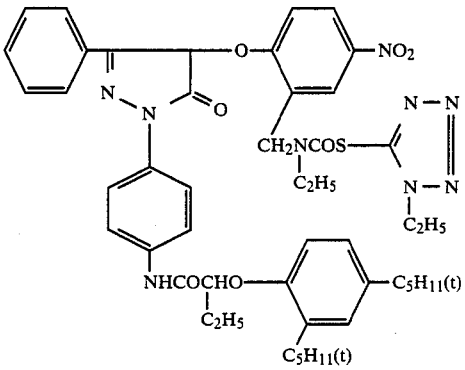
D-57
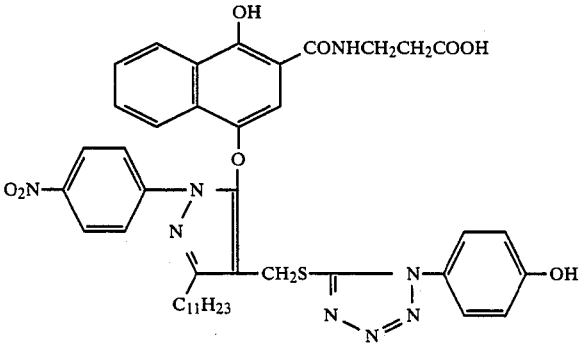

-continued
D-58
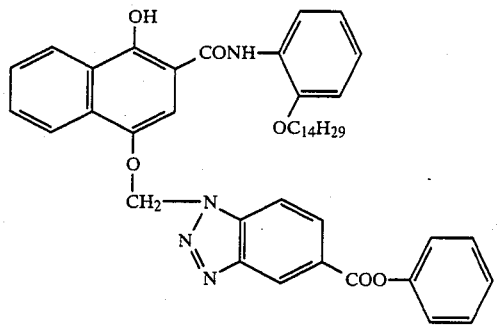
D-59
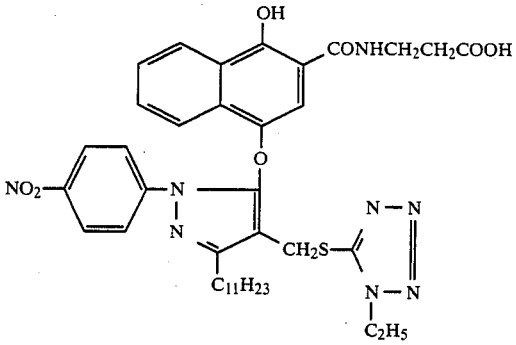
D-60
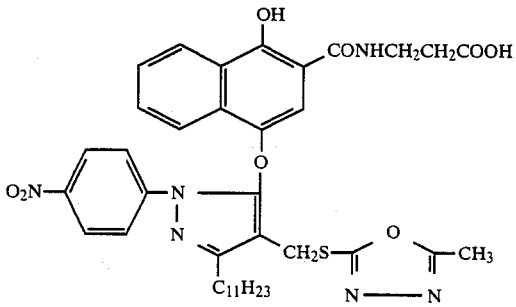
D-61
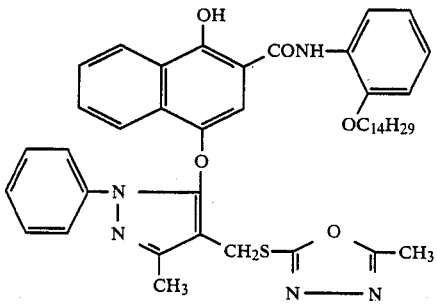

-continued

D-62

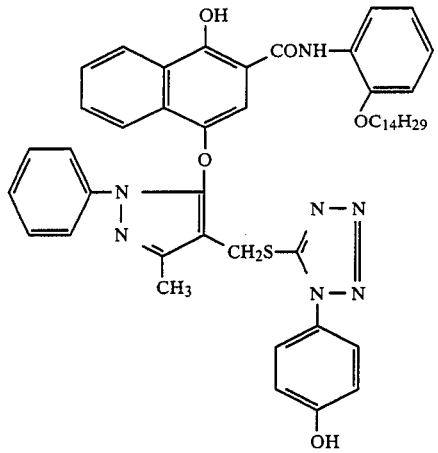

These compounds can be easily synthesized under the methods described in U.S. Pat. No. 4,234,678, U.S. Pat. No. 3,277,554, U.S. Pat. No. 3,617,291, U.S. Pat. No. 3,958,993, U.S. Pat. No. 4,149,886, U.S. Pat. No. 3,933,500, Japanese Patent O.P.I. Publication No. 56837/1982, Japanese Patent Examined Publication No. 13239/1976, British Pat. No. 2,072,363, British Pat. No. 2,070,266, and Research Disclosure No. 21228 issued in December 1981.

Also, chemical compounds which release the diffusible inhibitors or the precursor of such diffusible inhibitor of this invention include the compounds described in Japanese Patent O.P.I. Publication Nos. 184248/1985 and 206836/1984 which release, during development, and especially as a result of reaction with products yielded by oxidization of the developing agent, the groups whose photographic actions can be changed by the mutual reaction between different or similar groups or compounds.

The emulsion containing fog nuclei preferably used to the present invention is fogged to such a degree that the image may not be actually produced when development is performed in the internal developing solution B at 20 degrees Centigrade for five minutes after the emulsion is applied to the surface of the support, say, to the thickness of 3 grams per square meter, and processed at 20 degrees Centigrade for five minutes in the bleaching solution A after an imagewise exposure; but such emulsion may be a one which is capable of internally producing an image (internal latent image type). In this case, the most desirable emulsion is the one whose ratio (called the degree of internal fogging) of the minimum image density (D min.) to the maximum image density (D max.) obtained by the above-mentioned processing is 0.3 to 1.0.

It is prefarable that the emulsion containing the fog nuclei useful to the present invention has no fog nuclei on its surface and that the amount of fog silver is 20 mol % or less of the total amount of silver applied as measured under the fluorescent X-ray method when the emulsion is applied to the surface of the support to the thickness of 3 grams per square meters and the sample is developed in the surface developing solution C at 20 degrees Centrigrade for six minutes.

| (Bleaching solution A) | |
|---|---|
| Red prussiate | 3 grams |

-continued

| | |
|---|---|
| Phenosafranine | 0.0125 grams |
| Water is added to the above to produce total one liter of solution. | |
| (Internal developing solution B) | |
| N—methyl p-aminophenol sulfate | 2.0 grams |
| Sodium sulfite | 90 grams |
| Hydroquinone | 8.0 grams |
| Sodium carbonate monohydrate | 52.5 grams |
| Potassium bromide | 5 grams |
| Thiosodium sulfate | 10 grams |
| Water is added to the above to produce total one liter of solution. | |
| (Surface developing solution C) | |
| N—methyl p-aminophenol sulfate | 2.5 grams |
| Ascorbic acid | 10 grams |
| 2-diethyl aminoethanol | 25 grams |
| Potassium bromide | 1 gram |
| Sodium carbonate monohydrate | 55.6 grams |
| Water is added to the above to produce total one liter of solution. | |

To give fogging to the interior of the silver halide grains, light may be simply applied to the emulsion, or any other method, for instance, a chemical fogging method, can be used.

The emulsion having high internal fogging and low surface fogging can be also obtained by bleaching the emulsion with sensitivity in both interior and surface with the use of potassium cyanade after fogging it.

Emulsion containing fogging nuclei may be also produced by radiation of high energy such as X-ray to the internal latent image type emulsion or by exposing it to ultraviolet ray or visible rays.

The internal latent image type emulsion is described, for instance, in U.S. Pat. No. 2,592,250. Other emulsions which does not need to contain silver iodide applicable to the present invention. Internal latent image type silver chlorobromide emulsion and silver bromide emulsion can be also applied to the present invention like various kinds of other internal latent image type emulsions. Internal latent image type silver halide emulsions useful to the present invention include those prepared by various methods. For instance, they include the conversion type silver halide emulsions described in Specifications for U.S. Pat. No. 2,592,250, and Japanese Patent Publication Open to Public Inspection No. 18309/1977, silver halide emulsions containing internally chemically sensitized silver halide grains described in U.S. Pat. No. 3,206,313, U.S. Pat. 3,317,322, Specifications for U.S. Pat. No. 3,367,778, and Japanese Patent Publication Open to Public Inspection No. 29405/1968, silver halide emulsions containing silver halide grains with polyhydric metal ion described in U.S. Pat. No. 3,271,157, U.S. Pat. No. 3,447,927, U.S. Pat. No. 3,531,291, and Specifications for U.S. Pat. No. 3,703,584, silver halide emulsions consisting of grains with the laminated structure described in British Pat. No. 1,027,146, British Pat. No. 3,761,266, Specifications for British Pat. No. 3,761,276, Japanese Patent O.P.I. Publication Nos. 106321/1974, 8524/1975, and 60222/1978, and silver halide emulsions containing silver iodide prepared by the ammonium method described in Japanese Patent O.P.I. Publication, and so on.

The silver halide emulsion having fogging nuclei inside preferably used in the present invention is produced by optically or chemically providing fogging nuclei to the silver halide grains, and then adding silver salt water solution to develop silver halide on the grains to such a degree that the grains may be coated with silver halide.

To chemically achieve fogging, for instance, the method in which the silver halide grains are ripened at pAg of 1 to 8, pH of 6 to 14, and temperature of 30 to 80 degrees Centigrade for 10 to 180 minutes is used.

Fogging nuclei can be effectively provided by using the sulfur sensitizer, reduction sensitizer and noble metal sensitizer individually or combinedly during ripening and this method is preferable.

To develop silver halide on the above-mentioned halide silver grains to which fogging is provided, the double jet method in which water soluble silver salt solution and water soluble halide solution are simultaneously jettted into the water soluble protective colloide solution at a rate suitable to the rate at which the silver halide develops, single jet method, triple jet method or composite method utilizing the above-methods combinedly may be used; and also either the ammonia method, neutral or acid method may be used. pAg and pH in the emulsion liquid phase during preparation of the emulsion can be controlled as appropriate. Preferably, pAg is in the range from 2 to 13, and pH from 2 to 13. The emulsion temperature during preparation of the emulsion is 30 to 90 degrees Centigrade, and more preferably 35 to 70 degrees Centigrade.

The silver halide having fogging nuclei inside utilized in the present invention include, as its silver halide ingredients, any silver halide, e.g. silver bromide, silver chloride, silver chlorobromide, silver iodobromide, and silver chloroiodobromide.

Preferably, the silver halide substantially consisting of the silver bromide or chlorinated silver chlorobromide (Ag I$\leqq$5 mol %).

The grain size of the silver halide forming fogging nuclei inside utilized in this invention is not specially limitative, but fine grains are desirable. Especially, these grains preferably have the average size of 0.01 to 0.75 μm, and more preferably 0.01 to 0.5 μm.

Also, the shape of the grains of the silver halide emulsion containing fog nuclei is not limitative. These grains may have regular or irregular shape, but preferably they are normal crystals such as octahedron, cube or tetradecahedron.

The silver halide emulsion having fogging nuclei may be of the polydispersive type, but the monodispersive type, especially, with the variation coefficient of grain size distribution of 20% or less is preferable.

The content ratio of the light-sensitive silver halide grains to the internally fogged silver halide grains in the silver halide light-sensitive materials of this invention can be changed according to the type of the emulsion used (e.g. halogen composition), contrast of the emulsion used or the kind of the photographic material to be made.

Generally, favorable results are obtained when the ratio the silver halide grain containing fog nuclei inside thereof to the photosensitive silver halide grains is equivalent or greater in terms of the molar ratio of the silver halide. Ordinarily, it is preferable to use silver halide grains containing the internal fog nuclei at a rate of 0.5 to 100% in terms of mols of silver halide with respect to the photosensitive silver halide grains, or preferably 2 to 50%, or more preferably 5 to 30%.

The silver halide emulsion layer related to the present invention may comprise a misxture of the light-sensitive siver halide emulsion an internally fogged silver halide emulsion. Or else, these two types of emulsions may be applied to form adjacent layers. In applying these two types of emulsions to another layer, one of these types may be applied to another, and vice versa. Between these emulsion layers, a water permeable layer may be provided as far as the effect of this invention is not impaired.

The present invention is preferably applicable to negative color films.

The negative color film generally comprises the blue-sensitive, green-sensitive, and red-sensitive silver halide emulstion layer and non-sensitized hydrophilic colloid layer; and the arrangement of these layers on the support puts no restrictions on the present invention. The abovementioned red-sensitive layer, green-sensitive layer and blue-sensitive layer may be divided into high and low sensitivity layers, respectively. Also, these layers may have the structure in which at least one of the red-sensitive, green-sensitive and blue-sensitive layers is divided into three partial layers as described in Japanese Patent Examined Publication No. 15495/1974, structure in which high sensitivity emulsion layer unit is divided from the low sensitivity emulsion layer unit as described in Japanese Patent Application No. 49027/1976, or structure described in West German DOS Pat. Nos. 2,622,922, 2,622,923, 2,622,924, 2,704,826, and 2,704,797. The present invention is applicable to any of the blue-sensitive, green-sensitive, and red-sensitive layers. Even if each color sensitive layer consists of a plural number of layers, this invention can be applied to any layers having the high sensitiveity, medium sensitivity, and low sensitivity.

The effect of the present invention will be great when it is applied to the highest sensitive layer among the same color sensitive layers and more preferable when it is applied to all the same color sensitive layers.

The light-sensitive silver halide emulsion can utilize, in the present invention, any silver halide generally used as the silver halide emulsion, but it is preferable to use silver bromide, silver iodobromide, or silver chloroiodobromide It is preferable that the light-sensitive silver halide grains in the present invention is capable of forming latent image mostly on the surface.

The light-sensitive silver halide grains may have regular crystal form such as cubic, octahedron, and tetradecahedron, or irregular crystal form such as globe and plate. In these grains, any ratio of {100} planes to {111} planes can be used. Also, these grains may have a mixed crystal form combining various crystal forms, and also they may be blended with grains with various crystal forms.

The size of the silver halide grains is 0.05 to 30 μm, and preferably 0.1 to 20 μm.

The silver halide emulsion may be prepared by blending a plural number of silver halide emulsions prepared separately.

The light-sensitive silver halide emulsion can be chamically sensitized by the ordinary method. That is, the sulfur sensitization method, selenium sensitization method, reduction sensitization method, and noble method sensitization method utilizing gold or other noble metals may be used combinedly or individually.

The photo-sensitized silver halide emulsion used for the light-sensitive materials to which the present invention is applicable are not limitative as described above, but it is preferable to use the monodispersed emulsion, especially the core/shell type silver halide emulsion having a layer or phase having a high silver iodide content inside as the silver halide emulsion used in a high sensitive layer.

The term "high-sensitive" mentioned herein means that, in respect of monochromatic light-sensitive materials having a plurality of light-sensitive layers, a layer has a sensitivity higher than those of layers to at least one of sensitometric light sources, 5500° K., 3400° K. and 3200° K. which normally used, and that, in respect of color light-sensitive materials having blue-, green- and red-sensitive layers of which at least one layer comprised of plural layers each sensitive to the same color-light, a layer has a sensitivity higher than any other layers each sensitive to the same color.

In case the silver halide emulsion layer consists of two layers, the ratio of sensitivity between the above-mentioned high sensitive layer and other layers should preferably range from 1.05:1 to 100:1, and more preferably from 1.1:1 to 20:1.

In case the silver halide emulsion layer related to the present invention consists of three or more layers having different sensitivity, the high sensitive layer under the present invention means the layer with the highest sensitivity among these layers. In case the silver halide emulstion layer consists of three layers having different sensitivity, the ratio between the high sensitivity layer and other layers should preferably range from 1.05:1 to 200:1, and more preferably from 1.1:1 to 100:1.

The silver halide emulsion layer may be composed of four or more layers having different sensitivity, but such composition is not desirable because sharpness is impaired. The high sensitive layer in the present invention is preferably as far from the support as possible; and in case the silver halide emulsion layer consists of three or more layers having different sensitivity, the high sensitive layer in the present invention is preferably the layer farthest from the support among the layers sensitive to the same color-light.

When the light sensitive silver halide monodispersed emulsion contained in the high sensitive layer in the present invention is observed by means of electronic microscopic photographs, the majority of the silver halide grains have the same shape and even size, and present the grain size distribution described below. Namely, the result is 0.20 or less, or preferably 0.15 or less, when the standard deviation s of the grain size distribution is divided by the average grain size $$S/\bar{r} \leqq 0.20$$

(preferably, $S/\bar{r} \leqq 0.15$).

This value is termed "variation coefficient of grain size.

Here, the grain size means the diameter in the case of the spherical silver halide grains; and, in the case of grains having the shape different from the sphere, the diameter of the circular image into which the projected image is converted in terms of the area. If the grain size in this sense is $r_i$ and the number of grains is $n_i$, r is defined by the following equation:

$$\bar{r} = \frac{\Sigma ni \cdot ri}{\Sigma ni}$$

The relations with the grain size distribution can be determined according to the method described in "Experiential Relations between Sensitometory Distribution and Grain Distribution in Photography" a treatise by Trivelli and Smith on p.p. 330–338 of The Photographic Journal Volume LXXIX (1949).

In the present invention, the light-sensitive silver halide monodispersed emulsion used in the high-sensitive layer may have any grain size, but it is preferably in the range of 0.55–5.0 μm, and more preferably 0.60–3.0 μm. The high sensitive layer in the present invention may contain two or more kinds of light-senstive silver halide monodispersed emulsions having different average grain size, etc. Also, the high sensitive layer concerned may contain any other light-sensitive silver halide emulsion (e.g. polydispersed emulsion) than the light-sensitive silver halide monodispersed emulsions covered by the present invention so far as the effect of the present invention so far as the effect of the present invention is impaired in no way, but it is preferable that the content of such emulsion should be minimal.

Also, it is preferable to use the core/shell type silver halide emulsion as the light-sensitive silver halide emulsion.

The light-sensitive core/shell silver halide emulsion contains silver halide grains not substantially having logging nuclei inside, and it has a grain structure consisting of two or more; and the layer (called the core) having the highest silver iodide content preferably constitutes other layer than the layer (called the shell) nearest to the surface.

The silver iodide content in the inner layer (core) with the highest silver iodide may be 6 to 40 mol %, preferably 8 to 30 mol %, and more preferably 10 to 20 mol %. The shell portion of the core/shell type silver halide grains should preferably account for 10 to 80%, preferably 15–70%, and more preferably 20–60%.

The core portion accounts for 10 to 80% of the entire grains, preferably 20 to 50%.

In the present invention, the difference between the content in the core portion having the high silver diodide content in the silver halide grains and that in the shell portion having the low content may present a sharp boudary, or it may present continuous change whose boundary is not always distinct. Also, an intermediate layer having the silver diodide content between that of the core portion and that of the shell portion may preferably be provided between the core and shell.

In case of the core/shell type silver halide grain structure having the above-mentioned intermediate layer, the volume of the intermediate layer should be 5 to 60% of the entire grains, and preferably 20–55%.

It is preferable that the difference in the silver iodide content between each two of the shell, intermediate layer, and core should be 3 mol % or more, and that the difference in the silver iodide content between the shell and core should be 6 mol % or more.

In the present invention, the core/shell type silver halide emulsion should preferably be composed of silver iodobromide, and its average silver bromide should preferably be 4 to 20 mol %, and more preferably 5 to 15 mol %. The core/shell type silver halide emulsion may contain silver chloride as far as the effect of the present invention is not impaired.

The light-sensitive core/shell emulsions in this invention can be prepared according to the publicly known methods disclosed in for Japanese Patent O.P.I. Publication Nos. 177535/1984, 138,538/1975, 52238/1984, 14331/1985, 35726/1985, and 258536/1985.

In case the core/shell type silver halide emulsion is developed from seed grains as given by an example in Bulletin for Japanese Patent O.P.I. Publication No. 138538/1985, such emulsion may possibly has a halogen composition area different from the core in the center of each seed grain.

In this case, the seed grains may have any halogen composition such as the silver bromide, silver iodide, silver chloroiodobromide, silver chlorobromide, and silver chloride, but it is preferable to use the silver iodobromide or silver bromide with the silver iodide content of 10 mol % or less.

Also, the ratio of the seed emulsion to the total silver halide is preferably be 50% or less, and more preferably 10% or less.

The distribution of silver iodide in the above-mentioned core/shell type silver halide grains can be determined by various physical measurement methods. For instance, the methods involving the measurement of luminescence at a low temperature and X-ray analysis method introduced in the summary of lectures given in the opportunity of the annual conference of Photographic Society of Japan in 1981 may be employed.

The core/shell type light-sensitive silver halide emulsion preferably used in this invention gives two peaks in the diffraction pattern corresponding the face coefficient (200) of silver iodide or silver bromide when it is analysed by X-ray diffraction method using K$\beta$ ray of copper, and it is preferable that, even if only one diffractive peak appears, the half-value width of the peak is greater than $\Delta 2\theta = 0.2$ degree.

The light-sensitive core/shell type silver halide grains used in the present invention may be normal crystals such as cubes, tetradecahedra, and octahedra, twin crystals, or mixture of normal and twin crystals although it is preferable that the above-mentioned grains are normal crystals.

It is desirable that the light-sensitive core/shell type silver halide emulsions in the present invention are of the monodispersed type which was defined earlier.

The monodispersed emulsion can be obtained by adding water-soluble silver chloride solution and water-soluble halide solution to gelatin solution containing seed grains according to the double jet method in which pAg and pH are controlled properly.

To determine the rate of addition of these solutions, Japanese Patent O.P.I. Publication Nos. 48521/1979 and 49938/1983 may be referred to.

To obtain further high quality monodispersed emulsion, the method of growth in the presence of tetrazaindene disclosed in Japanese O.P.I. Publication No. 122935/1985 may be applied.

The grain size of the light-sensitive core/shell type silver halide emulsion should preferably be 0.05–30 $\mu$m, and more preferably 0.1–20 $\mu$m.

During the growth of light-sensitive core/shell type silver halide grains, presence of well-known silver halide solvents such as ammonia, thioether, and thiourea are allowed.

The light-sensitive silver halide emulsion can be optically sensitized in the desired wavelength area with the use of sensitizing dyes used in the photographic industry.

In order to prevent fogging of light-sensitive materials during manufacture, storage and photographic processing, and to secure photographic stability, chemical compounds known in the photographic industry as antifog agents and stabilizers may be added during chemical maturing, after completion of chemical ripening, and before coating of the silver halide emulsion.

As the binder (or protective colloid), it is desirable to use gelatin, but gelatin derivatives, graft polymer between gelatin and any other high molecular compound, other proteins, sugar derivatives, cellulose derivatives, and hydrophilic colloids including synthetic hydrophilic high molecular substances such as homopolymers and copolymers.

The layer of the photographic emulsion and other hydrophilic colloid in the light-sensitive material in the present invention can be hardened by adding one or two kinds of hardeners bridging binder (or protective colloid) molecules to strengthen the layer, Such an amount of hardeners may be added so that it may harden the layer of the sensitized material to such a degree as to make it unnecessary to add hardeners to the processing solution.

Although, an addition of hardners into processing solutions is allowed. To increase flexibility, a plasticizer may be added to the silver halide emulsion layer and/or other hydrophilic colloid layers in the sensitized material The photographic emulsion layers and other hydrophilic colloid layers in the sensitized material may contain synthetic polymer latex insoluble or hardly soluble to water so as to improve the dimensional stability.

The emulsion layers in the light-sensitive material may contain the dye forming coupler which forms dyes as a result of coupling to oxidized product of the aromatic primary amine developing agent (e.g. p-phenylen diamine, and aminophenol derivatives), colored couplers, chemical compounds which photographically liberate useful fragments such as the developing accelerator, bleaching accelerator, developing agent, silver halide solvent, color adjusting agent, hardener, fogging agent, chemical sensitizer, and spectral sensitizer upon coupling to oxidized product of the developing agent, colorless coupler (also called the competiting coupler) which can be coupled to the oxidized product of the aromatic primary amine developing agent but which can not form dye.

Especially, the biequivalent high speed coupler may be preferably used as the yellow coupler in the light-sensitive material in the present invention.

The biequivalent high speed yellow coupler to be preferably used in this invention means a biequivalent yellow coupler capable of being coupled at a high speed. For instance, one of the couplers expressed by the formulae [14] through [17] may be used.

Formula [14]

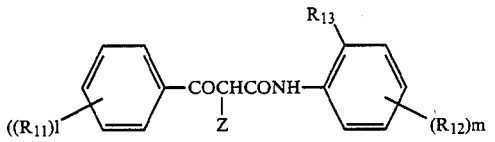

Formula [15]

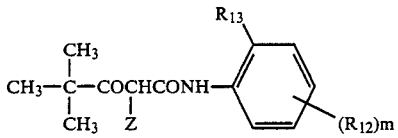

Formula [16]

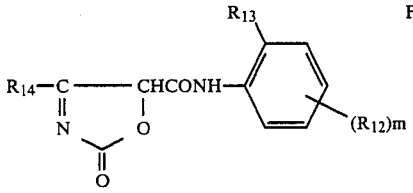

Formula [17]

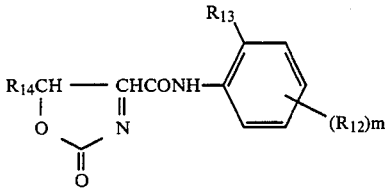

In the formulae [14] through [17], $R_{11}$ represents a univalent group, and l is 1, 2, or 3, where $R_{11}$ may be the same or different each other if l is 2 or more. $R_{12}$ is a group which can be substituted with a benzene ring, m for 1 or 2, where $R_{12}$ may be the same or different if m is 2. $R_{13}$ represents a halogen atom, alkoxy group or aryloxy group, Z is a group which can be splitted off upon coupling reaction of the oxidized product of color developing agent with the coupler residue, and $R_{14}$ is tert-butyl group or phenyl group.

The univalent group represented by $R_{11}$ is not limitative.

For example, it may be a halogen atom, alkyl group, aryl group, alkoxy group, aryloxy group, aklylthio group, aryl thio group, acylamino group, carbamoyl group, acyl group, alkylsulphonyl group, sulfonamide group, sulfamoyl group, nitrile group, acyloxy group, or alkyloxycarbonyl group. $R_{12}$ may, for example, stand for a halogen atom, $R_{15}$—, $R_{15}O$—,

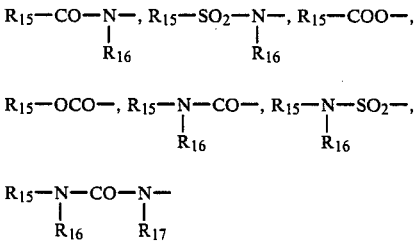

Here, each of $R_{15}$, $R_{16}$, and $R_{17}$ is a hydrogen atom, or alkyl group, aryl group or heterocyclic group each of which may have a substituent; and preferably each of them is a alkyl group or heterocyclic group each of which may have a substituent. The substituents mentioned above include the groups same as those represented by $R_{11}$ are used.

$R_{13}$ represents a halogen atom preferably, fluorine and chlorine), alkoxy group which preferably has 1 to 18 carbons, and more preferably which is methoxy, and aryloxy group.

The groups represented by Z include halogen atoms, —$SR_{18}$ wherein $R_{18}$ represents an alkyl group, aryl group, acyl group, or such a heterocyclic residue as benzo oxazoryl or 1-phenyl 5-tetrazoryl group, —$OR_{19}$ wherein $R_{19}$ represents an alkyl group such as carboxy methyl, N-(2-methoxy ethyl or carbamoyl methyl group, an aryl group such a phenyl, 4-carboxyphenyl or 4-(4-benzyloxy bezenesulphonyl)phenyl group, a heterocyclic group such as a 1-phenyl 5-tetrazoryl, iso oxazoryl or 4-pyridinyl group or an acyl group such as ethoxy carbonyl, N,N-diethyl carbamoyl, phenyl sulfamoyl or N-phenyl thiocarbamoyl group or

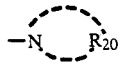

group wherein $R_{20}$ represents non-metallic atoms necessary for formation of 5- or 6-member ring together with 13 N<; preferably it is selected among C, N, O, and S, and these rings may have substituents. For instance, the following formulae:

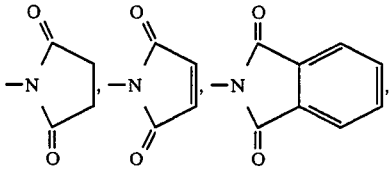

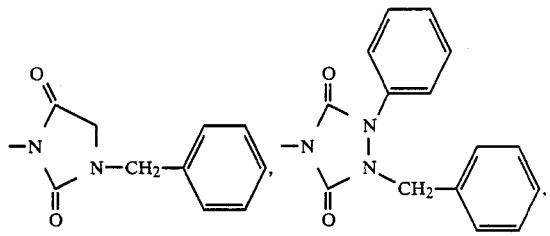

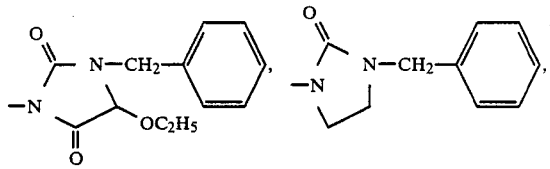

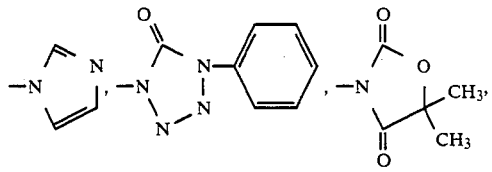

-continued

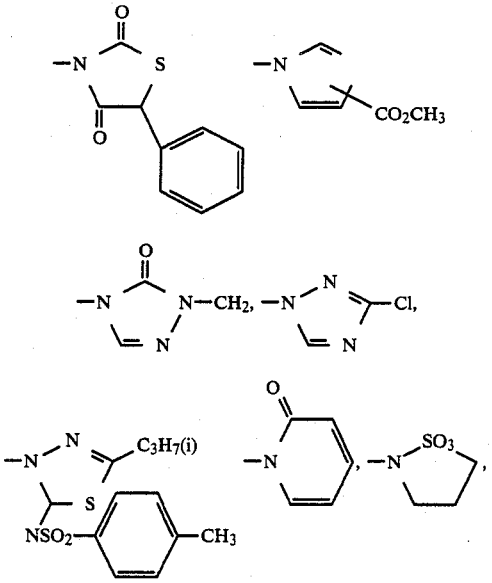

-continued

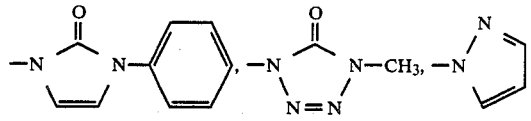

may represent these rings.

The phenyl group represented by $R_{14}$ may have a constituent expressed as $-(R_1)l$ where $R_{11}$ and l means the same meanings described above.

Among the couplers represented the above formula [14] through [17], the coupler expressed by the formula [14] is especially desirable because it has a high color-forming ability.

Typical examples of high speed bivalent yellow couplers used in the present invention are given below provided that they limit the present invention in no way:

Y-1

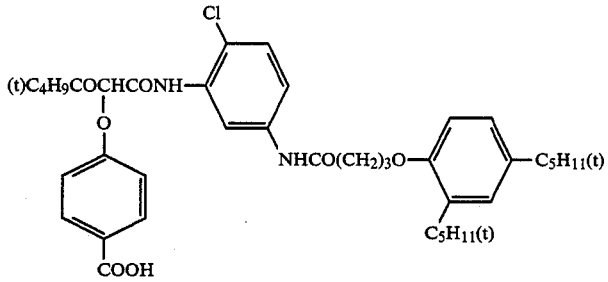

Y-2

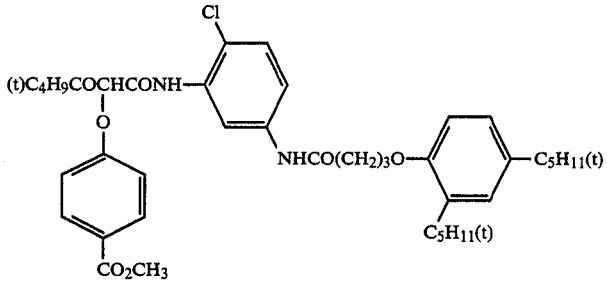

Y-3

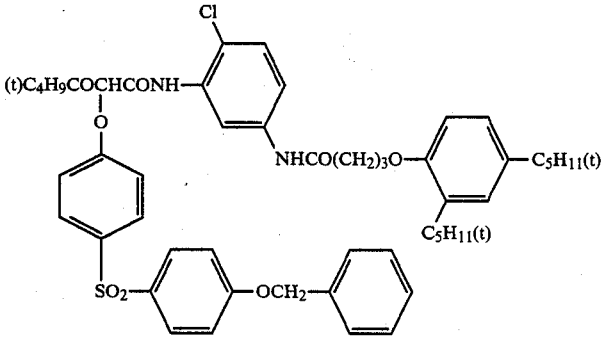

-continued
Y-4
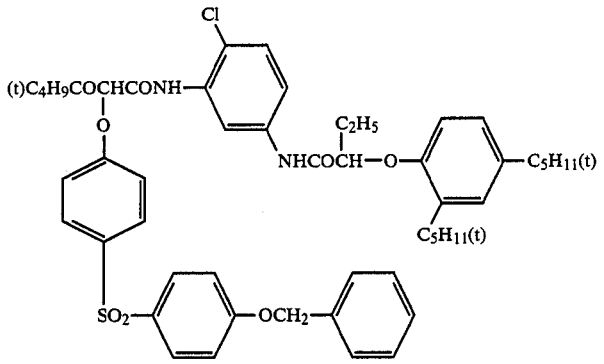
Y-5
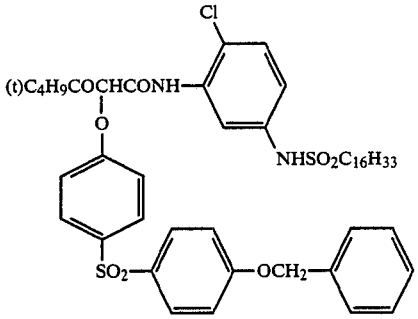
Y-6
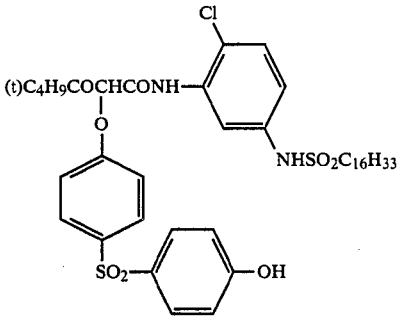
Y-7
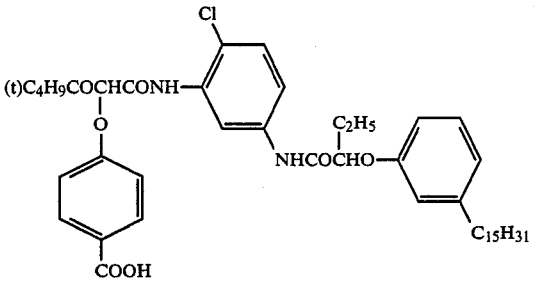
Y-8
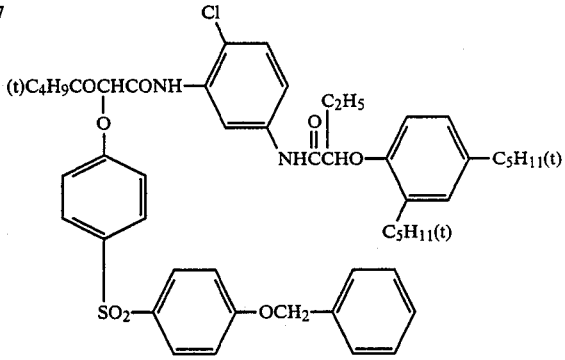
Y-9
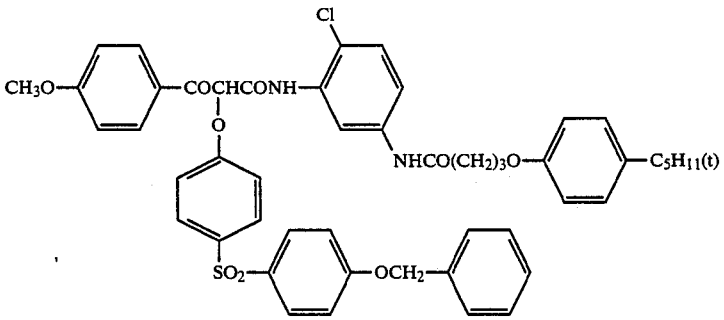
Y-10
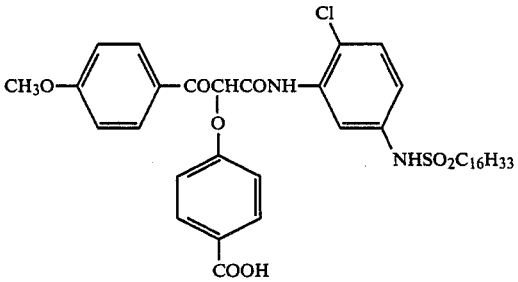

-continued
Y-11
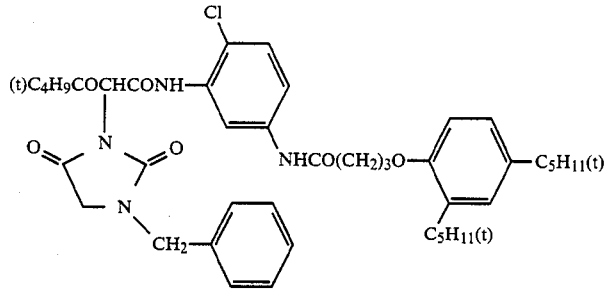
Y-12
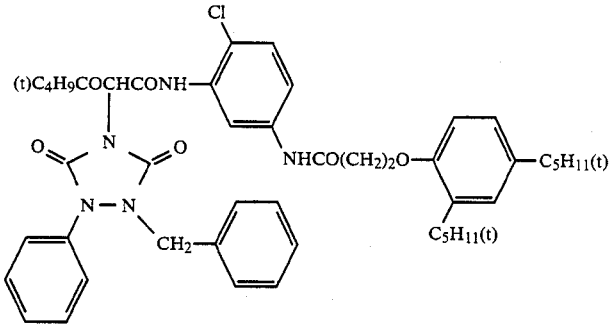
Y-13
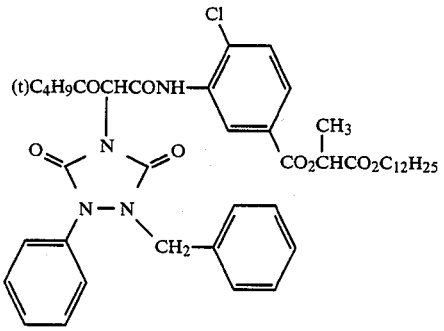
Y-14
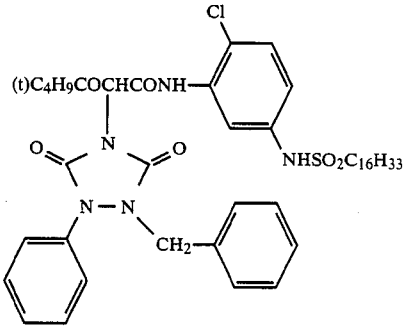
Y-15
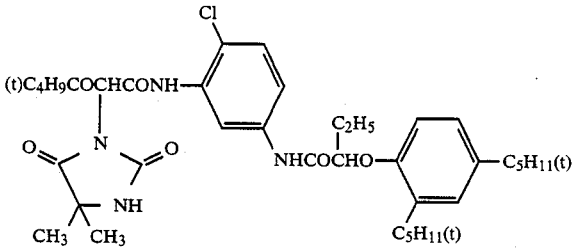
Y-16
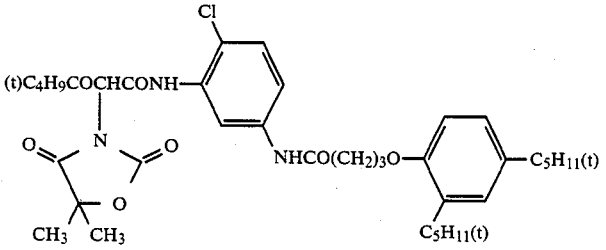

-continued
Y-17
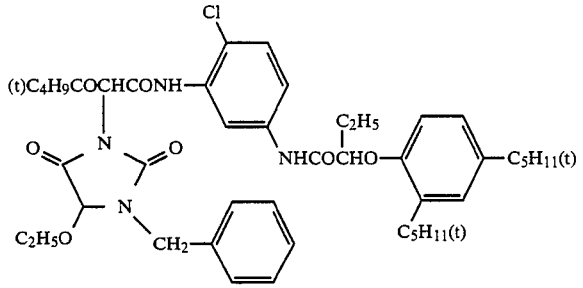
Y-18
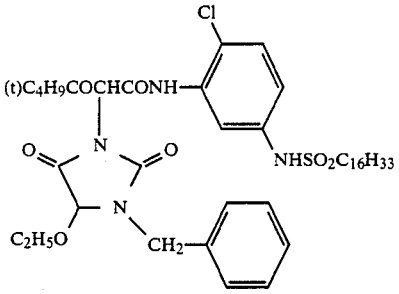
Y-19
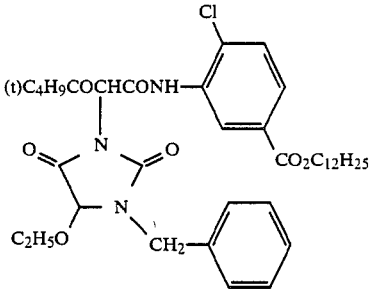
Y-20
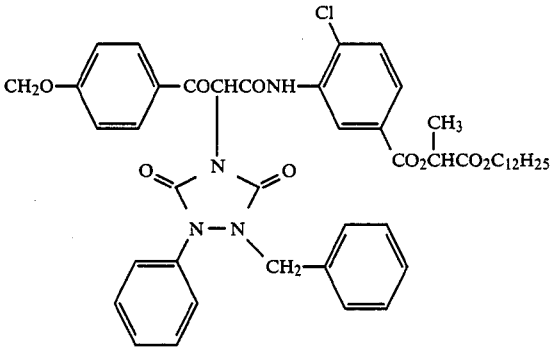
Y-21
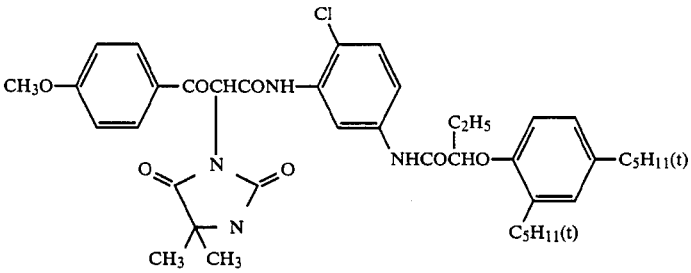
Y-22
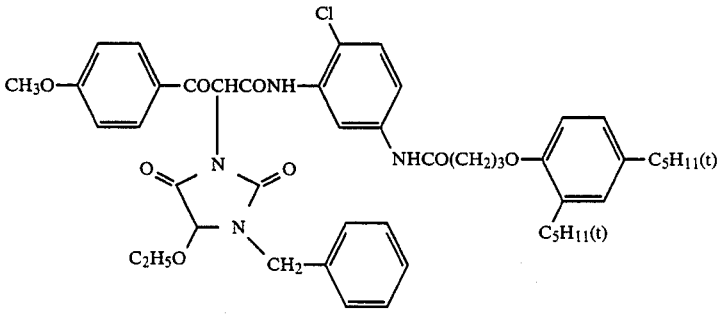

-continued
Y-23
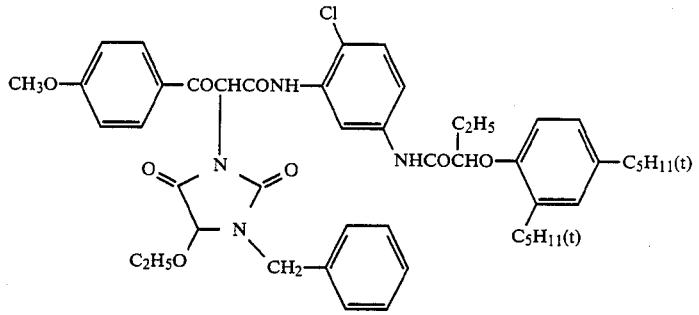
Y-24
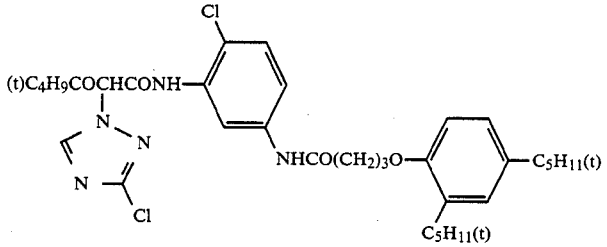
Y-25
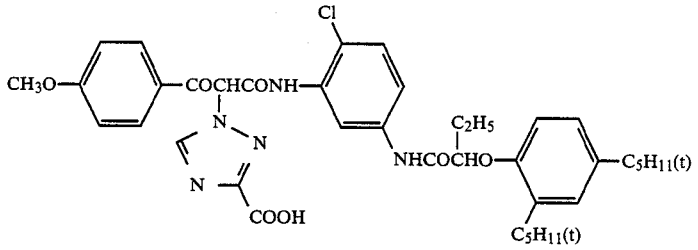
Y-26
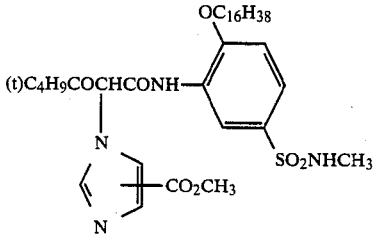
Y-27
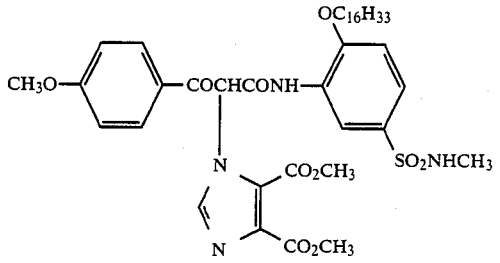
Y-28
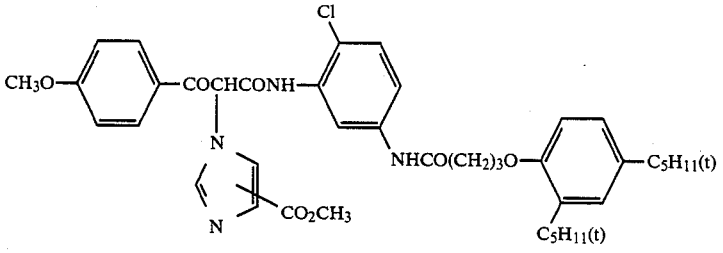
Y-29
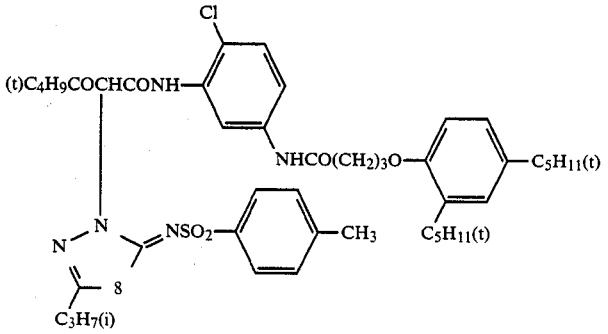

-continued
Y-30
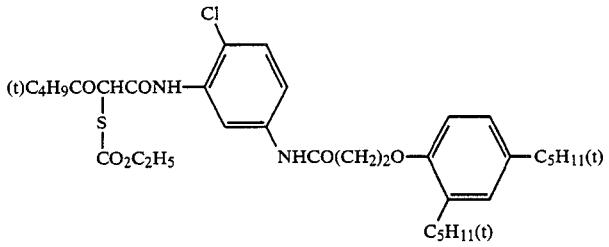
Y-31
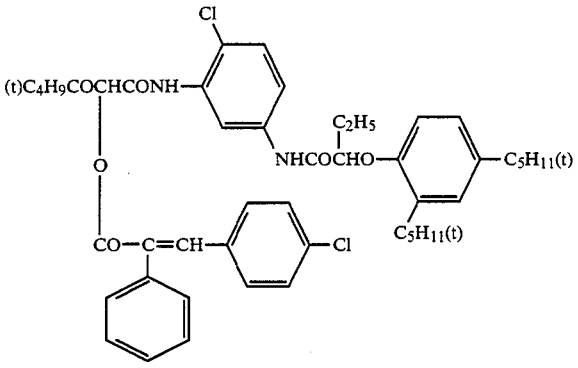
Y-32
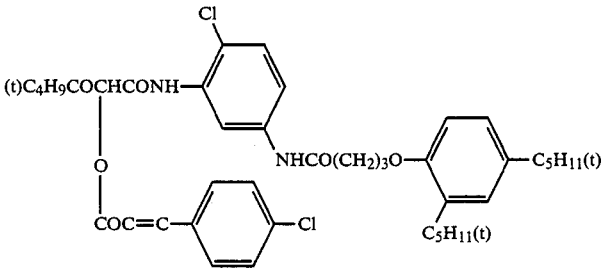
Y-33
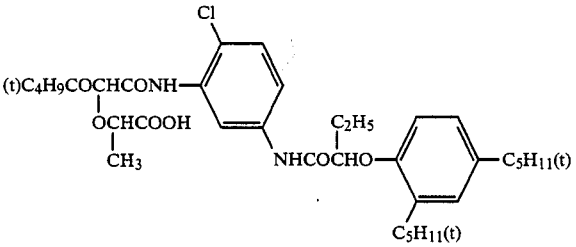
Y-34
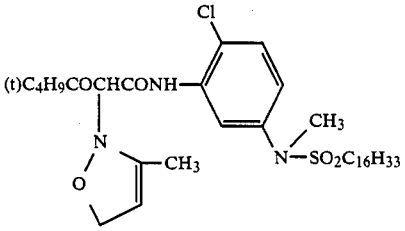
Y-35
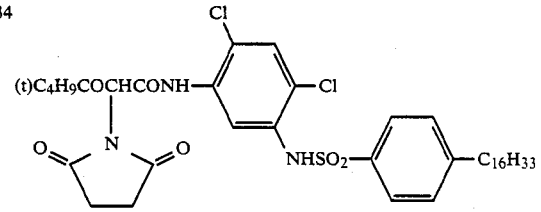

-continued
Y-36
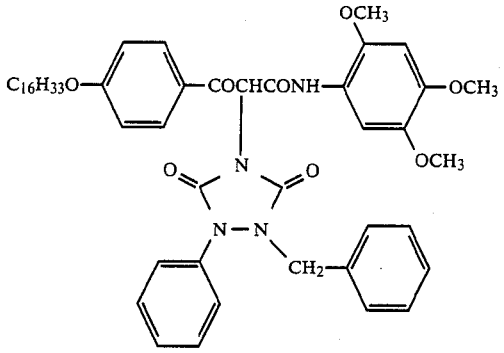
Y-37
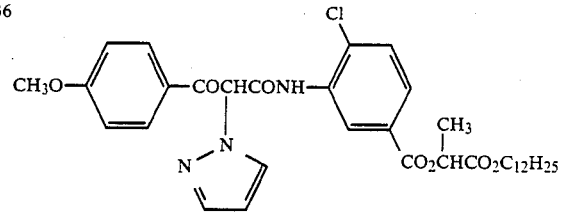
Y-38
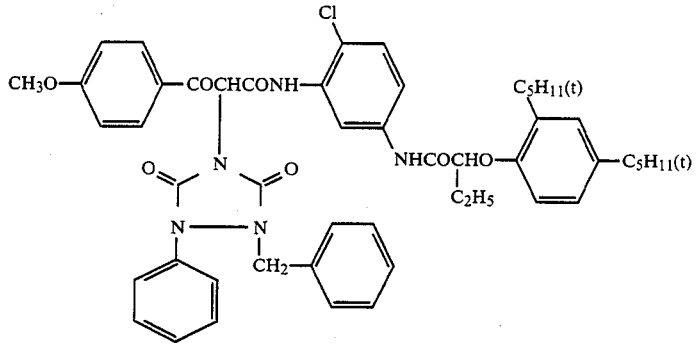
Y-39
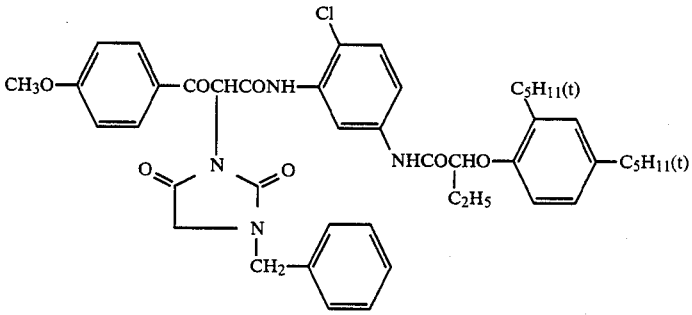
Y-40
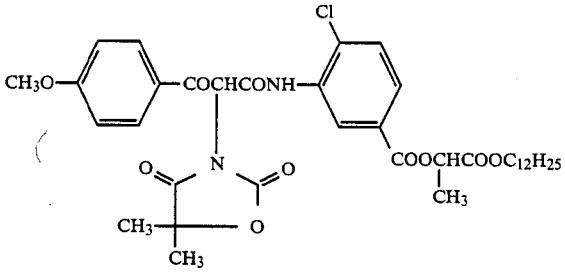
Y-41
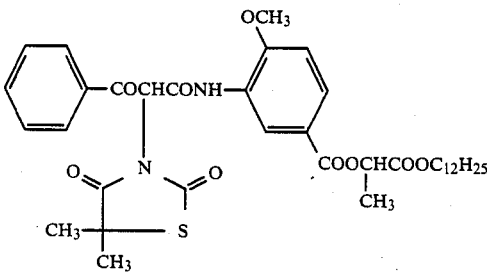
Y-42
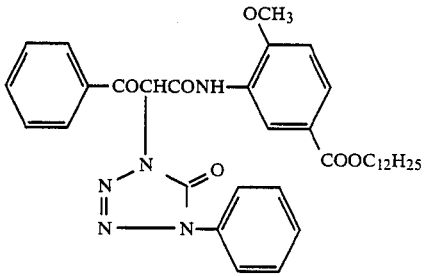

-continued
Y-43
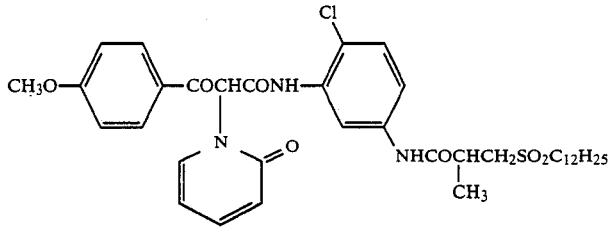
Y-44
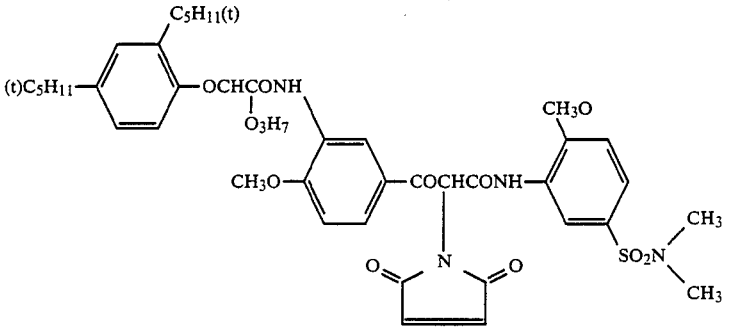
Y-45
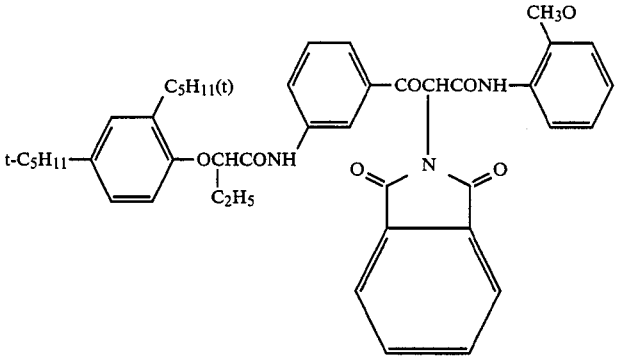
Y-46
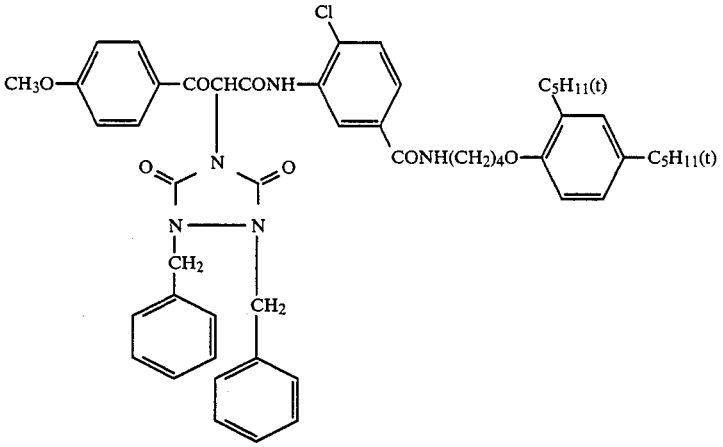
Y-47
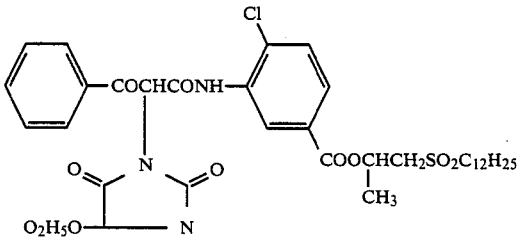

-continued
Y-48
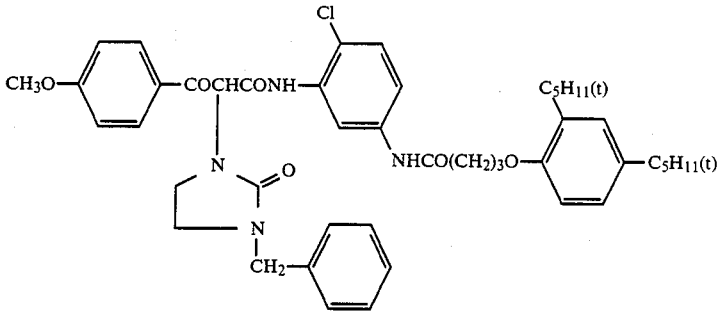
Y-49
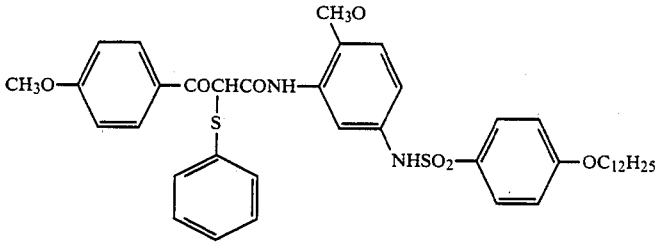
Y-50
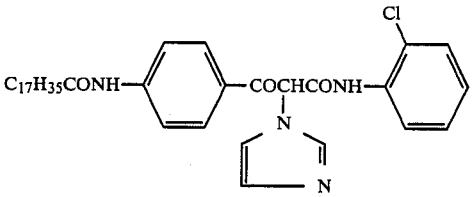
Y-51
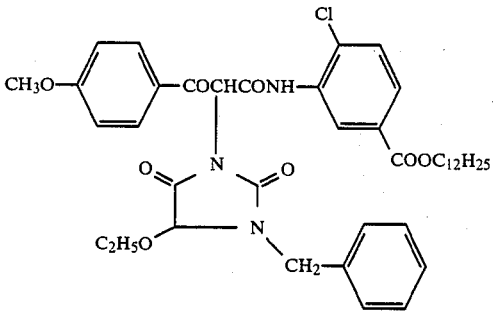
Y-52
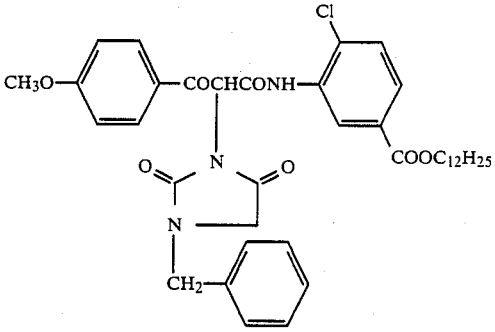
Y-53
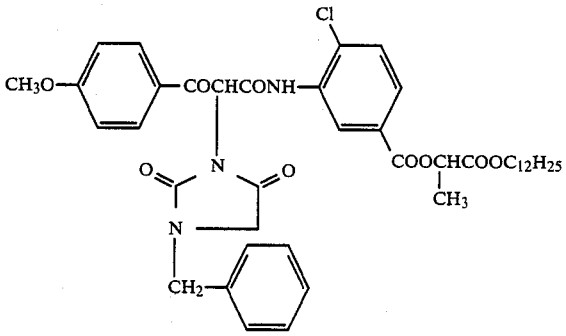

-continued

Y-54

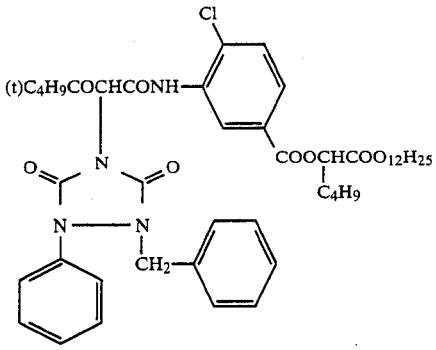

Y-55

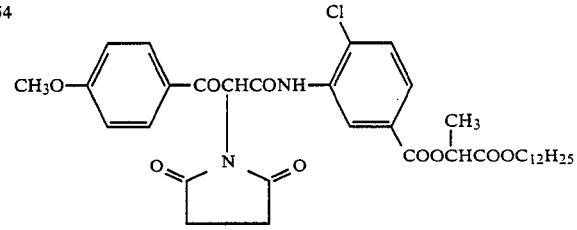

Y-56

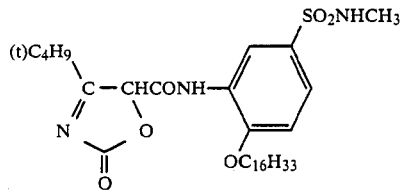

Y-57

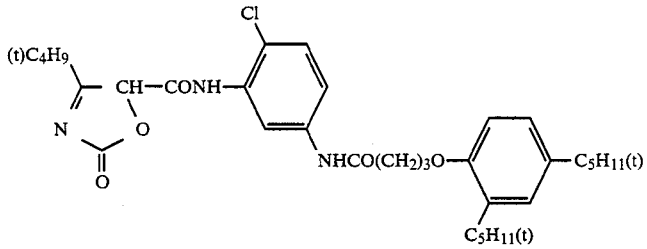

Y-58

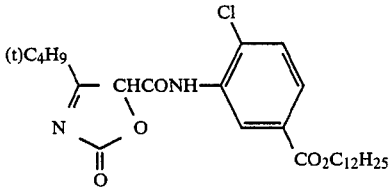

Y-59

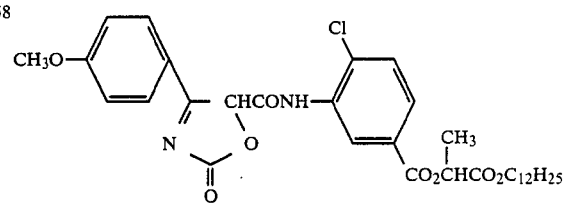

Y-60

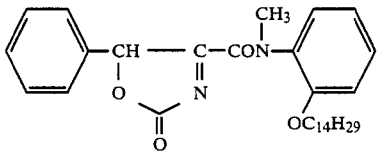

The couplers represented by the formulae [14] through [17] can be synthesized according to the well-known methods. For these methods, Japanese Patent Examined Publication No. 10783/1976, Japanese Patent O.P.I. Publication Nos. 66834/1973, 66835/1973, 102636/1976, 122335/1974, 34232/1975, 9529/1978, 39126/1978, 47827/1978 and 105226/1978, Japanese Patent Examined Publication No. 13576/1974, Japanese Patent O.P.I. Publication Nos. 89729/1976 and 75521/1976, U.S. Pat. Nos. 4,059,477 and 3,894,875, etc. may be referred to.

The content of the high speed bivalent yellow coupler is $1\times10^{-3}$ to $1\times10^{-1}$ mols per mol of silver halide contained in the sliver halide emulsion layer, and it is preferably in the range of $1\times10^{-2}$ *to* $8\times10^{-1}$ mols.

In the present invention, the silver halide emulsion layer containing the internal latent image type silver halide grains having internal fogging combinedly use other yellow couplers that the high speed bivalent yellow coupler, and the rate of the high bivalent coupler to all the yellow couplers is preferably at least 15 mol %.

In addition to the above mentioned coloring couplers, the sensitized material relevant to the present invention may utilize chemical compounds, hereinafter called the noncoloring coupler, which are coupled to the oxidized product of the color developing agent but which do not form dyes. The non-coloring couplers include the following chemical compounds:

(1) Coupler in which the dyes generated by coupling of the coupler with the oxidized product of color developing agent are eluted in the processing solution because it is water-soluble.

(2) Coupler which remains to be leuco-base although it is coupled to the oxidized product of the color developing agent.

(3) Coupler which produces colorless products because the dyes yielded by coupling to the oxidized product of the color developing agent do not present distinct visible absorption. The chemical compounds belonging to (1) above can be expressed by the following formula [18]:

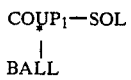

General formula[18]

In the above formula, $COUP_1$ represents the coupler residue having the coupling position marked with the asterisk "*", and BALL is a ballast group which is bonded to the coupling position, and splitted off from $COUP_1$ upon the reaction of the $COUP_1$ to the oxidized product of color developing agent, and at the same time it has such a size and shape that it can make the chemical compounds expressed by the formula [18] anti-diffusible. SOL is a solubilizing group which is bonded to the non-coupling position of $COUP_1$, and provides mobility to effuse products of coupling produced by coupling of $COUP_1$ to the oxidized product of the color developing agent out of the system for the light-sensitive material during processing for color development or later on.

As the coupler nucleus expressed by $COUP_1$, any coupler nucleus known or used in the photographic industry to generate reactive products colorless or having color shade by coupling to the oxidized product of the color developing agent may be used.

BALL is a ballast group having such size and shape that the compounds expressed by the formula [18] may be made anti-diffusible; and although it is not limitative as far as it gives anti-diffusibility to the compounds expressed by the formula [18], the useful groups expressed as BALL include the arylkyl, aryl and heterocyclic groups having 8 to 32 carbon atoms. These groups may and may not be substituted, but, as substituents, they are groups which increase the anti-diffusibility of the compounds expressed by the formula [18], and which increase the diffusibility of BALL after they are splitted off by reaction of coupling or by change of the reactivity for the chemical compounds expressed by the formula [18]. Furthermore, those which are coupled to the coupling site of $COUP_1$ through the bonding group are desirable as BALL. Typical bonding group includes an oxy (—O—), thio (s), carbonyloxy (—OCO), sulfonyloxy ($OSO_2$—), amide (—NHCO—), and sulfonamide (—$NHSO_2$) group.

Solubilizing groups represented by SOL are groups which give mobility to coupled products produced by coupling reaction to such a degree that they may be eluted out of the light-sensitive material system. For example, they include an ionizable hydroxyl group, carboxyl group, sulfo group and aminosulfonyl group, and ionizable salts consisting of the above groups, ester group, and ether group.

One, two, or more of these groups are also favorable in bonding to non-coupling position; and those having the suitable size, e.g., an alkyl group having one to ten carbon atoms and an aryl group having six to twelve carbon atoms in which the solubilizing group having one, two or more ionizable groups mentioned above are coupled to the non-coupling position of $COUP_1$ may be used favorably.

Also, those which are bonded to the non-coupling part of the above-mentioned $COUP_1$ through the bonding group are also preferable. Typical bonding group include an oxy (—O—O, thio (—s—), carbonyl group, carbonyloxy group, oxycarbonyl group, amino group, carbamoyl group, amino carbonyl group, ureido group, sulfamoyl group, and amino sulfonyl group.

Useful solubilizing groups are mentined above. Especially preferable solubilizing groups include the carboxyl group and sulfo group directly bonded to the non-coupling position of $COUP_1$, or ionizable salt of these groups; one, two or more carboxy groups and sulfo groups bonded to the non-coupling position of $COUP_1$ directly or through an amino group or carbonyl group, or an alkyl group having one through ten carbon atoms containing ionizable salts of these groups or aryl groups having six to twelve carbon atoms.

Further, the chemical compounds pertaining to the present invention which is capable of producing yellow, magenta and cyan dyes preferably used in this invention can be expressed by the following formulae [19] through [24]:

[Yellow dye producing compound]

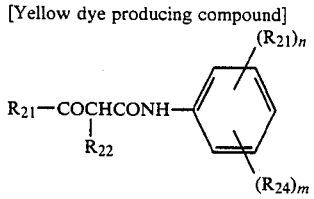

Formula [19]

In the above formula, $R_{21}$ is an aryl group such as phenyl group or an alkyl group especially, tertiary alkyl group such as t-butyl group, $R_{22}$ is the ballast group (BALL) mentioned earlier, $R_{23}$ is the solubilizing group (SOL) mentioned earlier, and $R_{24}$ is hydrogen atom, halogen atom, an alkyl group or an alkoxy group, and $n+m=5$ wherein, n and m each may be identical or different if n=0, and m=0, and n and m are 2 or more each.

[Magenta dye producing compounds]

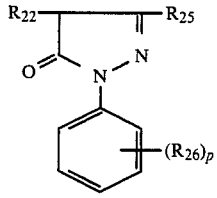

Formula [20]

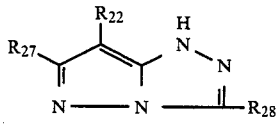

Formula [21]

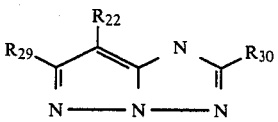

Formula [22]

In the formulae [20], [21], and [22], $R_{22}$ has the same meaning as $R_{22}$ in the formula [19], $R_{25}$ represents the solubilizing group (SOL), $R_{26}$ represents a hydrogen atom, halogen atom, alkyl group, alkoxy group or amino group provided that $p \leqq 5$ (where $p \neq 0$, and p may be identical or different if it is 2 or more), either one of $R_{27}$ and $R_{28}$ represents the above-mentioned solubilizing group (SOL) and the other one represents a hydrogen atom, alkyl group, alkoxy group, aryl group or amino group.

$R_{29}$ and $R_{30}$ have the same meaning as those of $R_{27}$ and $R_{28}$ in the formula [21].

[Cyan dye producing compounds]

Formula [23]

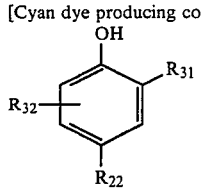

Formula [24]

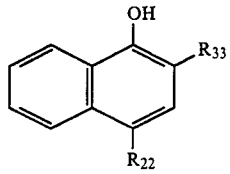

In the formula [23] and [24], $R_{22}$ has the same meaning as that in the formula [19], at least one of $R_{31}$ and $R_{32}$ is the above-mentioned solubilizing group (SOL), and the remaining one represents a hydrogen atom, halogen atom, alkyl group, alkoxy group or alkyl amide group, $q \leqq 3$ (where $q \neq 0$), and $R_{33}$ represents the above-mentioned solubilizing group (SOL).

In the above description, unless otherwise specified, each of the alkyl group, alkoxy group and alkyl amide group contains one to eight carbon atoms, and the amino group includes the primary, secondary, and tertiary amino groups.

These substituents and ballast groups (BALL) include those which are further substituted by a halogen atom, a hydroxy, carboxy, amino, amide, carbamoyl, sulfamoyl, sulfon amide, alkyl, alkoxy, or aryl groups.

In the non-coloring couplers pertaining to the present invention, the chemical compounds belonging to (2) above can be expressed by the formula [25] below:

Formula [25]

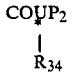

In the above formula, $COUP_2$ has the same meaning as $COUP_1$ in the formula [14], $R_{34}$ represents a group which is bonded to the coupling position of $COUP_2$, and which cannot be splitted off by reaction between the coupler expressed by the formula [25] and oxidized product of color developing agent.

As the coupler component represented by $COUP_2$, the coupler component described in connection with the formula [18] may be used.

The group represented by $R_{34}$ includes an alkyl, substituted alkyl, aryl, substituted aryl, alkenyl and cyano groups.

Chemical compounds expressed by the formula [25] are preferably made anti-diffusible by means of an alkyl, aryl or heterocyclic group having 8 to 32 carbon atoms through bonding groups in the non-coupling part of the coupler nuclei represented by $COUP_2$. Typical bonding group includes an oxy (—O—), thio (—S—), carbonyl group, carbonyl oxy group, oxycarbonyl group, amino group, carbamoyl group, aminocarbonyl group, ureido group, sulfamoyl group and aminosulfonyl group. In the noncoloring couplers relevant to the present invention, the chemicals belonging to (3) above can be expressed by the following formula [26]:

Formula [26]

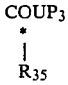

In the above formula, $COUP_3$ represents the coupler residue which provides substantially colorless products, and $R_{35}$ represents the groups which are bonded to the coupling position of $COUP_3$ and which can be splitted off from $COUP_3$ as a result of the reaction of coupling to the oxidized product of color developing agent.

The desirable group which can be splitted off includes a halogen atom, alkoxy group, aryloxy group, heterocyclic oxy group, alkylthio group, heterocyclic thio group, aryl azo group, acyloxy group, alkylsulfonyloxy group, an aryl sulfonyloxy group and a nitrogen-containing heterocyclic group.

Among the non-coloring coupler expressed by the formula [26], those which are more preferable can be expressed by the formulae [27] through [30].

Formula [27]

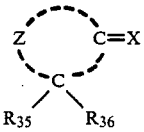

In the above formula, $R_{35}$ has the same meaning as that in the formula [26]; $R_{36}$ represents a hydrogen atom, alkyl group, aryl group, halogen atom, alcoxy group, acyloxy group or heterocyclic group; and X represents an oxygen atom or $=N\text{-}R_{37}$ group. $R_{37}$ represents an alkyl group, aryl group, hydroxy group, alcoxy group or sulfonyl group. Z represents a group of non-metallic atoms necessary to form 5-, 6-, and 7-member carbon rings such as indanon, cyclopentanon, and cyclohexanon or heterocyclic groups e.g. piperidon, pyrolidon, and hydrocarbostyryl.

Formula [28]

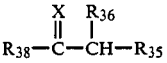

In the above formula, $R_{15}$, $R_{16}$ and X have the same meanings as those in the formula [27]; and $R_{18}$ represents an alkyl, aryl, heterocyclic, cyano, hydroxy, alkoxy, aryloxy, heterocyclic oxy, alkylamino, dialkylamino or anilino group.

Formula [29]

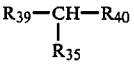

In the above formula, $R_{35}$ has the same meaning as that in the formula [26]; and $R_{39}$ and $R_{40}$ may be identical or different provided that they represent an alkoxy, carbonyl, carbamoyl, acyl, cyano, formyl, sulfonyl, sulfinyl, sulfamoyl, ammonium, or

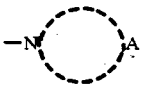

group. A represents a group of non-metallic atoms necessary for formation of a 5- to 7-member heterocyclic rings such as phthal imide, triazol, or tetrazol, together with the nitrogen atoms.

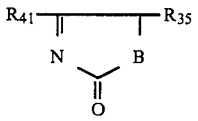

Formula [30]

In the above formula, R35 has the same meaning as that in the formula [26]; R41 represents an alkyl, aryl, anilino, alkylamino or alcoxy group; and B represents an oxygen, sulfur or nitrogen atom.

Typical examples of non-coloring couplers relevent to the present invention are given below provided that they should not be construed as limitative:

Example of chemical compounds represented by Formula [18]

(DS-1)

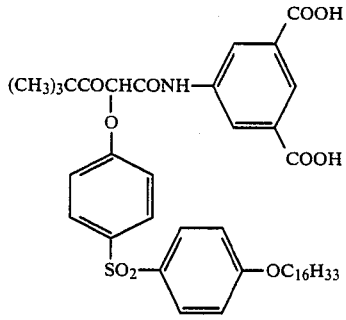

(DS-2)

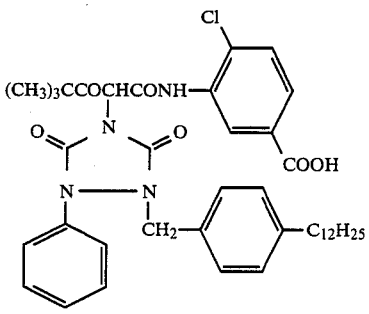

(DS-3)

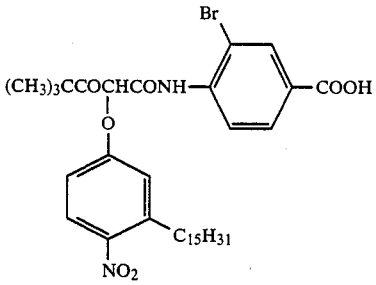

(DS-4)

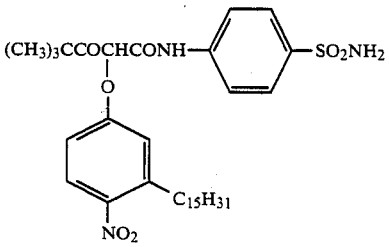

-continued
(DS-5)
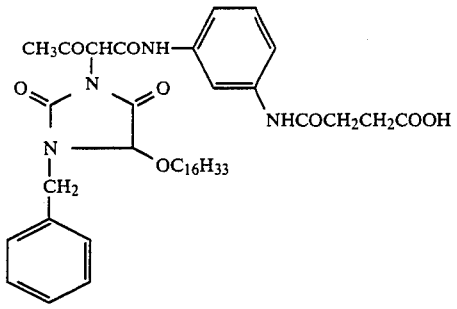
(DS-6)
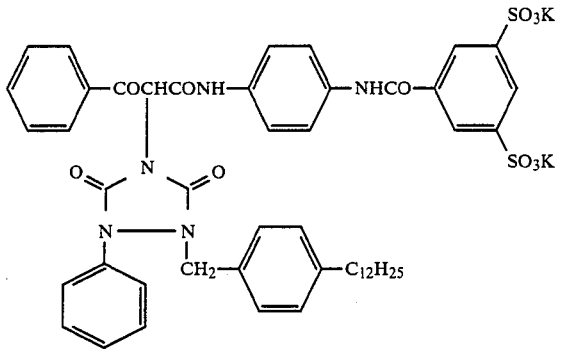
(DS-7)
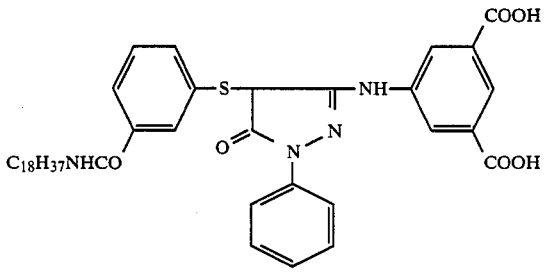
(DS-8)
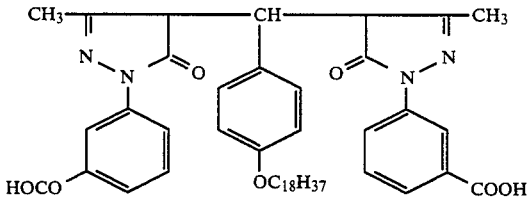
(DS-9)
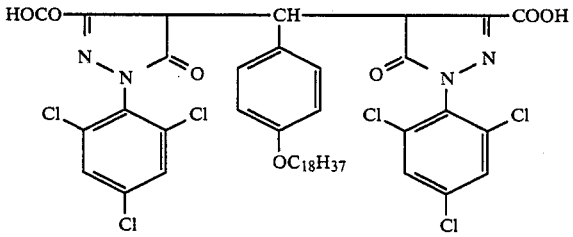

-continued
(DS-10)
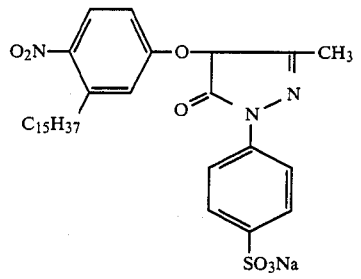
(DS-11)
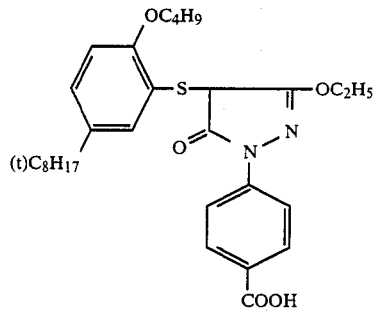
(DS-12)
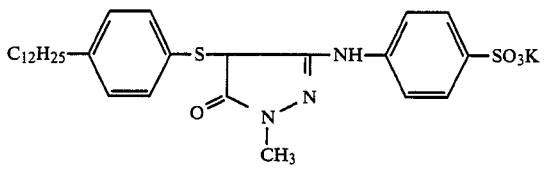
(DS-13)
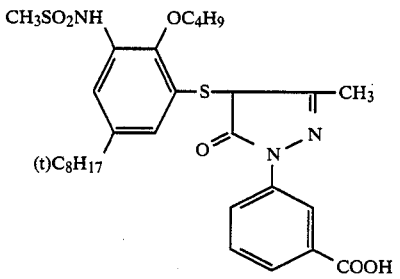
(DS-14)
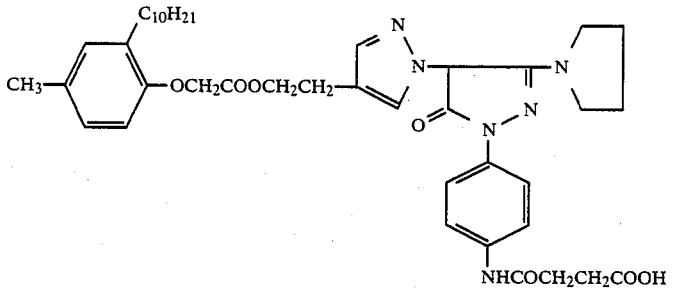
(DS-15)
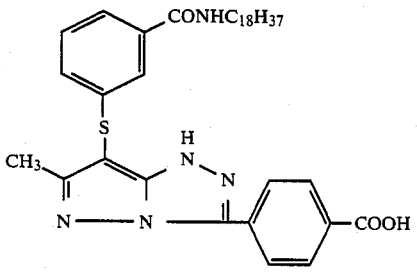

-continued
(DS-16)
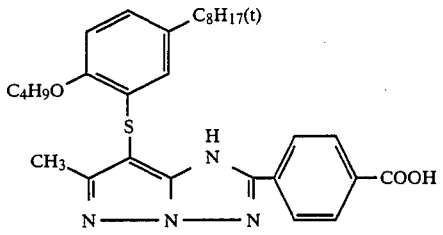
(DS-17)
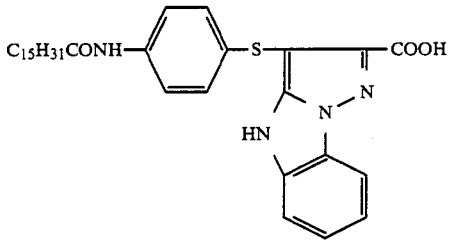
(DS-18)
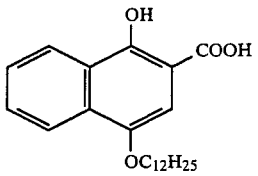
(DS-19)
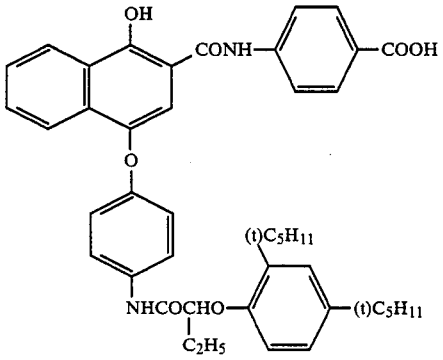
(DS-20)
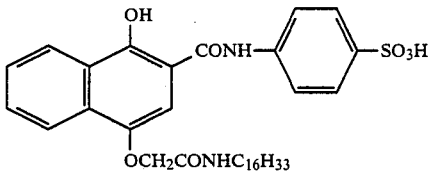
(DS-21)
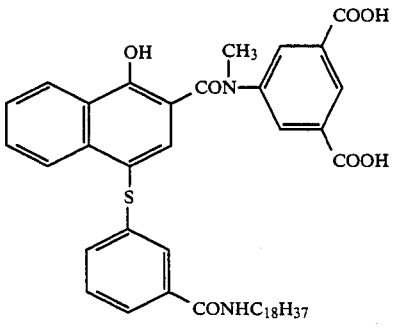

-continued
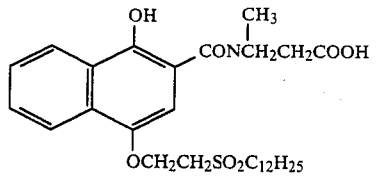
(DS-22)
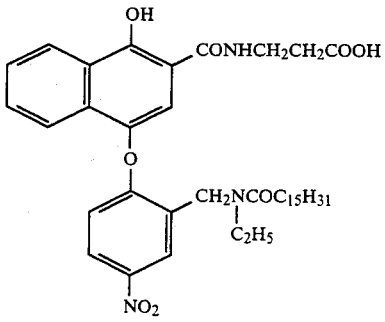
(DS-23)
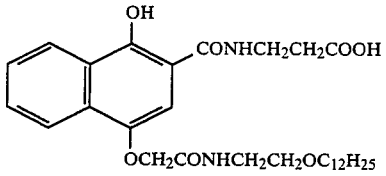
(DS-24)
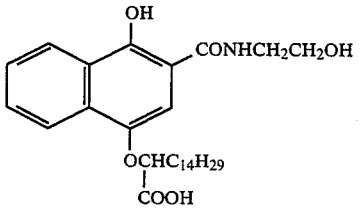
(DS-25)
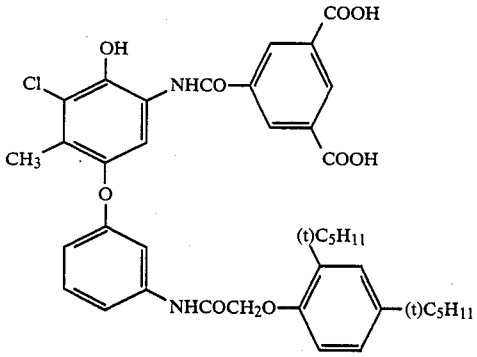
(DS-26)
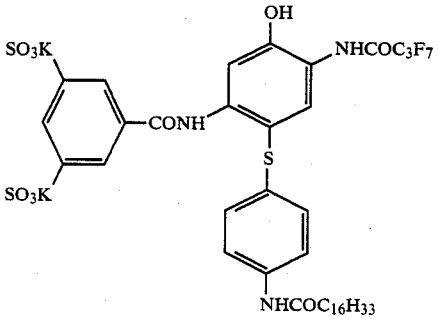
(DS-27)

-continued
(DS-28)
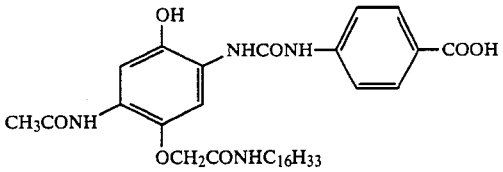
(DS-29)
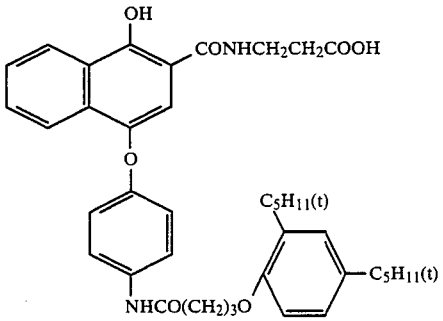
(DS-30)
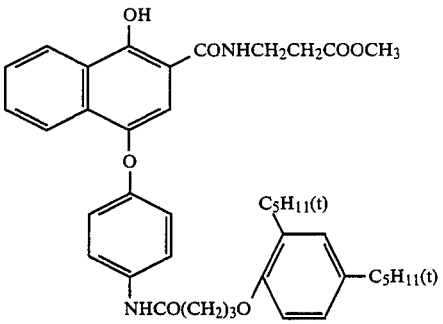
(DS-31)
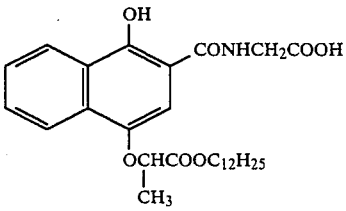
(DS-32)
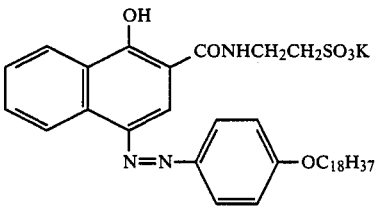
(DS-33)
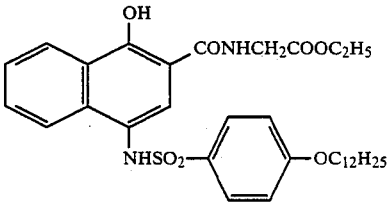

-continued
(DS-34)
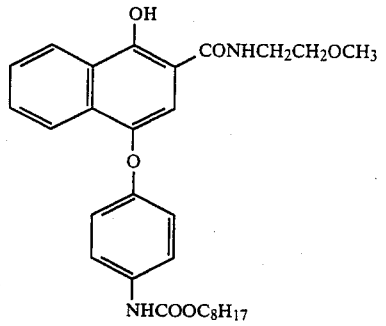
(DS-35)
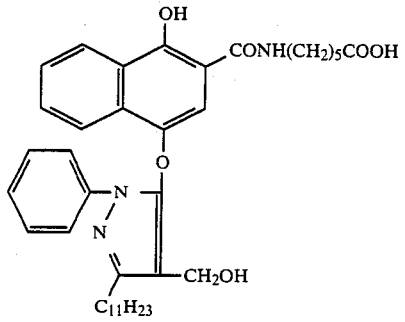
(DS-36)
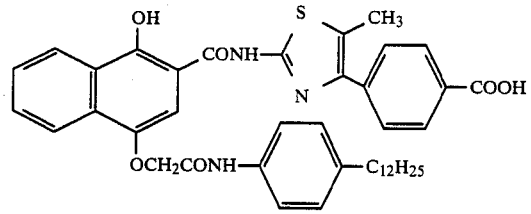
(DS-37)
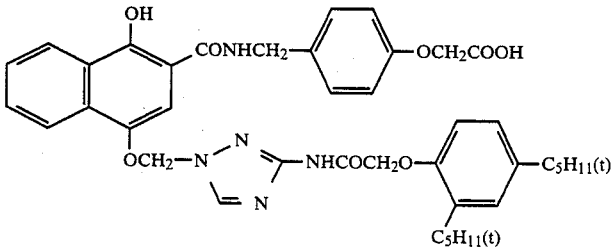
Examples of chemical compounds represented by Formula [25]
(DS-38)
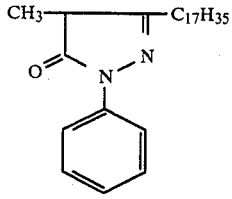
(DS-39)
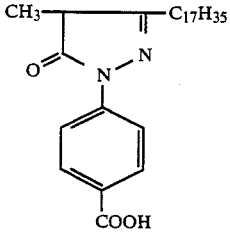

-continued
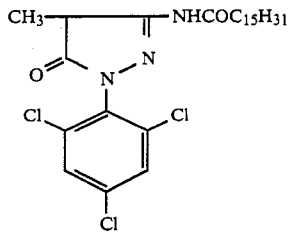
(DS- 40)
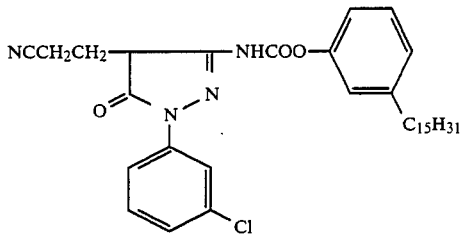
(DS-41)
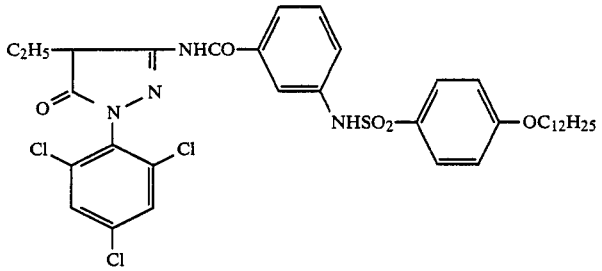
(DS-42)
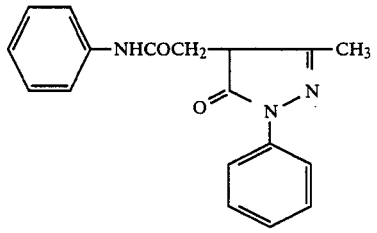
(DS-43)
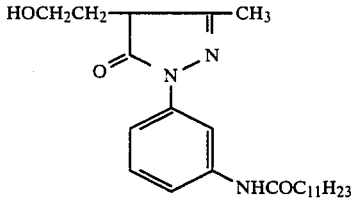
(DS-44)
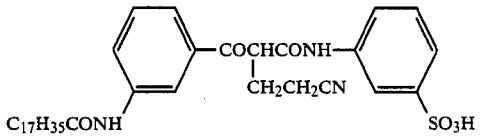
(DS-45)
Examples of chemical compounds represented Formula [26]

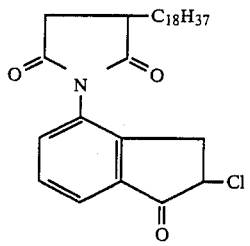
(DS-46)
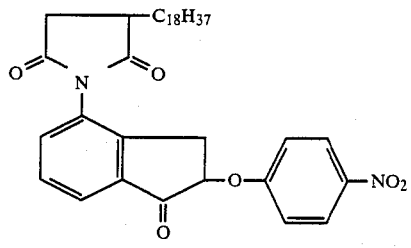
(DS-47)
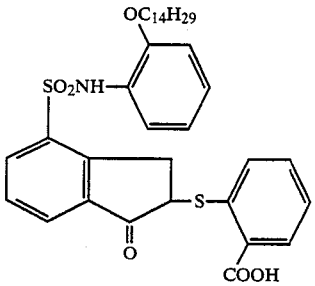
(DS-48)
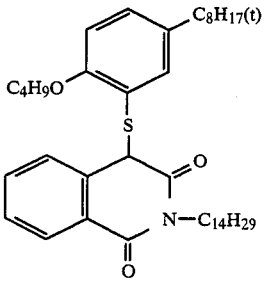
(DS-49)
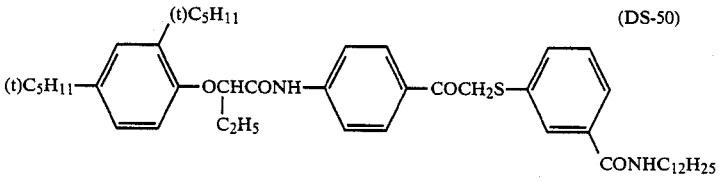
(DS-50)
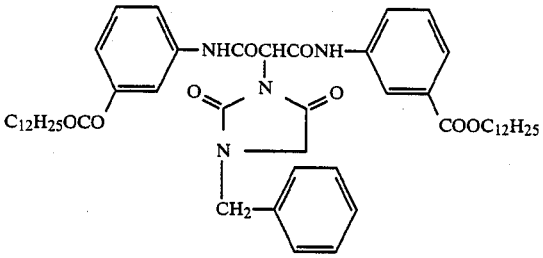
(DS-51)
The above-mentioned non-coloring couplers can be synthesized according to the methods described in Japanese Patent O.P.I. Publication Nos. 113440/1984, 171955/1984, and 82423/1977, British Pat. Nos. 914,145 and 1,284,649, U.S. Pat. Nos. 2,742,832, 3,227,550, 3,928,041, 3,958,993, 3,961,959, 4,046,574, 4,052,213, and 4,149,886.
These non-coloring couplers can be introduced into the silver halide emulsion layer according to the same method as the dye forming couplers described later. Desirable anti color fog agents include the chemical compounds represented by the following formula [31] and [32].

Formula [31]

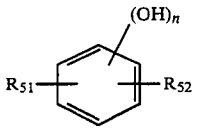

wherein n is 2 or 3 and the position of hydroxyl group on the benzene ring is 1,2 or 1,3 or 1,2,3. $R_{51}$ is a hydrogen atom, halogen atom, aliphatic group, carboxyl group or its salt, sulfo group or its salt, carboalkoxy group, —$COR_{53}$, —$SO_2R_{54}$, —$CONHR_{55}$, or —NH-$COR_{56}$, wherein $R_{53}$, $R_{54}$, $R_{55}$, and $R_{56}$ each are an aliphatic group or aromatic group.

Formula [32]

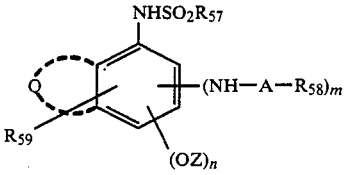

wherein, A is —CO— or —$SO_2$—, $R_{57}$ and $R_{58}$ each are an alkyl group, an aryl group, or a heterocyclic group, Z is a hydrogen atom or alkali decomposable precursor group, m is 1 or 2, n is 0 or 1, at least one of —N-H—A—$R_{58}$ and —OZ is in an ortho or para position to —$NHSO_2R_{59}$. $R_{59}$ is a hydrogen atom, halogen atom, cyano group, nitro group, alkyl group, aryl group, heterocyclic group, alkoxy group, aryloxy group, alkylthio group, arylthio group, heterocyclic thio group, carbamoyl group, alkoxycarbonyl group, acyl group, alkoxycarbonylamino group, ureido group, amino group, sulfinyl group, acylamide group, sulfonyl group or sulfonamide group. Q is a group of atoms forming a ring which may be omitted.

In the formula [31], the aliphatic group represented by $R_{51}$, $R_{52}$, $R_{53}$, $R_{54}$, $R_{55}$, and $R_{56}$ may have a substituent such as an alkyl group or alkenyl group. The alkyl group is preferable to be of a straight chain or branch having 1–20 carbon atoms, more preferably 1–18 carbon atoms. The alkenyl group is preferable to have 3–20 carbon atoms, more preferably 3–18 carbon atoms. The aromatic group represented by $R_{51}$–$R_{56}$ may have a substituent such as an aryl group.

Examples of the substituent for the aliphatic group and aromatic group represented by $R_{51}$–$R_{56}$ may be a halogen atom, hydroxyl group, sulfo group, carboxyl group, cyano group, amino group, alkyl group, alkenyl group, aryl group, alkoxy group, aryloxy group, an acyl group, acyloxy group, acylamino group, alkylmino group, arylamino group, alkoxycarbonyl group, aryloxycarbonyl group, carbamoyl group, an alkylcarbamoyl group, or aryloxycarbamoyl group.

Salts of the carboxyl group or sulfo group represented by $R_{52}$ include alkali metal salts (such as sodium salts and potassium salts) and ammonium salts.

The polyhydroxy benzene type compound represented by the formula [31] is prepared by following the synthesizing procedures disclosed in U.S. Pat. Nos. 2,360,290, 2,701,197, 2,728,659, 2,732,300, and Beilstein's writings. It is also allowed to use a commercially available compound as an anti-oxidant.

The alkyl group represented by $R_{57}$ and $R_{58}$ in the formula [32] may be either a straight-chain or branch and is preferable to have 1–30 carbon atoms.

The aryl group represented by $R_{57}$ and $R_{58}$ is preferable to have 6—30 carbon atoms.

The heterocyclic groups represented by $R_{57}$ and $R_{58}$ are preferable to have at least either one of 0 and N as a hetero atom and have 5–30 carbon atoms. Their examples include pyridyl and morpholino group. These groups represented by $R_{57}$ and $R_{58}$ may have a substituent. Examples of such a substituent include the groups which were referred to as groups of the aromatic group and aliphatic group represented by $R_{51}$–$R_{56}$.

The ring represented by Q indicates a group of atoms required for the formation of a naphthalene ring with the benzene ring.

In the alkali decomposable precursor group represented by Z, the hydrogen atom of the hydroxyl group has been substituted with the blocking group which is removed when contacted with alkali. A typical blocking group can be removed by the hydrolysis or intermolecular nucleophilic substitution. Examples of a typical group which can be removed by the hydrolysis include an acyl group, for example an aliphatic group, an aromatic carbonyl group, or sulfonyl group such as alkylsulfonyl, arylsulfonyl. A typical group which can be removed by the intermolecular nucleophilic substitution is disclosed in U.S. Pat. No. 4,310,612.

The compound represented by the formula [32] may be synthesized according to the known processes disclosed in Japanese Patent Application Laid-open Prints Nos. 55-72158, 59-5247, 59-192246, 59-192247, 59-195238, 59-195239, 59-202465, 59-204039, 59-204040, 59-206833, 59-212837, 59-220733, 59-222836, 60-108843, 60-118835, and 60-118836.

The following are specific examples of the compounds represented by the formulae [31] and [32] to be used in the present invention but these are not exclusive examples.

The compounds represented by the formula [31] are expressed by a formula:

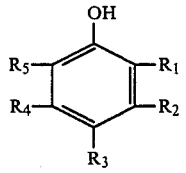

and $R_1$–$R_5$ as shown in the following table.

| Compound No. | $R_1$ | $R_2$ | $R_3$ | $R_4$ | $R_5$ |
|---|---|---|---|---|---|
| (Q-1) | —OH | H | —$C_4H_9$(t) | H | H |
| (Q-2) | —OH | H | —$C_{12}H_{25}$ | H | H |

-continued

| Compound No. | $R_1$ | $R_2$ | $R_3$ | $R_4$ | $R_5$ |
|---|---|---|---|---|---|
| (Q-3) | —OH | H | 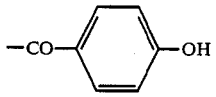 | H | H |
| (Q-4) | —OH | H | $-COCH_3$ | H | H |
| (Q-5) | —OH | H | $-COOC_2H_5$ | H | H |
| (Q-6) | —OH | $-SO_3NH_4$ | H | H | H |
| (Q-7) | —OH | H | 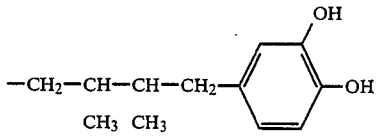 | H | H |
| (Q-8) | —OH | H | 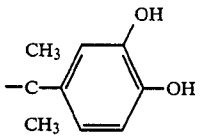 | H | H |
| (Q-9) | H | —OH | —COOH | H | H |
| (Q-10) | H | —OH | $-SO_3NH_4$ | H | H |
| (Q-11) | H | —OH | $-COOC_2H_5$ | H | H |
| (Q-12) | H | —OH | $-COCH_3$ | H | H |
| (Q-13) | H | —OH | 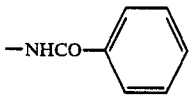 | H | H |
| (Q-14) | —OH | H | —COOH | H | —OH |
| (Q-15) | —OH | H | $-COOC_{12}H_{25}$ | H | —OH |
| (Q-16) | —OH | H | $-CONHC_2H_5$ | H | —OH |
| (Q-17) | —OH | H | 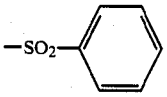 | H | —OH |
| (Q-18) | —OH | H | $-NHCOCH_3$ | H | —OH |
| (Q-19) | —OH | H | 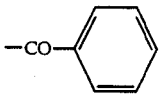 | H | —OH |
| (Q-20) | —OH | H | $-COOC_5H_{11}$(iso) | H | —OH |
| (Q-21) | —OH | H | $-SO_3Na$ | H | —OH |
| (Q-22) | —OH | $-COC_5H_{11}$ | H | H | —OH |
| (Q-23) | —OH | H | $-SO_2C_{12}H_{25}$ | H | —OH |

The following are preferable compounds which are represented by the formula [32].

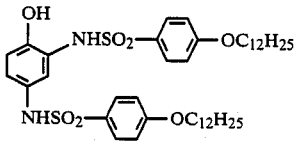

(Q-24)

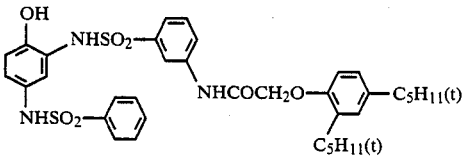

(Q-25)

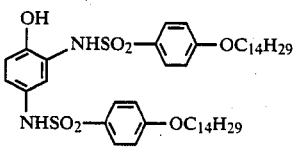

(Q-26)

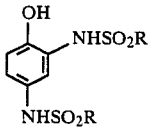

(Q-27)

-continued
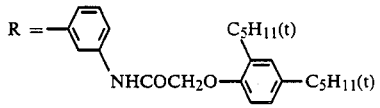
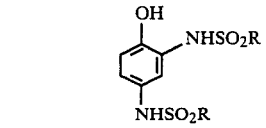
(Q-28)
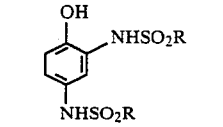
(Q-29)
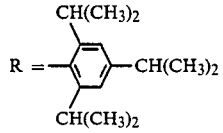
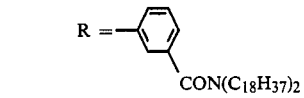
(Q-30)
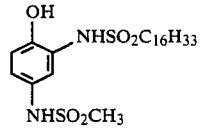
(Q-31)
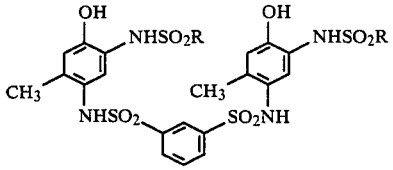
(Q-32)
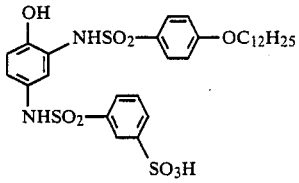
(Q-33)
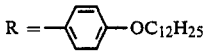
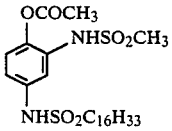
(Q-34)
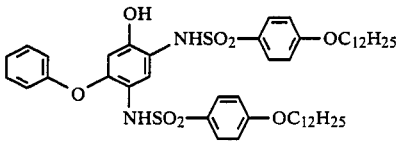
(Q-35)
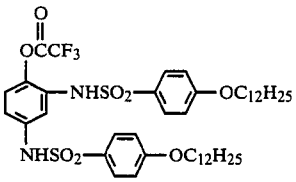
(Q-36)
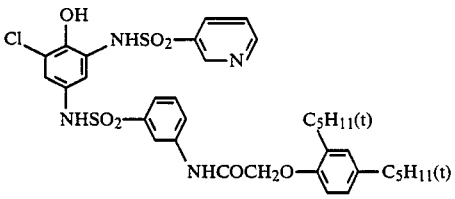
(Q-37)
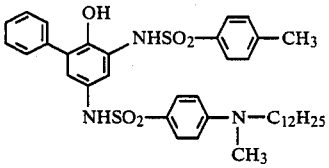
(Q-38)
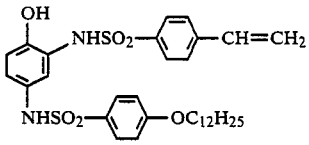
(Q-39)
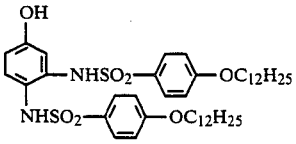
(Q-40)
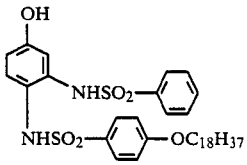
(Q-41)

-continued
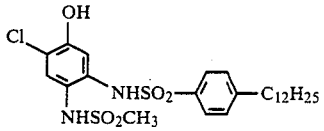
(Q-42)
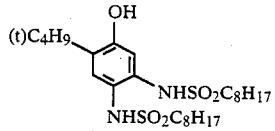
(Q-43)
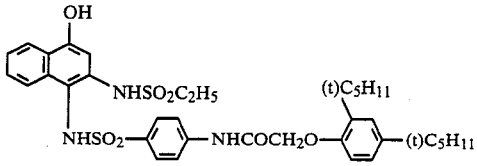
(Q-44)
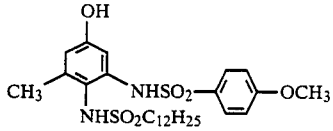
(Q-45)
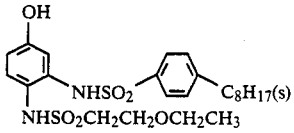
(Q-46)
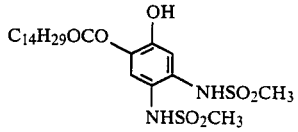
(Q-47)
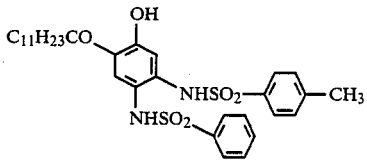
(Q-48)
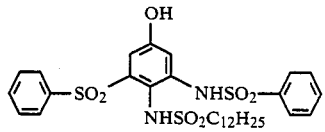
(Q-49)
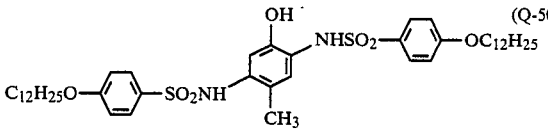
(Q-50)
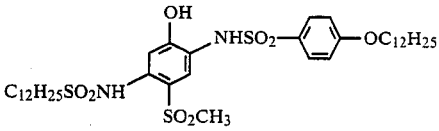
(Q-51)
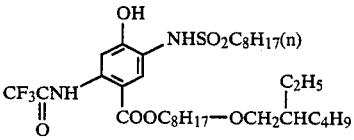
(Q-52)
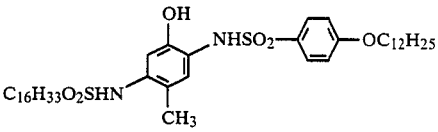
(Q-53)
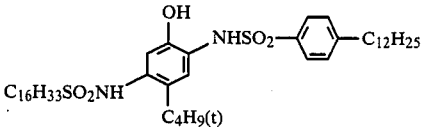
(Q-54)
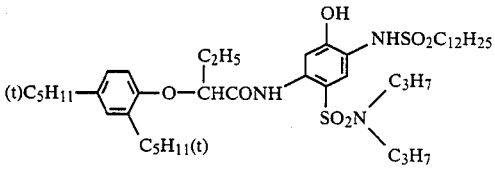
(Q-55)
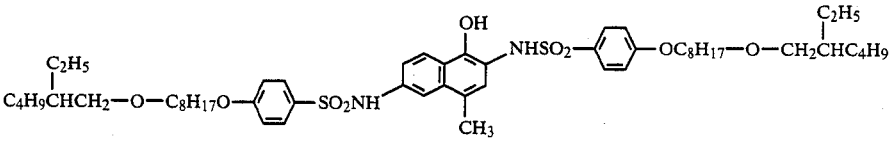
(Q-56)
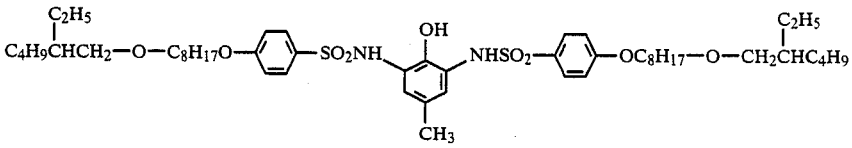
(Q-57)
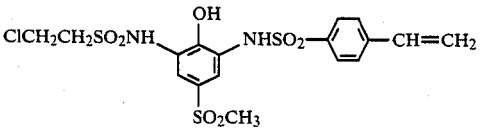
(Q-58)
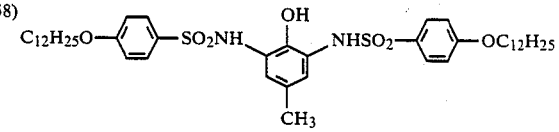
(Q-59)

-continued
(Q-60)
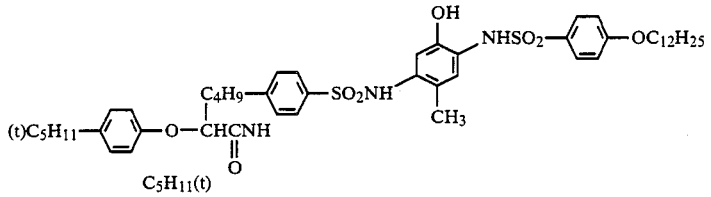
(Q-61)
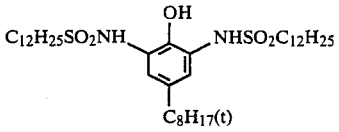
(Q-62)
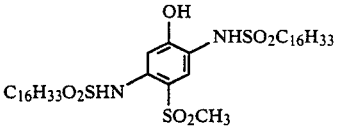
(Q-63)
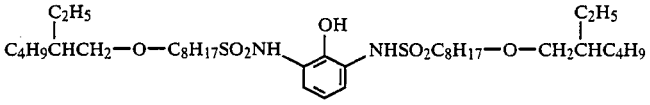
(Q-64)
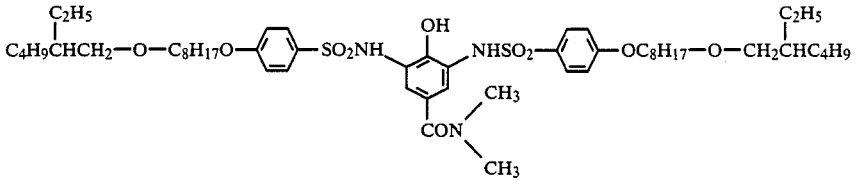
(Q-65)
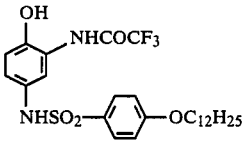
(Q-66)
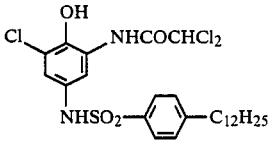
(Q-67)
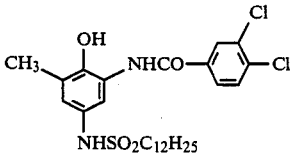
(Q-68)
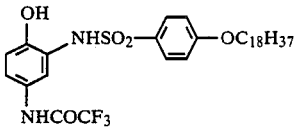
(Q-69)
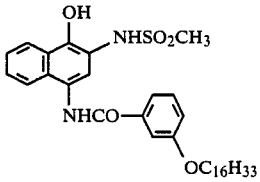
(Q-70)
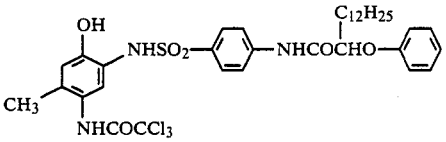
(Q-71)
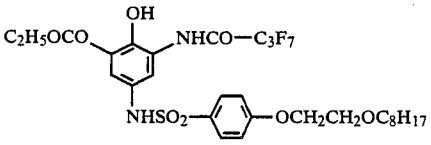
(Q-72)
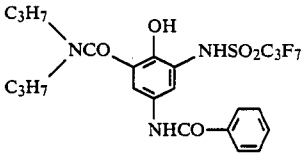
(Q-73)
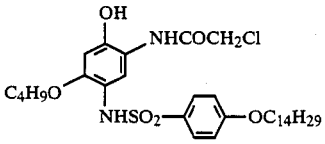
(Q-74)
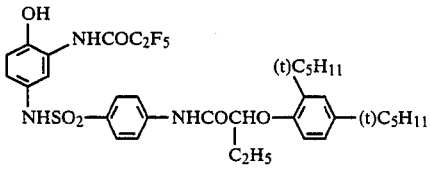
(Q-75)
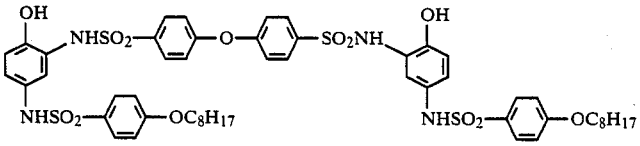

-continued
(Q-76)
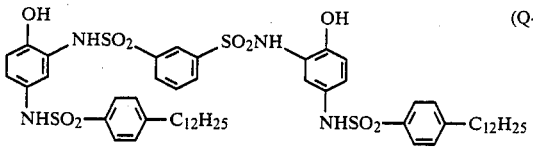
(Q-77)
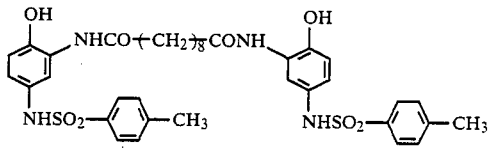
(Q-78)
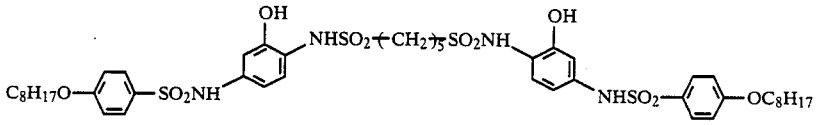
(Q-79)
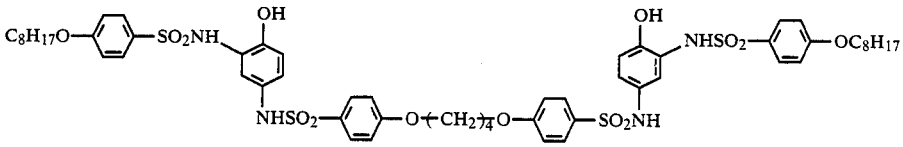
(Q-80)
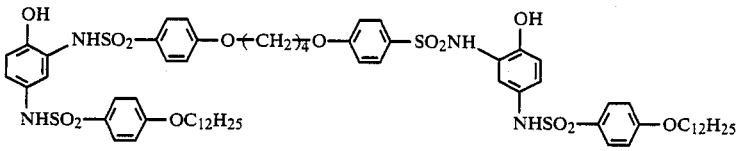
(Q-81)
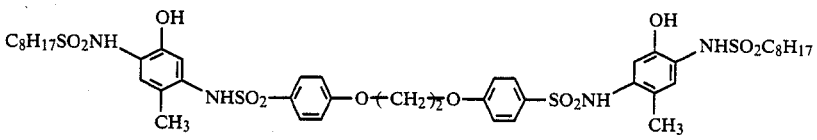
(Q-82)
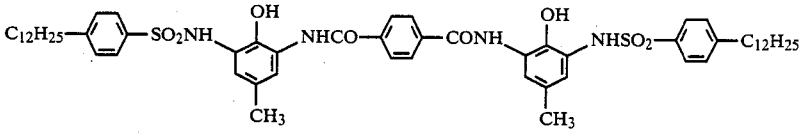
(Q-83)
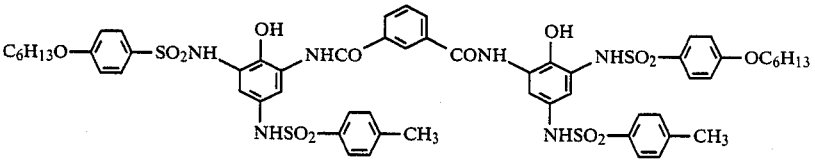
(Q-84)
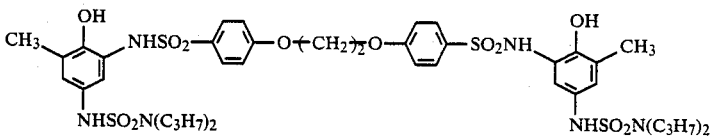
(Q-85)
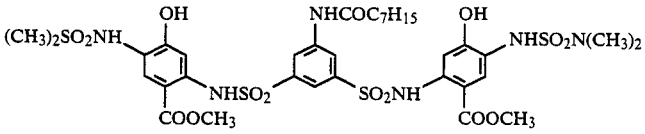
(Q-86)
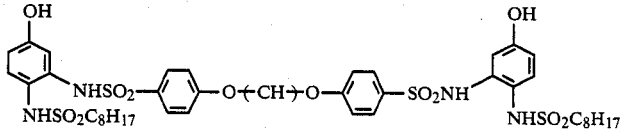
(Q-87)
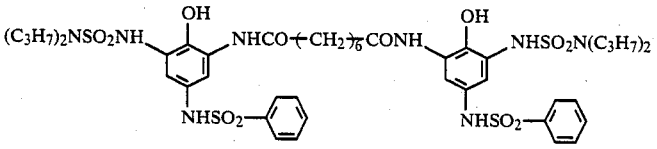

-continued
(Q-88)
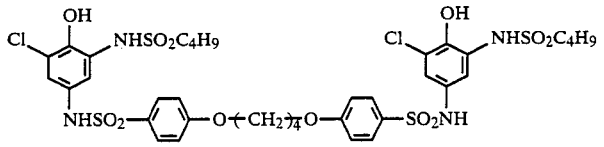
(Q-89)
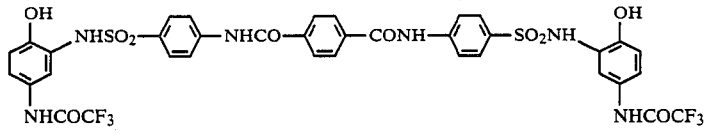
(Q-90)
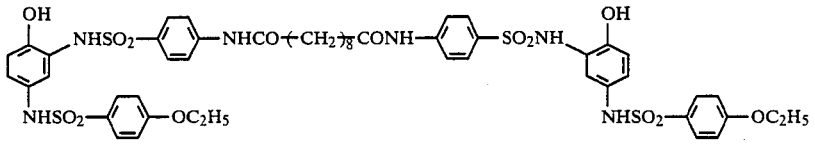
(Q-91)
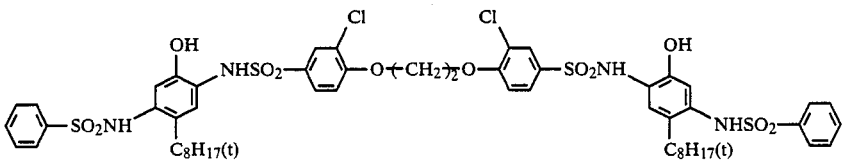
(Q-92)
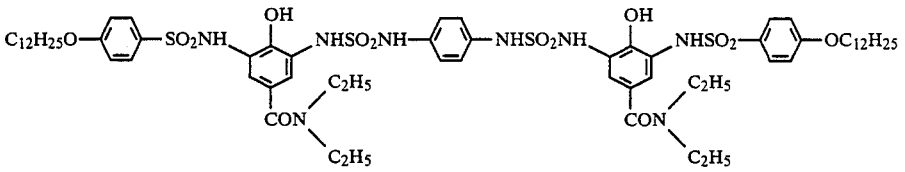
(Q-93)
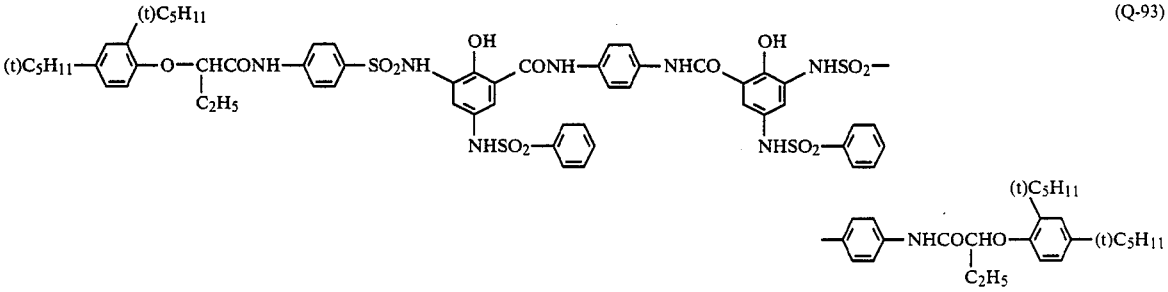
(Q-94)
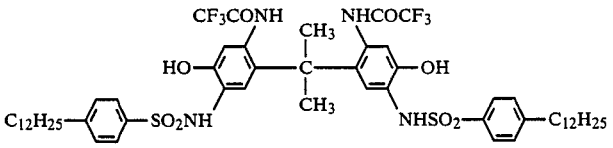
(Q-95)
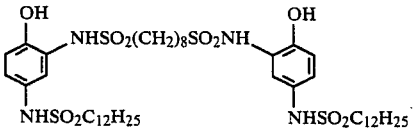
(Q-96)
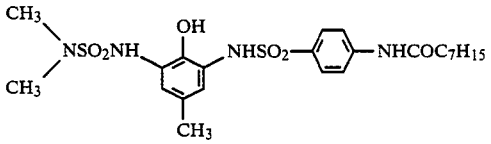
(Q-97)
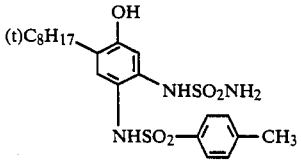
(Q-98)
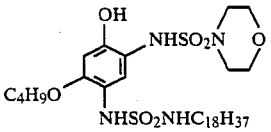

-continued

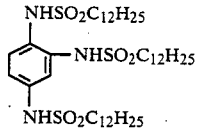

(Q-99)

Among the compounds represented by the formula [31] or [32], particularly preferable ones are ester of gallic acid and gallic acid amide.

The compound represented by the formula [31] or [32] may be contained in a sensitive silver halide emulsion and/or internal latent image type silver halide emulsion which has been internally fogged. The compound is contained in an amount of $1\times10^{-5}$ to $1\times10^{-1}$ mol, preferably $1\times10^{-4}$ to $3\times10^{-2}$ mol per mol of silver halide contained in a layer that the compound is to be contained. The compound represented by the formula [31] or [32] may be contained in a layer adjacent to the layer which comprises the sensitive silver halide emulsion and/or internal latent image type silver halide emulsion which has been internally fogged or in both of the adjacent layer and the emulsion-coated layer.

In the case of adding such additives not necessary to absorb to silver halide crystals to the emulsion as a color-forming coupler, colored coupler, DIR compound, image stabilizer, anti color fog agent, ultraviolet absorbing agent, and fluorescent whitening agent, a hydrophobic compound can be added according to a solid dispersion method, latex dispersion method, oil-in-water type emulsion dispersion method, and other methods. Among these methods, a suitable one can be selected depending on the chemical structure and others of a hydrophobic compound such as a coupler. As the oil-in-water type emulsifying dispersion method, a known method of dispersing a hydrophobic additive such as a coupler is applicable. Generally, a low boiling and/or water soluble organic solvent is dissolved in a high boiling organic solvent having a boiling point of not less than about 150° C., as necessary. The resulting solvent is subjected to the emulsifying dispersion in a hydrophilic binder such as an aqueous solution of gelatin with a surface active agent by means of a dispersing apparatus such as an agitator, homogenizer, colloid mill, flowdgit mixer, and ultrasonic apparatus. Then, the resulting dispersion is added to a desired hydrophilic colloidal solution. There may be added a process of removing the low boiling organic solvent from the dispersion after or at a moment of dispersion.

When the dye-forming coupler, colored coupler, DIR compound, image stabilizer, anti color fog, ultraviolet absorbing agent, and fluorescent whitening agent have an acid group such as carboxylic acid and sulfonic acid, they may be introduced into a hydrophilic colloid as an alkaline aqueous solution.

When the hydrophobic compound is dissolved in a low boiling solvent alone or in a solvent used with a high boiling solvent and dispersed in water mechanically or by means of supersonic waves, there is employed a dispersing agent such as anionic surface active agent, nonionic surface active agent, cation surface active agent, and ampholytic surface active agent.

A color fog inhibitor may be used to prevent the occurrence of turbid color, degradation of sharpness, and prominence of grainness due to the transfer of the oxidized product of a color developing agent or an electron-transfer agent between the emulsion layers of light-sensitive material (between the same color-sensitive layers and/or different color-sensitive layers).

This color fog inhibitor may be contained in the emulsion layer or in an intermediate layer which is disposed between the neighboring emulsion layers.

The light-sensitive material may include an image stabilizing agent which prevents the degradation of colored images.

The hydrophilic colloid layer such as the protection and intermediate layers of the light-sensitive material may contain an ultraviolet absorbent therein to prevent the occurrence of fog due to electric discharge which occurs when the light-sensitive material is frictionally charged or to prevent the images from being degraded due to ultraviolet rays.

To prevent the degradation of a magenta color-forming coupler by formalin during the storage of the light-sensitive material, a formalin scavenger may be used in the light-sensitive material.

When dye and ultraviolet absorbent are contained in the hydrophilic colloid layer of the light-sensitive material, they may be mordanted with a mordant such as a cationic polymer.

A bleaching accelerator or a compound capable of varying the developing property of the light-sensitive material such as development accelerator and retarder may be added to the silver halide emulsion layer and/or other hydrophilic colloid layers. For the acceleration of the development and other purposes, a black-and-white developing agent and/or its precursor may be used.

In order to improve the sensitivity or contrast or to accelerate the development, the emulsion layer of the light-sensitive material may contain polyalkylene oxide or a derivative, such as its ether, ester, and amine, thioether compound, thiomorpholines, quaternary ammonium compound, urethane derivative, urea derivative, or imidazole derivative.

To enhance a white background be white and to prevent the coloring of the white background from being conspicuous, a fluorescent whitening agent may be used for the light-sensitive material.

The light-sensitive material may be provided with an auxiliary layer such as a filter layer, antihalation layer, and antiirradiation layer. These layers and/or the emulsion layer may contain dyes which might flow out of the light-sensitive material or be bleached during the developing treatment.

A matting agent may be added to the silver halide emulsion layer and/or the other hydrophilic colloid layer for the light-sensitive material in order to lower the gloss of the sensitized material, to improve the aptitude to retouching, and to prevent the mutual adhesion of the sensitized materials.

A lubricant may be added to the sensitized material to reduce slipping friction.

An antistatic agent may be added to prevent electrification.

Various surface active agents may be used in the photographic emulsion layer and/or other hydrophilic colloid layer for the light-sensitive material for the improvement of coating properties, prevention of electrification, improvement of slippage, emulsification and dispersion, prevention of adhesion, and improvement of photographic properties (acceleration of development, hardening, intensification).

Examples of the support used in the light-sensitive material of the present invention include a flexible reflecting support such as synthetic paper and paper which has been laminated with α-olefin polymer such as polyethylene, polypropylene, ethylene/butene copolymer, a film of semi-synthetic or synthetic polymer of cellulose acetate, cellulose nitrate, polystyrene, polyvinyl chloride, polyethylene terephthalate, polycarbonate, and polyamide, a flexible support prepared by disposing a reflecting layer on the above film, glass, metal, and ceramics.

For the coating of the sensitized material, a thickener may be used to improve the coating properties. For example, in the case of a hardener which reacts quickly and gells prior to the coating if added to the coating solution in advance, it is desirable to mix the hardener with a static mixer just before the coating.

Particularly useful coating methods are extrusion coating and curtain coating which can coat at least two layers simultaneously. In addition, a packet coating may be used depending on the purposes. The coating speed can be selected optionally.

Thickness of the emulsion layer and silver density to be coated are not particularly restricted but in order to coat the emulsion layer as thin as possible and to prevent the degradation of the grainness and pressure fog properties, it is desirable to construct at least one of the layers containing the sensitive silver halide on the support so that when the silver density (d) is defined by the equation:

$$d=N/V,$$

where, N is a total amount (unit: g) of silver (equivalent to metal silver) contained in the aforementioned sensitive silver halide emulsion layer and V is the volume (unit: $cm^3$) of the above sensitive silver halide emulsion layer, the silver density (d) is expressed as $d \geqq 5.0\times10^{-1}$ g/$cm^3$, and the layer having the above silver density and/or its adjacent layer contains the silver halide emulsion which has fog nuclei therein.

In this manner, an interesting effect has been attained at the same time that the silver halide photographic light-sensitive material is excellent in the storage stability under the circumstances of high humidity, R.H. of not less than 60%.

It is preferable that the silver density of the silver halide emulsion layer according to the present invention is not less than $5.0\times10^{-1}$ g/$cm^3$ to complete an object of the present invention. In view of the fog, however, the silver density is preferable to be not more than 2.0 g/$cm^3$, more desirably in the range of not less than $6.0\times10^{-1}$ g/$cm^3$ and not more than 1.2 g/$cm^3$.

The above silver density is applied to define the light-sensitive silver halide emulsion excepting the silver halide emulsion having fog nuclei therein.

The volume V of the light-sensitive emulsion layer is expressed by the product of the coated area and the dry film thickness.

For measuring the above silver content, the atomic absorption analysis can be used.

The above dry film thickness is measured by enlarging the section of a dry sample with a scanning electron microscope to take a picture and measuring a film thickness of each layer.

To obtain a color image with the light-sensitive material of the present invention, exposure shall be followed by the color developing process known in the industry.

EXAMPLES

The present invention will be specifically described below with reference to working examples but not limited to those examples.

With respect to the sensitive silver halide emulsion to be used in the present invention, Table 1 shows silver iodobromide emulsions Em-1 to Em-7 having different silver iodide contents prepared by the double jet method using the known 0.1 μm seed emulsion.

TABLE 1

| Emulsion No. | Average grain size (μm) | Variation coefficient of grain size (%) | Silver iodide content (%) | | | Volume ratio of shell |
|---|---|---|---|---|---|---|
| | | | Average | Core | Shell | |
| Em-1 | 0.30 | 13 | 6 | 6 | 6 | — |
| Em-2 | 0.50 | 15 | 7 | 7 | 7 | — |
| Em-3 | 0.48 | 12 | 6 | 6 | 6 | — |
| Em-4 | 0.80 | 15 | 5 | 5 | 5 | — |
| Em-5 | 0.32 | 14 | 6 | 10 | 1 | 44 |
| Em-6 | 0.49 | 15 | 8 | 15 | 2 | 54 |
| Em-7 | 0.50 | 14 | 7.5 | 20 | 0.5 | 61 |

Then, coating samples were prepared.

In the following examples, the amount of additives in the silver halide photographic light-sensitive material is expressed per 1 $m^2$. Silver halide and colloidal silver are expressed as converted to silver.

Preparation of Comparison Samples:

On a cellulose triacetate film support were superimposed the layers having the following components one after another to prepare a multi-layer color image component sample 1.

| Sample 1 (Comparison) | |
|---|---|
| First layer: | Antihalation layer (HC-1)<br>This is formed of a gelatin layer containing black colloidal silver. |
| Second layer: | Intermediate layer (I. L.)<br>This is formed of a gelatin layer containing an emulsified dispersion of 2,5-di-t-octyl hydroquinone (AS-1). |
| Third layer: | Red-sensitive silver halide emulsion layer with low sensitivity (RL-1)<br>Em-1 . . . Amount of silver coated: 1.8 g/$m^2$<br>Sensitizing dye I . . .<br>$6\times10^{-5}$ mol per mol of silver<br>Sensitizing dye II . . .<br>$1.0\times10^{-5}$ mol per mol of silver<br>Cyan coupler (C-1) . . .<br>0.06 mol per mol of silver<br>Colored cyan coupler (CC-1) . . .<br>0.003 mol per mol of silver<br>DIR compound (A) . . .<br>0.0015 mol per mol of silver |

-continued

| Sample 1 (Comparison) | |
|---|---|
| | DIR compound (B) . . . |
| | 0.002 mol per mol of silver |
| Fourth layer: | Red-sensitive silver halide emulsion layer with high sensitivity (RH-1) |
| | Em-2 . . . Amount of silver coated: 1.3 g/m$^2$ |
| | Sensitizing dye I . . . |
| | $3 \times 10^{-5}$ mol per mol of silver |
| | Sensitizing dye II . . . |
| | $1.0 \times 10^{-5}$ mol per mol of silver |
| | Cyan coupler (C-1) . . . |
| | 0.02 mol per mol of silver |
| | Colored cyan coupler (CC-1) . . . |
| | 0.0015 mol per mol of silver |
| | DIR compound (B) . . . |
| | 0.001 mol per mol of silver |
| Fifth layer: | Intermediate layer (I. L.) |
| | This is formed of the same gelatin layer as the second layer. |
| Sixth layer: | Green-sensitive silver halide emulsion layer with low sensitivity (GL-1) |
| | Em-1 . . . Amount of silver coated: 1.5 g/m$^2$ |
| | Sensitizing dye III . . . |
| | $2.5 \times 10^{-5}$ mol per mol of silver |
| | Sensitizing dye IV . . . |
| | $1.2 \times 10^{-5}$ mol per mol of silver |
| | Magenta coupler (M-1) . . . |
| | 0.050 mol per mol of silver |
| | Colored magenta coupler (CM-1) . . . |
| | 0.009 mol per mol of silver |
| | DIR compound (A) . . . |
| | 0.0010 mol per mol of silver |
| | DIR compound (C) . . . |
| | 0.0030 mol per mol of silver |
| Seventh layer: | Green-sensitive silver halide emulsion layer with high sensitivity (GH-1) |
| | Em-2 . . . Amount of silver coated: 1.4 g/m$^2$ |
| | Sensitizing dye III . . . |
| | $1.5 \times 10^{-5}$ mol per mol of silver |
| | Sensitizing dye IV . . . |
| | $1.0 \times 10^{-5}$ mol per mol of silver |
| | Magenta coupler (M-1) . . . |
| | 0.020 mol per mol of silver |
| | Colored magenta coupler (CM-1) . . . |
| | 0.002 mol per mol of silver |
| | DIR compound (C) . . . |
| | 0.0010 mol per mol of silver |
| Eighth layer: | Yellow filter layer (YC-1) |
| | This is formed of a gelatin layer containing a yellow colloidal silver and emulsion dispersion of AS-1. |
| Ninth layer: | Blue-sensitive silver halide emulsion layer with low sensitivity (BL-1) |
| | Em-3 . . . Amount of silver coated: 0.9 g/m$^2$ |
| | Sensitizing dye V . . . |
| | $1.3 \times 10^{-5}$ mol per mol of silver |
| | Yellow coupler (Y-1) . . . |
| | 0.29 mol per mol of silver |
| Tenth layer: | Blue-sensitive emulsion layer with high sensitivity (BH-1) |
| | Em-4 . . . Amount of silver coated: 0.5 g/m$^2$ |
| | Sensitizing dye V . . . |
| | $1.0 \times 10^{-5}$ mol per mol of silver |
| | Yellow coupler (Y-1) . . . |
| | 0.08 mol per mol of silver |
| | DIR compound (D) . . . |
| | 0.0015 mol per mol of silver |
| Eleventh layer: | First protective layer (Pro-1) |
| | This is formed of a gelatin layer containing silver iodide/bromide (Ag I 1 mol %, average grain size 0.07 μm), an amount of silver coated 0.5 g/m$^2$, and ultraviolet absorbing agents UV-1 and UV-2. |
| Twelfth layer: | Second protective layer (Pro-2) |
| | This is formed of a gelatin layer containing polymethyl methacrylate grains (diameter: 1.5 m) and formalin scavenger (HS-1). |

Each layer was further added with a gelatin hardener (H-1) and a surface active agent in addition to the above additives.

The compounds contained in each layer of the sample 1 are as follows:

Sensitizing dye I: Anhydro 5,5'-dichloro-9-ethyl-3,3'-di-(3-sulfopropyl)thiacarbocyanine hydroxyde Sensitizing dye II: Anhydro 9-ethyl-3,3'-di-(3-sulfopropyl)-4,5,4',5'-dibenzothiacarbocyanine hydroxyde Sensitizing dye III: Anhydro 5,5'-diphenyl-9-ethyl-3,3'-di-(3-sulfopropyl) oxacarbocyanine hydroxyde Sensitizing dye IV: Anhydro 9-ethyl-3,3'-di-(3-sulfopropyl)-5,6,5',6'-dibenzooxacacarbocyanine hydroxyde Sensitizing dye V: Anhydro 3,3'-di-(3-sulfopropyl)-4,5-benzo-5'-methoxythiacyanine The following (A) to (D) illustrate comparison compounds.

(A)

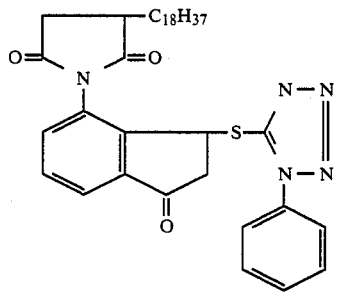

(B)

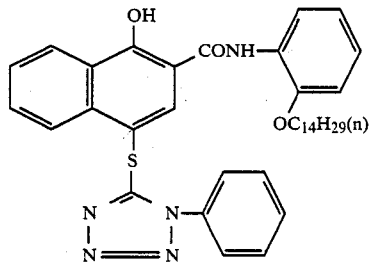

-continued
(C)
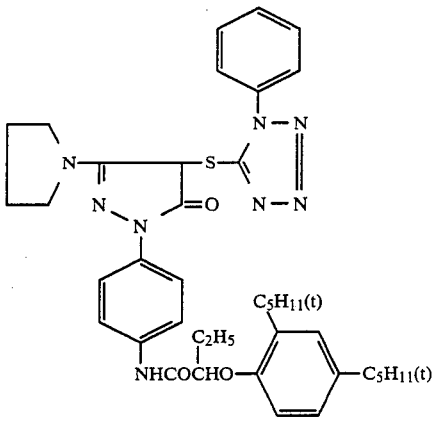
(D)
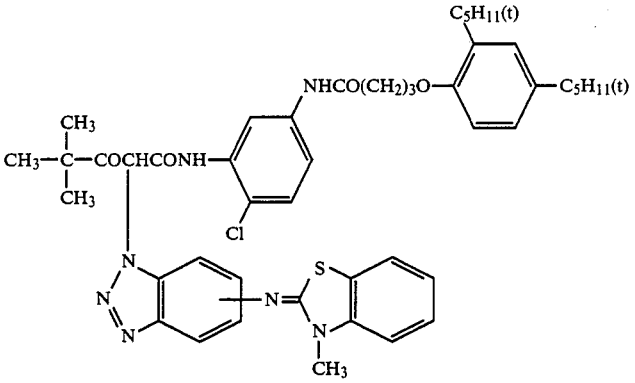
C-1
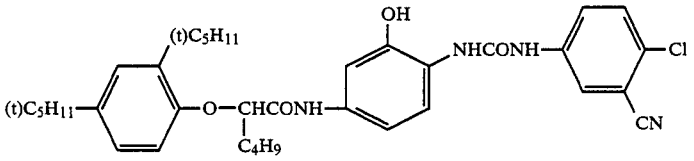
CC-1
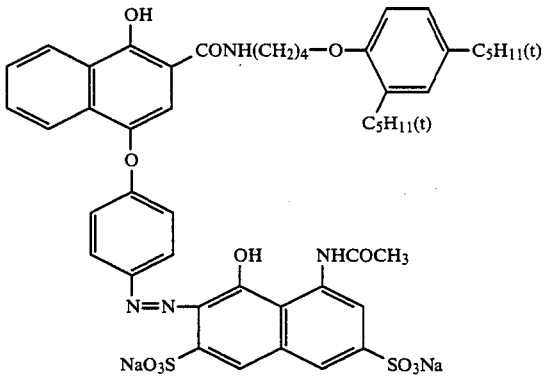
M-1
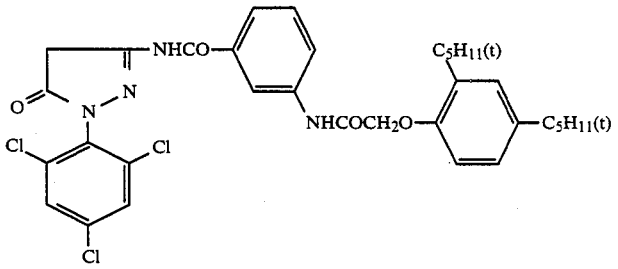

-continued

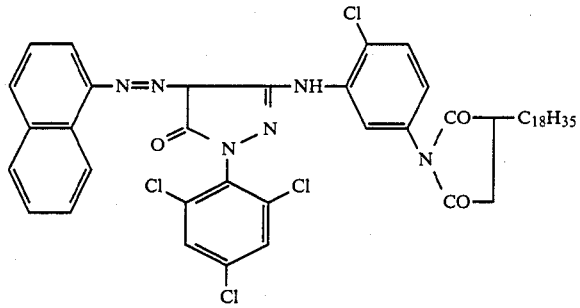

CM-1

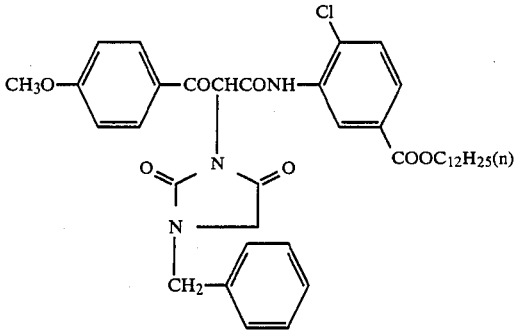

Y-1

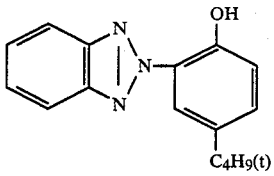

UV-1

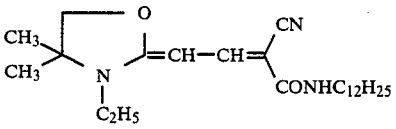

UV-2

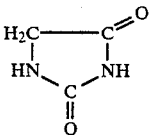

HS-1

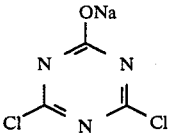

H-1

EXAMPLE 1

Preparation of fog nuclei-containing silver halide emulsion

A pure monodisperse silver bromide emulsion prepared according to a known method and being a cubic system having an average grain size of 0.15 μm was adjusted to have PAg 6 and PH 7, then added with thiourea dioxide and chloroauric acid. The resulting mixture was ripened for 60 minutes at 60° C. to obtain a fogged emulsion.

Part of the emulsion was taken and vigorously stirred at 60° C., then added with an aqueous solution of silver nitrate and an aqueous solution of potassium bromide to grow its crystals by the double jet method while maintaining its PAg and PH at 9 and 6 respectively, to produce a monodisperse emulsion of cubic crystals having an average grain size of 0.25 μm.

The degree of internal fog of the emulsion was 0.99 and the ratio of silver fogged by the surfacwe development was not more than 1%. The variation coefficient of the grain size was 0.17 (referred to as Em-A). Em-B was prepared by the same manner as in Em-A except that the ripening time for fogging was changed to 5 minutes. The Em-B had the degree of internal fog of 0.65 and the ratio of silver fogged by the surface development and the variation coefficient of the grain size were same with those of Em-A.

The DIR compounds B, C, and Em-1 or -2 for the 3rd, 4th, 6th, and 7th layers of the Comparison Sample No. 1 were replaced by those as shown in Table 2. As shown in Table 2, the silver halide emulsion emulsion containing fog nuclei therein was added to the above layers and the aforementioned non-color-forming coupler and/or the aforementioned anti color fog was added to the 3rd, 4th, 6th to 8th layers to prepare Samples No. 2 to No. 20.

TABLE 2

| | Third layer (RL-1) | | | | | Fourth layer (RH-1) | | | | |
|---|---|---|---|---|---|---|---|---|---|---|
| | | | Internal fogged Em | | Kind and amount added of non-color-forming | | | Internal fogged Em | | Kind and amount added of non-color-forming |
| Sample No. | Em No. | Compound Kind | Em No. | Amount added g/m² | coupler and/or anti color-fog agent | Em No. | Compound Kind | Em No. | Amount added g/m² | coupler and/or anti color-fog agent |
| 1 (comparison) | Em-1 | B | — | — | — | Em2 | B | — | — | — |
| 2 (comparison) | " | B | Em-A | 0.3 | — | " | B | Em-A | 0.2 | — |
| 3 (comparison) | " | D-4 | — | — | — | " | D-4 | — | — | — |
| 4 (comparison) | " | D-16 | — | — | — | " | D-16 | — | — | — |
| 5 (comparison) | " | D-20 | — | — | — | " | D-20 | — | — | — |
| 6 (comparison) | " | D-61 | — | — | — | " | D-61 | — | — | — |
| 7 (Present invention) | " | D-3 | Em-A | 0.3 | — | " | D-3 | Em-A | 0.2 | — |
| 8 (Present invention) | " | D-16 | " | " | — | " | D-16 | " | " | — |
| 9 (Present invention) | " | D-20 | " | " | — | " | D-20 | " | " | — |
| 10 (Present invention) | " | D-61 | " | " | — | " | D-61 | " | " | — |
| 11 (Present invention) | " | D-62 | " | " | — | " | D-62 | " | " | — |
| 12 (Present invention) | " | D-16 | " | " | — | " | D-16 | " | " | — |
| 13 (Present invention) | " | D-16 | Em-B | " | — | " | D-16 | Em-B | " | — |
| 14 (Present invention) | " | D-18 | Em-A | 0.4 | — | " | D-18 | Em-A | 0.2 | — |
| 15 (Present invention) | Em-5 | D-16 | " | 0.3 | — | Em-6 | D-16 | " | " | — |
| 16 (Present invention) | " | D-16 | " | " | — | Em-7 | D-16 | " | " | — |
| 17 (Present invention) | Em-1 | D-16 | " | " | — | Em-2 | D-16 | " | " | |
| 18 (Present invention) | " | D-16 | " | " | — | " | D-16 | " | " | Add 0.002 mol of DS-29 per mol of Ag |
| 19 (Present invention) | " | D-16 | " | " | Add 0.0017 mol of Q-15 per mol of Ag | " | D-16 | " | " | Add 0.002 mol of Q-15 per mol of Ag |
| 20 (Present invention) | " | D-16 | " | " | Add 0.0017 mol of Q-24 per mol of Ag | " | D-16 | " | " | Add 0.001 mol of Q-24 per mol of Ag Add 0.001 mol of DS-29 per mol of Ag |

| | Fifth layer (IL) | | | Sixth layer (GL-1) | | | | |
|---|---|---|---|---|---|---|---|---|
| | Internal fogged Em | | Kind and amount | | | Internal fogged Em | | Kind and amount |
| Sample No. | Em No. | Amount added glm² | added of non-color-forming coupler and/or anit color-fog agent | Em No. | Compound Kind | Em No. | Amount added glm² | added of non-color-forming coupler and/or anti color-fog agent |
| 1 (comparison) | — | — | — | Em-1 | c | — | — | — |
| 2 (comparison) | — | — | — | " | c | Em-A | 0.4 | — |
| 3 (comparison) | — | — | — | " | D-4 | — | — | — |
| 4 (comparison) | — | — | — | " | D-16 | — | — | — |
| 5 (comparison) | — | — | — | " | D-10 | — | — | — |
| 6 (comparison) | — | — | — | " | D-59 | — | — | — |
| 7 (Present invention) | — | — | — | " | D-4 | Em-A | 0.4 | — |
| 8 (Present invention) | — | — | — | " | D-16 | " | " | — |
| 9 (Present invention) | — | — | — | " | D-10 | " | " | — |
| 10 (Present invention) | — | — | — | " | D-59 | " | " | — |
| 11 (Present invention) | — | — | — | " | D-60 | " | " | — |
| 12 (Present invention) | Em-A | 0.5 | — | " | D-16 | " | " | — |
| 13 (Present invention) | — | — | — | " | D-16 | Em-B | " | — |
| 14 (Present | Em-A | 0.5 | — | " | D-55 | " | " | — |

TABLE 2-continued

| | | | | | | | | |
|---|---|---|---|---|---|---|---|---|
| invention) | | | | | | | | |
| 15 (Present invention) | — | — | — | Em-5 | D-16 | " | " | — |
| 16 (Present invention) | — | — | — | " | D-16 | " | " | — |
| 17 (Present invention) | — | — | Add $1.5 \times 10^{-4}$ mol/m$^2$ DS-33 instead of As-1 | Em-1 | D-16 | " | " | — |
| 18 (Present invention) | — | — | Add $1.5 \times 10^{-4}$ mol/m$^2$ of DS-29 instead of As-1 | " | D-16 | " | " | — |
| 19 (Present invention) | — | — | — | " | D-16 | " | " | Add 0.0015 mol of Q-15 per mol of Ag |
| 20 (Present invention) | — | — | Add $1.5 \times 10^{-4}$ mol/m$^2$ of DS-29 instead of AS-1 | " | D-16 | " | " | Add 0.0015 mol of Q-24 per mol of Ag |

| | | | Seventh layer (GH-1) | | | Eighth layer (YC-1) |
|---|---|---|---|---|---|---|
| | | | Internal fogged Em | | Kind and amount | Kind and amount |
| Sample No. | Em No. | Compound Kind | Em No. | Amount added glm$^2$ | added of non-color-forming coupler and/or anti color-fog agent | added of non-color-forming coupler and/or anti color-fog agent |
| 1 (comparison) | Em2 | c | — | — | — | — |
| 2 (comparison) | " | c | Em-A | 0.1 | — | — |
| 3 (comparison) | " | D-4 | — | — | — | — |
| 4 (comparison) | " | D-16 | — | — | — | — |
| 5 (comparison) | " | D-10 | — | — | — | — |
| 6 (comparison) | " | D-59 | — | — | — | — |
| 7 (Present invention) | " | D-4 | Em-A | 0.1 | — | — |
| 8 (Present invention) | " | D-16 | " | " | — | — |
| 9 (Present invention) | " | D-10 | " | " | — | — |
| 10 (Present invention) | " | D-59 | " | " | — | — |
| 11 (Present invention) | " | D60 | " | " | — | — |
| 12 (Present invention) | " | D-16 | " | " | — | — |
| 13 (Present invention) | " | D-16 | Em-B | " | — | — |
| 14 (Present invention) | " | D-55 | " | " | — | — |
| 15 (Present invention) | Em-6 | D-16 | " | " | — | — |
| 16 (Present invention) | Em-7 | D-16 | " | " | — | — |
| 17 (Present invention) | Em-2 | D-16 | " | " | | Add $1.5 \times 10^{-4}$/m$^2$ of DS-33 instead of AS-1 |
| 18 (Present invention) | " | D-16 | " | " | Add 0.002 mol of DS-29 per mol of Ag | Add $1.5 \times 10^{-4}$/m$^2$ OF DS-29 instead of As-1 |
| 19 (Present invention) | " | D-16 | " | " | Add 0.002 mol of Q-15 per mol of Ag | — |
| 20 (Present invention) | " | D-16 | " | " | Add 0.001 mol of Q-24 per mol of Ag Add 0.001 mol of DS-29 per mol of Ag | Add $1.5 \times 10^{-4}$/m$^2$ of DS-29 instead of AS-1 |

Samples No. 1 to No. 20 thus prepraed were undergone the wedge exposure with white light and the white exposure through the sharp measuring pattern to conduct the following developing treatment.

| Treating process (38° C.) | |
|---|---|
| Coloring development | 3 minutes 15 seconds |
| Bleaching | 6 minutes 30 seconds |
| Rinsing | 3 minutes 15 seconds |
| Fixing | 6 minutes 30 seconds |
| Rinsing | 3 minutes 15 seconds |
| Stabilizing | 1 minute 30 seconds |

-continued

| Treating process (38° C.) |
|---|
| Drying |

The treating solution used in each process contain the following components:

Color Developer

Water was added to the following to prepare one liter of the developer.

| | |
|---|---|
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Tri sodium nitrilotriacetate mono hydrate | 2.5 g |
| Potassium hydroxide | 1.0 g |

Bleaching Solution

Water was added to the following to prepare one liter of this solution and its pH was adjusted to 6.0 with ammonia water.

| | |
|---|---|
| Ferric ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |

Fixer

Water was added to the following to prepare one liter of the fixer and its pH was adjusted to 6.0 with acetic acid.

| | |
|---|---|
| Ammonium thiosulfate | 175.0 g |
| Anhydrous sodium sulfite | 8.5 g |
| Sodium metasulfite | 2.3 g |

Stabilizing Solution

Water was added to the following to prepare one liter of this solution.

| | |
|---|---|
| Formalin (37% aqueous solution) | 1.5 ml |
| KONIDUCKS (Konishiroku Photo Industry Co., Ltd.) | 7.5 ml |

Table 3 shows the sensitivity and MTF sharpness measured as the red light and green light density. As a result, the samples which are prepared by combining the diffusible DIR compound and silver halide emulsion having fog nuclei therein of the present invention were observed to have attained remarkable improvement in sharpness while retaining a high sensitivity.

It was also found that the silver halide emulsion containing fog nuclei therein had better effects as the degree of internal fog is high.

Further, the sharpness was improved at high sensitivity when core/shell type silver halide emulsion was used.

It was also observed that the addition of a non-color-forming coupler and an anti color-fog agent had a better effect of improving the sharpness.

TABLE 3

| | Red sensitive layer | | | Green sensitive layer | | |
|---|---|---|---|---|---|---|
| | Relative* | Sharpness (MTF)* | | Relative* | Sharpness (MTF)* | |
| Sample No. | sensitivity | 5 cycle/mm | 50 cycle/mm | sensitivity | 5 cycle/mm | 50 cycle/mm |
| 1 (Comparison) | 100 | 100 | 100 | 100 | 100 | 100 |
| 2 (Comparison) | 110 | 88 | 85 | 110 | 90 | 88 |
| 3 (Comparison) | 83 | 106 | 104 | 81 | 103 | 103 |
| 4 (Comparison) | 86 | 108 | 103 | 85 | 105 | 104 |
| 5 (Comparison) | 85 | 110 | 105 | 88 | 107 | 105 |
| 6 (Comparison) | 80 | 107 | 104 | 90 | 105 | 105 |
| 7 (Present invention) | 125 | 118 | 125 | 135 | 115 | 116 |
| 8 (Present invention) | 130 | 120 | 121 | 132 | 115 | 117 |
| 9 (Present invention) | 135 | 121 | 118 | 140 | 117 | 119 |
| 10 (Present invention) | 135 | 120 | 120 | 136 | 117 | 120 |
| 11 (Present invention) | 128 | 119 | 116 | 132 | 118 | 122 |
| 11 (Present invention) | 128 | 118 | 118 | 130 | 115 | 118 |
| 13 (Present invention) | 120 | 116 | 115 | 125 | 114 | 115 |
| 14 (Present invention) | 136 | 119 | 122 | 136 | 119 | 123 |
| 15 (Present invention) | 142 | 124 | 127 | 145 | 120 | 121 |
| 16 (Present invention) | 143 | 126 | 127 | 147 | 122 | 124 |
| 17 (Present invention) | 130 | 123 | 124 | 131 | 121 | 122 |
| 18 (Present invention) | 129 | 127 | 128 | 130 | 123 | 125 |
| 19 (Present invention) | 128 | 124 | 126 | 129 | 119 | 121 |
| 20 (Present invention) | 128 | 128 | 128 | 128 | 124 | 126 |

*Relative value determined by fixing each value of Sample 1 as 100.

EXAMPLE 2

Samples No. 1 to No. 20 shown in Table 2 were subjected to the white wedge exposure to evaluate their treatment running properties.

The components and temperature of the color developer in running were same as in Example 1 and the color developer was replenished at 220 ml/dm$^2$ during the running until the exchange ratio of the mother liquor reached 90%.

Table 4 shows the fog measured and the relative sensitivity determined based on the sensitivity of each sample at the beginning of the test fixed as 100. It is seen from the results shown in Table 4 that the samples prepared by combining the diffusible DIR compound and the silver halide emulsion containing the fog nuclei therein of the present invention were effectively improved in the sensitivity and the change of fog.

TABLE 4

| Sample name | Fog* | Relative sensitivity |
|---|---|---|
| 1 (Comparison) | 0.46 | 82 |
| 2 (Comparison) | 0.38 | 75 |
| 3 (Comparison) | 0.35 | 70 |
| 4 (Comparison) | 0.40 | 88 |
| 5 (Comparison) | 0.31 | 68 |
| 6 (Comparison) | 0.37 | 73 |
| 7 (Present invention) | 0.58 | 100 |
| 8 (Present invention) | 0.56 | 98 |
| 9 (Present invention) | 0.58 | 95 |
| 10 (Present invention) | 0.57 | 98 |
| 11 (Present invention) | 0.56 | 100 |
| 12 (Present invention) | 0.57 | 100 |
| 13 (Present invention) | 0.55 | 96 |
| 14 (Present invention) | 0.56 | 98 |
| 15 (Present invention) | 0.58 | 100 |
| 16 (Present invention) | 0.58 | 100 |
| 17 (Present invention) | 0.57 | 99 |
| 18 (Present invention) | 0.57 | 100 |
| 19 (Present invention) | 0.57 | 99 |
| 20 (Present invention) | 0.58 | 99 |

(*Fog prior to the test was 0.58.)

What is claimed is:

1. A silver halide photographic light-sensitive material comprising a support and at least one silver halide light-sensitive emulsion layer thereon, said emulsion layer containing a compound capable of splitting off a diffusible development-inhibitor or a precursor thereof upon a coupling reaction with an oxidized product of a color developing agent, said compound represented by COUP+Y)m Formula 1 wherein, COUP is a coupler residue, m is 1 or 2, and Y is a group bonded with COUP at a coupling position thereof and is capable of being split off to make a diffusible development-inhibitor or a precursor thereof, at least one of said emulsion layers and a layer adjacent thereto containing a silver halide emulsion comprising a silver halide grain having an internal fog nucleus.

2. The silver halide photographic light-sensitive material of claim 1, wherein a diffusibility of said diffusible development-inhibitor is not less than 0.40.

3. The silver halide photographic light-seneitive material of claim 1, wherein said Y is represented by the formula (2A), (2B), (2C), (2D), (2E), (3), (4) or (5):

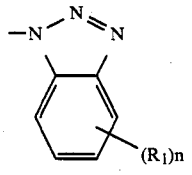

Formula (2A)

-continued

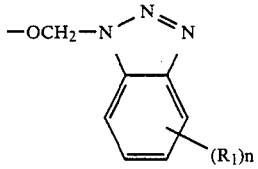

Formula (2B)

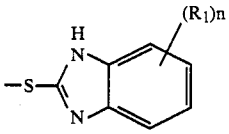

Formula (2C)

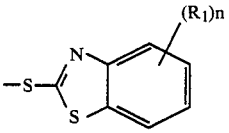

Formula (2D)

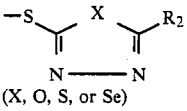

Formula (2E)

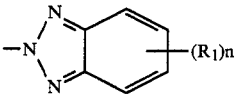

Formula (3)

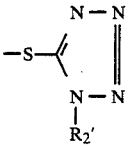

Formula (4)

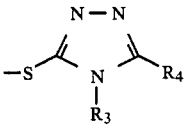

Formula (5)

wherein $R_1$ and $R_2$ are selected from the group consisting of a hydrogen atom, a halogen atom, an alkyl group, an alkoxy group, an acylamino group, an alkoxycarbonyl group, a thiazolidenamino group, an aryloxycarbonyl group, an acyloxy group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl grup and an aryloxycarbonylamino group, n is an integer 1 or 2, two of $R_1$ may be the same or different when n is 2, and the total numbers of carbon atoms containing n of $R_1$ are from 0 to 10, and numbers of carbon atoms containing in $R_2$ are from 1 to 15, $R_2$ is selected from the group consisting of an alkyl group, an aryl group and a heterocyclic group and numbers of carbon atoms containing in $R_2$ are from 1 to 15, $R_3$ is selected from a hydrogen atom, an alkyl group, an aryl group and a heterocyclic group $R_4$ is selected from the group consisting of a hydrogen atom, a halogen atom, an alkyl group, an acyl group an alkoxycarbonylamino group, aryloxycarbonylamino group, an alkansulfonamido group, a cyano group, a heterocyclic group, an alkylthio group and an amino group, and the total number of carbon atoms containing in $R_3$ and $R_4$ are 1 to 15, and X is selected from a oxygen atom, a sulfur atom and a selenium atom.

4. The silver halide photographic light-sensitive material of claim 1, wherein said Y is represented by formula (6):

-TIME-INHIBIT Formula (6)

wherein -TIME is a group bonded to a couupling positon of the coupler residue, and is capable of raleasing -INHIBIT group with a proper rate after splitting off from the coupler residue.

5. The silver halide photographic light-sensitive material of claim 4, wherein said -TIME- group is represented by the formula (7), (8), (9), (10), (11), (12) or (13):

Formula (7)

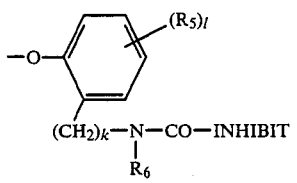

Formula (8)

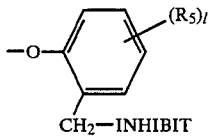

Formula (9)

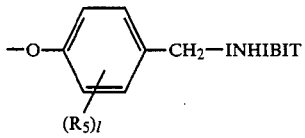

Formula (10)

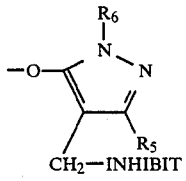

Formula(11)

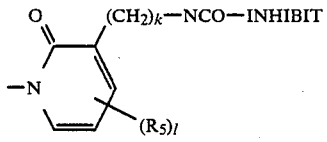

Formula (12)

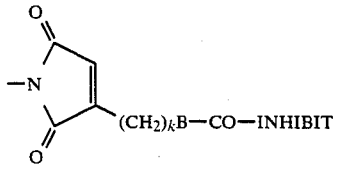

-continued formula (13)

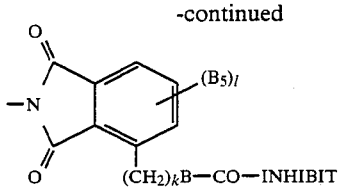

wherein $R_5$ is selected from a group consisting of a hydrogen atom, a halogen atom, an alkyl group, an alkenyl group, an aralkyl group, an alkoxycarbonyl group, an anilino group, an acylamino group, an ureido group, a cyano group, a nitro group, a sufonamido group, a sulfamoyl group, a carbamoyl group, an aryl group, a carboxy group, a sulfo group, a hydroxy group and an alkansulfonyl group, l is an integer 1 to 2, k is an integer 0 to 2, $R_6$ is selected from an alkyl group, an alkenyl group, an aralkyl group, a cycloalkyl group and an aryl group, B is a oxygen atom or $=N—R_6$, and -INHIBIT is selected from the group represented Formula (2A), (2B), (3), (4) and (5) except that the numbers of carbon atoms containing in $R_1$ are totaly 1 to 32, in $R_2$ are 1 to 32 and in $R_3$ and $R_4$ are totaly 0 to 32.

6. The silver halide photographic light-sensitive material of claim 1, said light-sensitive silver halide emulsion layer comprises monodispersed silver halide grains.

7. The silver halide photographic light-sensitive material of claim 1, wherein said light-sensitive silver halide emulsion layer comprises a core/shell type silver halide grain of which content of silver iodide at the internal portion of said grain is larger than that of at the external portion of said grain.

8. The silver halide photographic light-sensitive material of claim 1, wherein said light-sensitive material further comprises a compound represented the formula (31) or (32):

Formula (31)

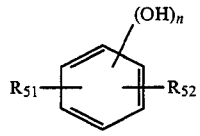

wherein n is an integer 2 or 3 and the position of hydroxyl group on the benzene ring is 1, 2 or 1, 3 or 1, 2, 3, $R_{51}$ is a hydrogen atom, a halogen atom, aliphatic group, a carboxyl group, or its salt, a sulfo group, or its salt, a carboalkoxy group, $—COR_{53}$, $—SO_2R_{54}$, $—CONHR_{55}$ or $—NHCOR_{56}$, wherein $R_{53}$, $R_{54}$, $R_{55}$ and $R_{56}$ each are an aliphatic group or an aromatic group, Formula (32)

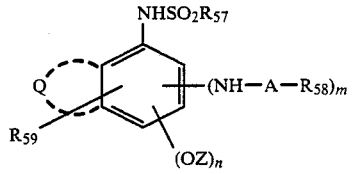

wherein A is —CO— or $—SO_2—$, $R_{57}$ and $R_{58}$ are an alkyl group, an aryl group or heterocyclic group, respectively, Z is a hydrogen atom or an alkali decomposable precursor, m is an integer 1 or 2, n is an integer 0 or 1, at least one of —NH—A—$R_{58}$ group and OZ group is placed at ortho- or parasite of $—NHSO_2R_7$ group, $R_{59}$ is selected from the group consisting of hydrogen atom, a halogen atom, a cyano group, a nitro group, an alkyl group, an aryl group, a heterocyclic group, an alkoxy group, an arylthio group, a heterocyclicthio group, a carbamoyl group, an alkoxycarbonyl group, an acyl group, an alkoxycarbonylamino group, an ureido group, an amino group, a sulfinyl group, an acylamido group, a sulfonyl group and a sulfonamido group, Q is a atomic group necessary to complete a ring, which may not be present.

* * * * *